US010859941B2

(12) United States Patent
Kyotani

(10) Patent No.: US 10,859,941 B2
(45) Date of Patent: Dec. 8, 2020

(54) IMAGE FORMING APPARATUS INCLUDING TONER CARTRIDGE HAVING TONER MEMORY AND DRUM CARTRIDGE HAVING DRUM MEMORY

(71) Applicant: BROTHER KOGYO KABUSHIKI KAISHA, Nagoya (JP)

(72) Inventor: Tadao Kyotani, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/223,659

(22) Filed: Dec. 18, 2018

(65) Prior Publication Data

US 2019/0196361 A1 Jun. 27, 2019

(30) Foreign Application Priority Data

Dec. 27, 2017 (JP) ..... 2017-252302

(51) Int. Cl.
*G03G 15/08* (2006.01)

(52) U.S. Cl.
CPC ..... *G03G 15/0863* (2013.01)

(58) Field of Classification Search
CPC ..... G03G 2221/1823; G03G 21/1889; G03G 15/0863; G03G 15/553
See application file for complete search history.

(56) References Cited

U.S. PATENT DOCUMENTS

2010/0135693 A1 6/2010 Okabe et al.
2012/0002987 A1* 1/2012 Odani ..... G03G 15/50 399/44
2013/0108282 A1* 5/2013 Sonoda ..... G03G 15/0863 399/12
2016/0139538 A1* 5/2016 Homma ..... G03G 21/1889 399/12

FOREIGN PATENT DOCUMENTS

JP 11-194682 A 7/1999
JP 2001-249589 A 9/2001
JP 2010-128336 A 6/2010
JP 2010-175619 A 8/2010

* cited by examiner

*Primary Examiner* — Walter L Lindsay, Jr.
*Assistant Examiner* — Jessica L Eley
(74) *Attorney, Agent, or Firm* — Merchant & Gould P.C.

(57) ABSTRACT

An image forming apparatus includes: a toner cartridge; a drum cartridge to which the toner cartridge is attachable; and a controller. The toner cartridge is configured to accommodate toner therein. The toner cartridge includes a toner memory. The drum cartridge includes: a photosensitive drum; and a drum memory. The controller is configured to perform: a first determination process to determine whether communication with the drum memory is established; and after determining in the first determination process that the communication with the drum memory is established, a second determination process to determine whether communication with the toner memory is established.

28 Claims, 23 Drawing Sheets

IMAGE FORMING APPARATUS INCLUDING TONER CARTRIDGE HAVING TONER MEMORY AND DRUM CARTRIDGE HAVING DRUM MEMORY

CROSS REFERENCE TO RELATED APPLICATION

This application claims priority from Japanese Patent Application No. 2017-252302 filed Dec. 27, 2017. The entire content of the priority application is incorporated herein by reference.

TECHNICAL FIELD

The present disclosure relates to an image forming apparatus.

BACKGROUND

Conventionally, an electro-photographic type image forming apparatus such as a laser printer and an LED printer is well known in the art. The image forming apparatus includes a plurality of toner cartridges and a drum cartridge. Each of the plurality of toner cartridges includes a developing roller, and is detachably attachable to the drum cartridge. In a state where each toner cartridge is attached to the drum cartridge, the developing roller of each toner cartridge is in contact with the corresponding photosensitive drum of the drum cartridge.

Further, a toner cartridge including a toner memory as a storage medium is known in the art. Various information relating to the toner cartridge is stored in the toner memory. In recent years, various information is handled not only for the toner cartridge, but also for the drum cartridge in the image forming apparatus. Accordingly, installation of a drum memory as a storage medium on the drum cartridge is demanded.

SUMMARY

As a result of installation of the toner memory on the toner cartridge and the drum memory on the drum cartridge, two determination process are required. One process is a determination process to determine whether a controller of the image forming apparatus is capable of communicating with the toner memory, and the remaining one process is a determination process to determine whether the controller of the image forming apparatus is capable of communicating with the drum memory.

In view of the foregoing, it is an object of the present disclosure to provide an image forming apparatus capable of efficiently performing determination process to determine whether a controller of the image forming apparatus is capable of communicating with a toner memory of a toner cartridge and another determination process to determine whether the controller of the image forming apparatus is capable of communicating with a drum memory of a drum cartridge.

In order to attain the above and other objects, according to one aspect, the disclosure provides an image forming apparatus including: a toner cartridge; a drum cartridge to which the toner cartridge is attachable; and a controller. The toner cartridge is configured to accommodate toner therein. The toner cartridge includes a toner memory. The drum cartridge includes: a photosensitive drum; and a drum memory. The controller is configured to perform: a first determination process to determine whether communication with the drum memory is established; and after determining in the first determination process that the communication with the drum memory is established, a second determination process to determine whether communication with the toner memory is established.

According to another aspect, the disclosure provides an image forming apparatus including: a toner cartridge; a drum cartridge to which the toner cartridge is attachable; and a controller. The toner cartridge includes a toner memory. The drum cartridge includes: a photosensitive drum; and a drum memory. The controller is configured to perform: a first determination process to determine whether communication with the drum memory is established; a second determination process to determine whether communication with the toner memory is established; and an error outputting process including: in response to determining in the first determination process that the communication with the drum memory is not established, outputting a first error; and in response to determining in the second determination process that the communication with the toner memory is not established, outputting a second error, the outputting a first error being performed in preference to the outputting a second error.

According to still another aspect, the disclosure provides an image forming apparatus including: a toner cartridge; a drum cartridge to which the toner cartridge is attachable; and a controller. The toner cartridge includes a toner memory. The drum cartridge includes; a photosensitive drum; and a drum memory. The controller is configured to perform: retrieving information stored in the toner memory from the toner memory; and writing the information retrieved from the toner memory in the retrieving into the drum memory.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

1. First Embodiment

An image forming apparatus 100 according to a first embodiment of the present disclosure will be described with reference to FIGS. 1 through 16.

<1-1. Configuration of Image Forming Apparatus>

Figure 1:
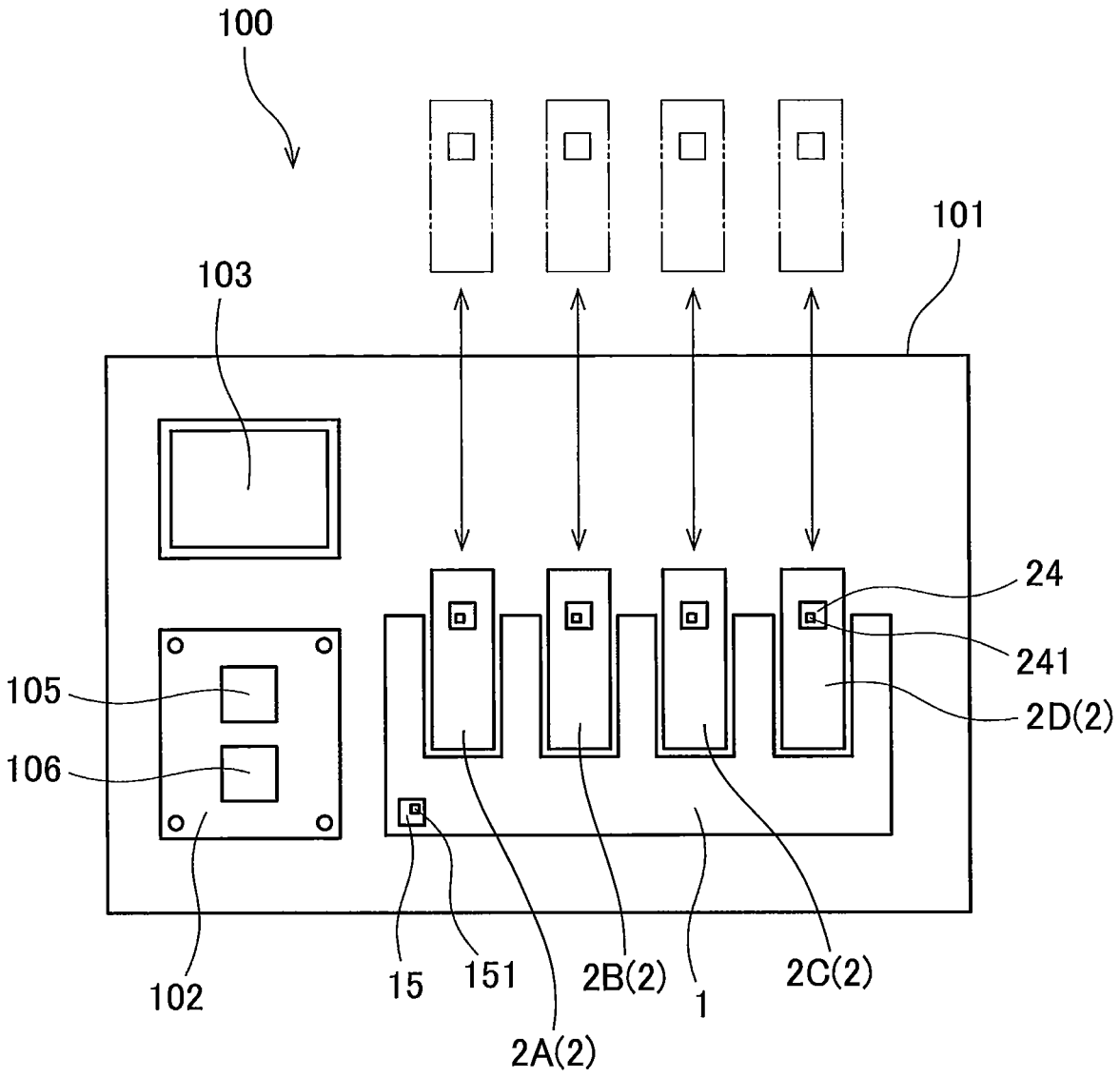
FIG. 1 is a schematic diagram illustrating an image forming apparatus according to a first embodiment of the present disclosure.

FIG. 1 is a schematic diagram of the image forming apparatus 100. The image forming apparatus 100 is an electro-photographic type printer. The image forming apparatus 100 may be a laser printer or an LED printer, for example. As illustrated in FIG. 1, the image forming apparatus 100 includes a main casing 101, a controller 102, a display 103, a drum cartridge 1, and a plurality of toner cartridges 2.

Each of the plurality of toner cartridges 2 is attachable to and detachable from the drum cartridge 1. Further, the drum cartridge 1 to which the toner cartridges 2 are attached is attachable to and detachable from the main casing 101. The toner cartridges 2 accommodate therein toners (developing agent) of colors different from each other (for example, cyan, magenta, yellow, and black).

The image forming apparatus 100 is configured to form an image on an image recording surface of a printing sheet using toners supplied from the toner cartridges 2. In the present embodiment, four toner cartridges 2 are attachable to the drum cartridge 1. However, the number of the toner cartridges 2 that can be attached to the drum cartridge 1 may be one to three, or five or more.

The drum cartridge 1 includes a drum circuit board 15 and a drum memory 151. The drum memory 151 is a storage medium from which information is readable and to which information is writable. Each of the plurality of toner cartridges 2 includes a toner circuit board 24 and a toner memory 241. The toner memory 241 is a storage medium from which information is readable and to which information is writable.

The controller 102 is positioned inside the main casing 101 of the image forming apparatus 100. The controller 102 includes a circuit board, a processor 105 such as a CPU, and a main body memory 106 which is a storage medium. The controller 102 is configured to execute various process in the image forming apparatus 100 by operating the processor 105 in accordance with programs. Specifically, the controller 102 performs a first reading process to read information from the main body memory 106, and an operation process to operate the image forming apparatus 100 on a basis of the information read in the first reading process.

As a result of attachment of the toner cartridges 2 to the drum cartridge 1, each of the toner circuit boards 24 of the toner cartridges 2 and the drum circuit board 15 are electrically connected to each other. Further, upon attachment of the drum cartridge 1 to which the toner cartridges 2 are attached to the main casing 101 of the image forming apparatus 100, the controller 102 positioned inside the main casing 101 and the drum circuit board 15 are electrically connected to each other. That is, each of the toner circuit boards 24 of the toner cartridges 2 is electrically connected to the controller 102 through the drum circuit board 15.

The display 103 is, for example, a liquid crystal display or an organic electroluminescence (EL) display. The display 103 is configured to display various information relating to operations in the image forming apparatus 100 on a screen in accordance with a command from the controller 102.

<1-2. Configuration of Drum Cartridge>

Figure 2:
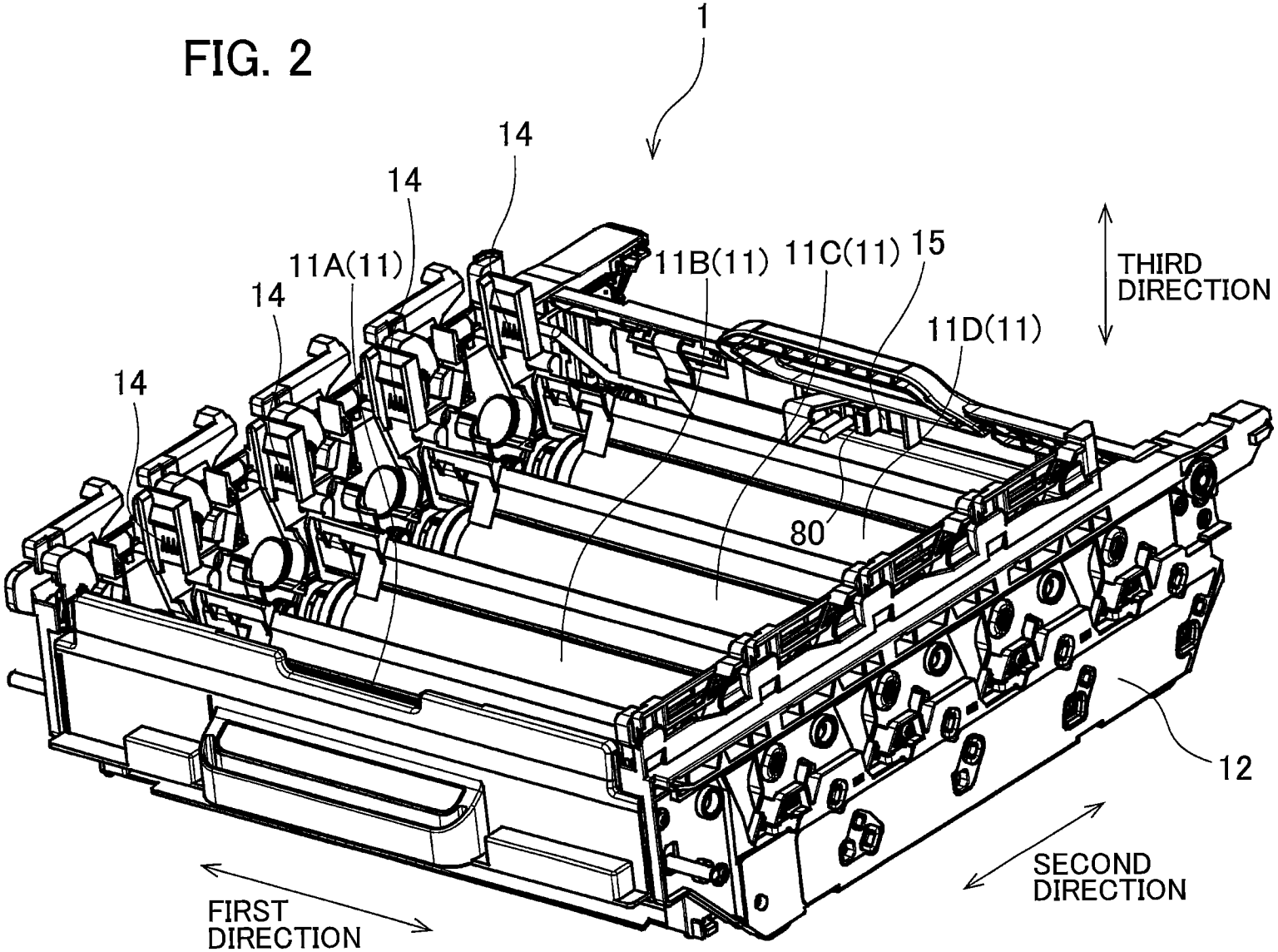
FIG. 2 is a perspective view of a drum cartridge in the image forming apparatus according to the first embodiment.
Figure 3:
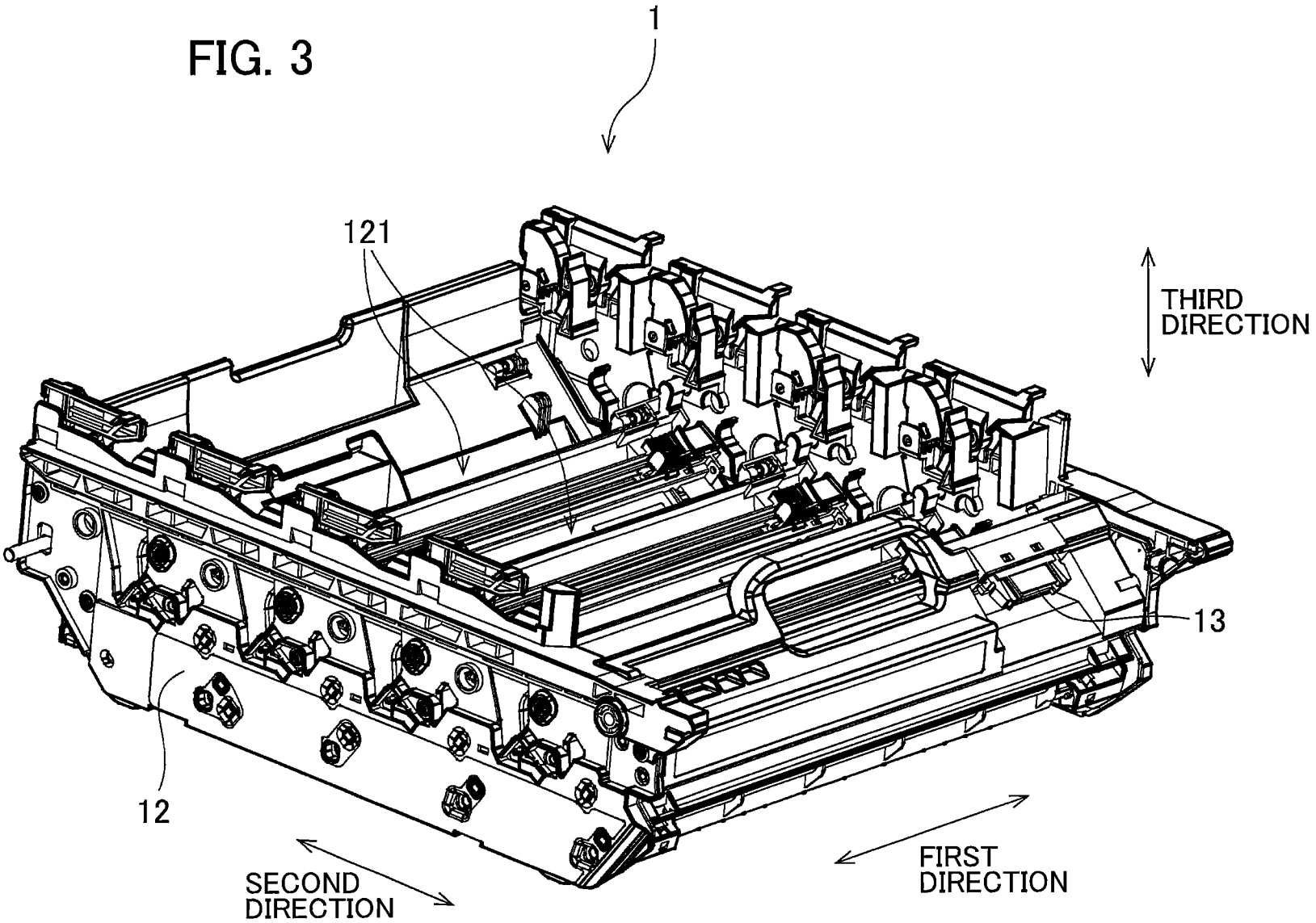
FIG. 3 is another perspective view of the drum cartridge in the image forming apparatus according to the first embodiment.

Next, configuration of the drum cartridge 1 will be described. FIGS. 2 and 3 are perspective views of the drum cartridge 1.

As illustrated in FIGS. 2 and 3, the drum cartridge 1 includes a plurality of photosensitive drums 11, a frame 12, a first electrical terminal 13, a plurality of second electrical terminals 14, and the drum circuit board 15. In the present embodiment, four of the photosensitive drums 11 and four of the second electrical terminals 14 are provided in the drum cartridge 1.

In the following description, a direction in which a rotational axis of each of the photosensitive drums 11 extends will be referred to as "first direction", and a direction in which the photosensitive drums 11 are arrayed will be referred to as "second direction". The first direction and the second direction cross each other. Preferably, the first direction and the second direction are perpendicular to each other.

Each of the photosensitive drums 11 is configured to transfer toner supplied from the corresponding toner cartridge 2 to a printing sheet. The photosensitive drums 11 are arrayed in the second direction with a gap between neighboring two photosensitive drums 11. Each of the photosensitive drums 11 has a hollow cylindrical shape extending in the first direction, and has an outer circumferential surface coated with a photosensitive material. Further, each of the photosensitive drums 11 is rotatable about the rotational axis extending in the first direction.

The frame 12 holds the plurality of photosensitive drums 11, and includes a plurality of toner cartridge holders 121 (see FIG. 3). The toner cartridge holders 121 are arrayed in the second direction with a gap between neighboring two toner cartridge holders 121. Each of the toner cartridges 2 is attachable to the corresponding toner cartridge holder 121. That is, each of the toner cartridges 2 is attachable to the frame 12. In a state where each of the toner cartridges 2 is attached to the corresponding toner cartridge holder 121 of the frame 12, the outer circumferential surface of each of the photosensitive drums 11 is in contact with an outer circumferential surface of a developing roller 22 (described later) of the corresponding toner cartridge 2.

Figure 4:
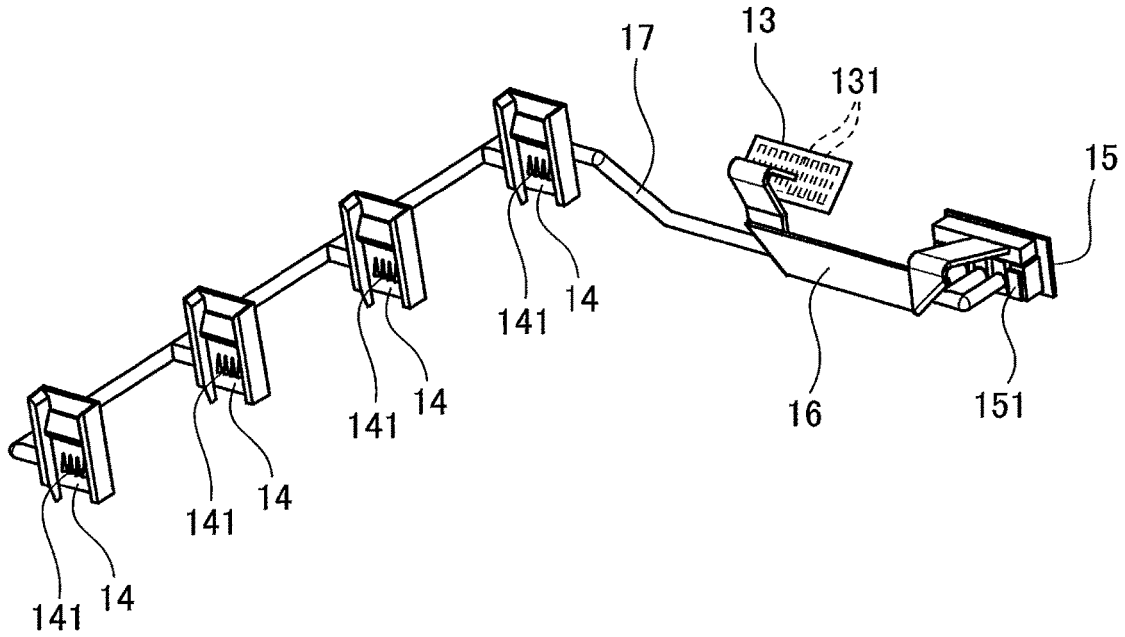
FIG. 4 is a perspective view of a first electrical terminal, second electrical terminals, and a first harness and a second harness for connecting the first electrical terminal to the second electrical terminals in the image forming apparatus according to the first embodiment.

FIG. 4 is a perspective view of the first electrical terminal 13, the second electrical terminals 14, the drum circuit board 15, and a first harness 16 and a second harness 17. The first harness 16 and the second harness 17 connect the first electrical terminal 13, the second electrical terminals 14, and the drum circuit board 15 to one another.

The first electrical terminal 13 is electrically connected to terminals provided in the main casing 101 in a state where the drum cartridge 1 is attached to the main casing 101 of the image forming apparatus 100. The first electrical terminal 13 is fixed to, for example, a surface of the frame 12. Note that the first electrical terminal 13 may be immovable or slightly movable relative to the frame 12.

The first electrical terminal 13 includes a plurality of first terminals 131. Each of the first terminals 131 is a conductor exposed to an outside. Each of the first terminals 131 is electrically connected to corresponding one of a plurality of main body-side terminals 31 (described later) of the drum circuit board 15.

Each of the second electrical terminals 14 is electrically connected to a plurality of terminals 242 (described later) of the corresponding one of the toner circuit boards 24 in a state where the toner cartridges 2 are attached to the corresponding toner cartridge holders 121. The second electrical terminal 14 is provided for each of the toner cartridge holders 121. Each of the second electrical terminals 14 is positioned at one end portion in the first direction of the corresponding toner cartridge holder 121. That is, each of the second electrical terminals 14 is fixed to, for example, the surface of the frame 12. Note that each of the second electrical terminals 14 may be immovable or slightly movable relative to the frame 12.

Each of the second electrical terminals 14 includes a plurality of second terminals 141. Each of the second terminals 141 is a conductor exposed to the outside. The second terminals 141 of each of the second electrical terminals 14 is electrically connected to corresponding one of a plurality of toner-side terminals 32 (described later) of the drum circuit board 15.

The drum circuit board 15 is a circuit board electrically connected to the first electrical terminal 13 and the second electrical terminals 14. The drum circuit board 15 is fixed to the surface of the frame 12, for example. As illustrated in FIG. 4, the drum circuit board 15 and the first electrical terminal 13 are electrically connected to each other through the first harness 16. Further, the drum circuit board 15 and each of the second electrical terminals 14 are electrically connected to each other through the second harness 17. For example, a wire harness including a plurality of conductive wires can be employed as the first harness 16 and the second harness 17.

As illustrated in FIG. 4, the drum cartridge 1 includes the drum memory 151 serving as a storage medium. The drum memory 151 is positioned on the drum circuit board 15. The drum memory 151 stores various information as to the drum cartridge 1. For example, the drum memory 151 stores at least one of information for identifying the drum cartridge 1 and information indicating characteristics of the drum cartridge 1.

The information for identifying the drum cartridge 1 includes at least one of, for example, a manufacturer's serial number of the drum cartridge 1, and an identification code indicating that the drum cartridge 1 is a genuine product. The information indicating the characteristics of the drum cartridge 1 includes at least one of, for example, models compatible with the drum cartridge 1, specification of the drum cartridge 1, lifetime of each photosensitive drum 11, charging characteristics of each photosensitive drum 11, information indicating whether or not the drum cartridge 1 is unused, accumulated rotation amount (the number of revolutions) of each photosensitive drum 11, accumulated charged of time of each photosensitive drum 11, the number of sheets that have been printed, and an error history.

Note that the drum memory 151 may not necessarily be positioned on the drum circuit board 15. Specifically, the drum memory 151 may be positioned on the surface of the frame 12.

The drum memory 151 includes a first storage area and a second storage area capable of storing information. Information stored in the first storage area is non-rewritable, while information stored in the second storage area is rewritable. The first storage area can store at least one of, for example, the manufacturer's serial number of the drum cartridge 1, the identification code for the drum cartridge 1, the models compatible with the drum cartridge 1, the specification of the drum cartridge 1, the lifetime of each photosensitive drum 11, and the charging characteristics of each photosensitive drum 11 those are mentioned above.

The second storage area can store, for example, information relating to usages of the drum cartridge 1. The usages of the drum cartridge 1 includes at least one of, for example, the information indicating whether or not the drum cartridge 1 is unused, the accumulated rotation amount of each photosensitive drum 11, the accumulated charged time of each photosensitive drum 11, the number of sheets that have been printed, and the error history described above.

The drum memory 151 can also store information relating to the toner cartridges 2. For example, the second storage area of the drum memory 151 can store information for identifying individual for each of the toner cartridges 2 attached to the drum cartridge 1. The information for identifying individual is retrieved from the toner memory 241 (described later) of each of the toner cartridges 2, for example, and written into the drum memory 151 of the drum circuit board 15. Accordingly, whether the toner cartridge 2 attached to the drum cartridge 1 is one that has been previously attached or a new one can be determined. However, the drum memory 151 may not necessarily be capable of storing the information relating to the toner cartridges 2.

The second storage area of the drum memory 151 can also store information relating to use history of the toner cartridges 2 attached to the drum cartridge 1. The information relating to use history of the toner cartridge 2 includes at least one of, for example, accumulated rotation amount (the number of revolutions) of the developing roller 22, an amount of toner that has been used, and an error history for the toner cartridge 2.

By storing information relating to use history for the toner cartridges 2 in the drum memory 151 as described above, a malfunction can be analyzed by checking the drum memory 151 without checking toner memories 241 for all the toner cartridges 2 when the malfunction occurs. However, the drum memory 151 may not necessarily be able to store the information relating to use history of the toner cartridges 2 attached to the drum cartridge 1.

<1-3. Configuration of Toner Cartridge>

Next, configurations of the toner cartridges 2 will be described. In the following description, the configuration of the toner cartridge 2 that is being attached to the drum cartridge 1 will be described using the first direction and the second direction mentioned above.

Figure 5:
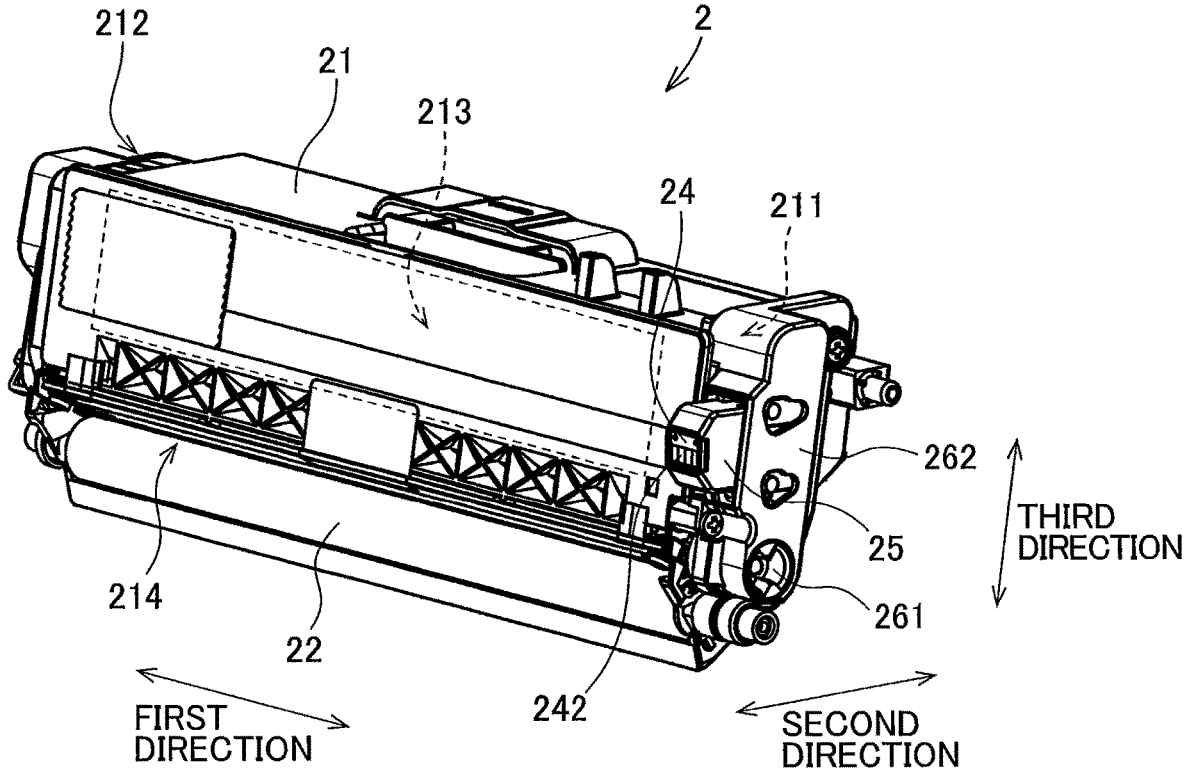
FIG. 5 is a perspective view of a toner cartridge in the image forming apparatus according to the first embodiment.

FIG. 5 is a perspective view of the toner cartridge 2. As illustrated in FIG. 5, each of the toner cartridges 2 includes a cartridge casing 21, the developing roller 22, a plurality of gears, a coupling 261, a gear cover 262, the toner circuit board 24, the toner memory 241, and a holder 25.

The cartridge casing 21 is configured to accommodate toner therein. The cartridge casing 21 has a first outer surface 211 and a second outer surface 212, and extends in the first direction between the first outer surface 211 and the second outer surface 212. An accommodation chamber 213 is provided within the cartridge casing 21. Toner is accommodated in the accommodation chamber 213. The cartridge casing 21 has an opening 214. The opening 214 is positioned at one end of the cartridge casing 21 in a third direction crossing the first direction and the second direction. The accommodation chamber 213 is in communication with an outside of the cartridge casing 21 through the opening 214.

The developing roller 22 is rotatable about a rotational axis extending in the first direction. The developing roller 22 is positioned in the opening 214 of the cartridge casing 21. That is, the developing roller 22 is positioned at the one end of the cartridge casing 21 in the third direction. In a state where the toner cartridge 2 is attached to the drum cartridge 1, the outer circumferential surface of the developing roller 22 is in contact with the outer circumferential surface of the corresponding photosensitive drum 11.

Toner is supplied from the accommodation chamber 213 to the outer circumferential surface of the photosensitive drum 11 through the developing roller 22. At this time, the toner carried onto the outer circumferential surface of the developing roller 22 moves from the developing roller 22 to the photosensitive drum 11 in accordance with an electrostatic latent image formed on the outer circumferential surface of the photosensitive drum 11. As a result, the electrostatic latent image on the outer circumferential surface of the photosensitive drum 11 becomes a visible image.

The plurality of gears, the coupling 261, and the gear cover 262 are positioned at the first outer surface 211 of the cartridge casing 21. The gear cover 262 is fixed to the first outer surface 211 of the cartridge casing 21 by, for example, a screw. At least a part of the plurality of gears is positioned in a space formed between the first outer surface 211 of the cartridge casing 21 and the gear cover 262.

The coupling 261 is exposed from the gear cover 262. When the drum cartridge 1 to which the plurality of toner cartridges 2 has been attached is attached to the main casing 101 of the image forming apparatus 100, a drive shaft of the image forming apparatus 100 is coupled with the coupling 261. Accordingly, rotation of the drive shaft is transmitted to the developing roller 22 through the coupling 261 and the plurality of gears.

The toner circuit board 24 is supported by the holder 25. The holder 25 is positioned in the space formed between the first outer surface 211 of the cartridge casing 21 and the gear cover 262 in the first direction. However, the holder 25 may be provided at a position in the toner cartridge 2 other than the position described above. Note that, it is preferable that the holder 25 is movable in the second direction relative to the cartridge casing 21 and the gear cover 262.

The toner circuit board 24 has the plurality of terminals 242. Each of the terminals 242 is a conductor exposed to the outside. When the toner cartridge 2 is attached to the corresponding toner cartridge holder 121 of the drum cartridge 1, each of the terminals 242 contacts the corresponding one of the second terminals 141. In the present embodiment, the number of the terminals 242 of each of the toner circuit boards 24 is four, and the number of the second terminals 141 of each of the second electrical terminals 14 is four.

Each of the toner cartridges 2 further includes the toner memory 241 (see FIG. 6; the toner memory 241 is omitted in FIG. 5)) serving as a storage medium. The toner memory 241 is provided on the toner circuit board 24. The toner memory 241 stores various information relating to the toner cartridge 2. For example, the toner memory 241 stores at least one of, for example, information for identifying the toner cartridge 2, and information indicating characteristics of the toner cartridge 2.

The information for identifying the toner cartridge 2 includes at least one of, for example, a manufacturer's serial number of the toner cartridge 2, and an identification code indicating that the toner cartridge 2 is a genuine product. The information indicating the characteristics of the toner cartridge 2 includes at least one of, for example, models compatible with the toner cartridge 2, specification of the toner cartridge 2, an amount of toner accommodated in the cartridge casing 21, lifetime of the developing roller 22, information indicating whether or not the toner cartridge 2 is unused, accumulated rotation amount (the number of revolutions) of the developing roller 22, the number of sheets that have been printed, and an error history.

Incidentally, the toner memory 241 need not be positioned on the toner circuit board 24. Specifically, the toner memory 241 may be positioned on the cartridge casing 21.

<1-4. Drum Circuit Board>

Figure 6:
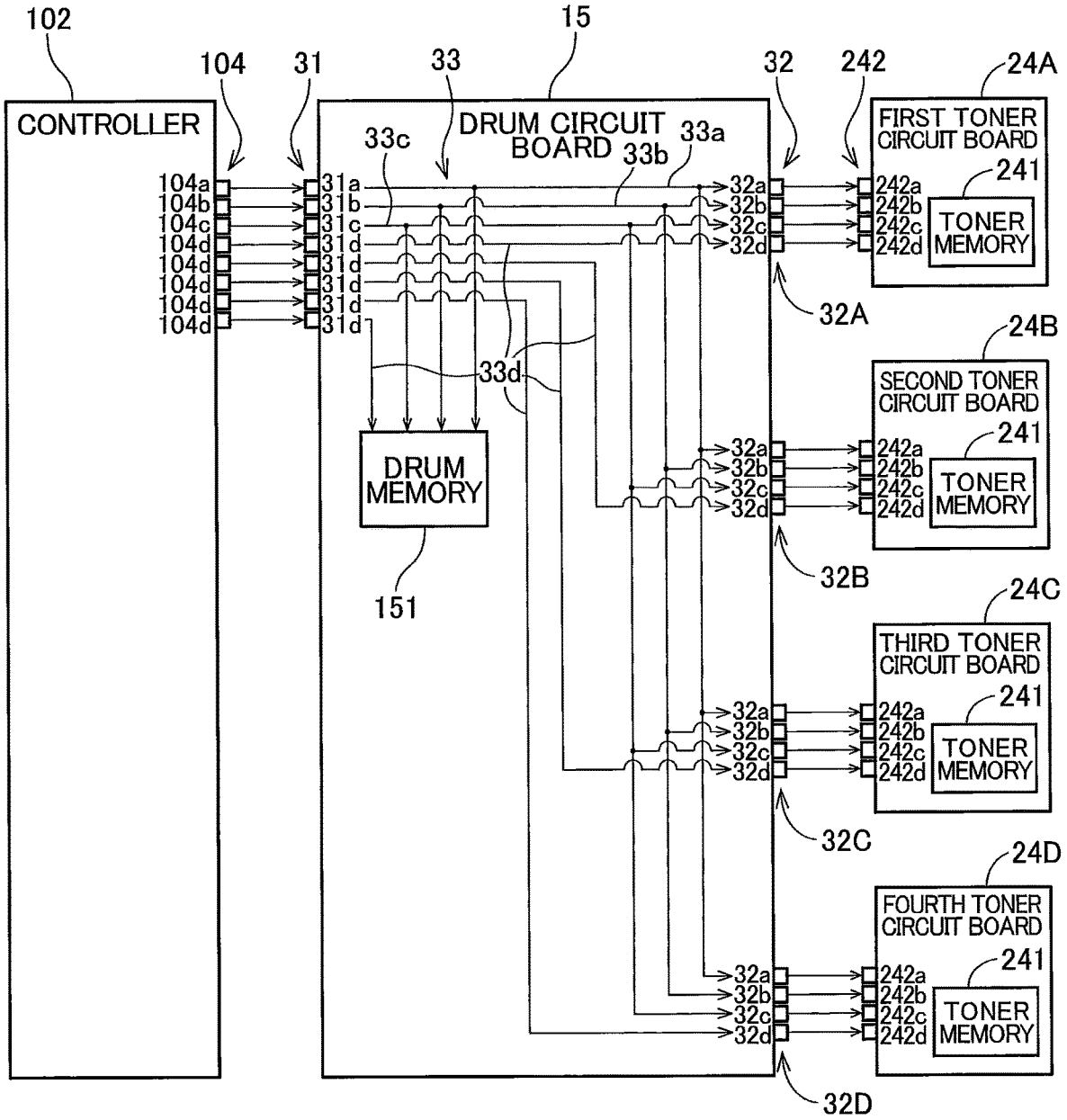
FIG. 6 is a block diagram illustrating electrical connection among a controller, a drum circuit board, and four toner circuit boards in the image forming apparatus according to the first embodiment.

Configuration of the drum circuit board 15 will next be described in further detail. FIG. 6 is a block diagram illustrating electrical connection among the controller 102, the drum circuit board 15, and the four toner circuit boards 24. As illustrated in FIG. 6, the drum circuit board 15 includes the main body-side terminals 31, the toner-side terminals 32, and relay lines 33.

<1-4-1. Main Body-Side Terminals>

The main body-side terminals 31 are electrically connected to terminals 104 of the controller 102 through the above-mentioned first electrical terminal 13 (see FIG. 4) in a state where the drum cartridge 1 is attached to the main casing 101 of the image forming apparatus 100. As a result, the drum circuit board 15 and the controller 102 are electrically connected to each other. Note that the first electrical terminal 13 that connects the main body-side terminals 31 to the terminals 104 provided in the main casing 101 is omitted in FIG. 6.

The main body-side terminals 31 include a main body-side voltage terminal 31*a*, a main body-side ground terminal 31*b*, a main body-side clock terminal 31*c*, and main body-side signal terminals 31*d*. As illustrated in FIG. 6, in the present embodiment, the number of the main body-side terminals 31 is plural, specifically, eight. More specifically, the number of the main body-side voltage terminals 31*a* is one, the number of the main body-side ground terminals 31*b* is one, the number of the main body-side clock terminals 31*c* is one, and the number of the main body-side signal terminals 31*d* is five.

Note that the number of the terminals 104 of the controller 102 is plural, specifically, eight in the present embodiment.

The main body-side voltage terminal 31*a* is electrically connected to a voltage terminal 104*a* of the terminals 104 of the controller 102 in a state where the drum cartridge 1 is attached to the main casing 101 of the image forming apparatus 100. With this configuration, power supply voltage is supplied from the controller 102 to the drum circuit board 15.

The main body-side ground terminal 31*b* is electrically connected to a ground terminal 104*b* of the terminals 104 of the controller 102 in a state where the drum cartridge 1 is attached to the main casing 101 of the image forming apparatus 100. This configuration allows ground voltage to be supplied from the controller 102 to the drum circuit board 15.

The main body-side clock terminal 31*c* is electrically connected to a clock terminal 104*c* of the terminals 104 of the controller 102 in a state where the drum cartridge 1 is attached to the main casing 101 of the image forming apparatus 100. Accordingly, a clock signal is supplied from the controller 102 to the drum circuit board 15 at constant time intervals.

The main body-side signal terminals 31*d* are electrically connected to signal terminals 104*d* of the terminals 104 of the controller 102 in a state where the drum cartridge 1 is attached to the main casing 101 of the image forming apparatus 100. This allows a signal indicating various information to be exchanged between the controller 102 and the drum circuit board 15.

In the present embodiment, the information is exchanged through serial communication. As described above, the number of the main body-side signal terminals 31*d* is five, and the number of the signal terminals 104*d* of the controller 102 is five in the present embodiment. Each of the five main body-side signal terminals 31*d* is electrically connected to the corresponding one of the five signal terminals 104*d* in a state where the drum cartridge 1 is attached to the main casing 101 of the image forming apparatus 100.

<1-4-2. Toner-Side Terminals>

The toner-side terminals 32 are electrically connected to the toner circuit boards 24 of the toner cartridges 2 through the corresponding second electrical terminals 14 described above in a state where the toner cartridges 2 are attached to the frame 12 of the drum cartridge 1. Accordingly, the drum circuit board 15 is electrically connected to the toner circuit boards 24. As illustrated in FIG. 6, in the present embodiment, the number of the toner-side terminals 32 is sixteen (16) in total. Note that the second electrical terminals 14 for connecting the toner-side terminals 32 to the terminals 242 of the toner cartridges 2 are omitted in FIG. 6.

In the following description, four toner cartridges 2 to be attached to the drum cartridge 1 are referred to as a first toner cartridge 2A, a second toner cartridge 2B, a third toner cartridge 2C, and a fourth toner cartridge 2D. Further, the toner circuit board 24 of the first toner cartridge 2A is referred to as a first toner circuit board 24A, the toner circuit board 24 of the second toner cartridge 2B is referred to as a second toner circuit board 24B, the toner circuit board 24 of the third toner cartridge 2C is referred to as a third toner circuit board 24C, and the toner circuit board 24 of the fourth toner cartridge 2D is referred to as a fourth toner circuit board 24D.

The sixteen toner-side terminals 32 include a first group 32A having four toner-side terminals 32, a second group 32B having four toner-side terminals 32, a third group 32C having four toner-side terminals 32, and a fourth group 32D having four toner-side terminals 32.

The toner-side terminals 32 of the first group 32A are electrically connected to the first toner circuit board 24A in a state where the first toner cartridge 2A is attached to the frame 12 of the drum cartridge 1. The toner-side terminals 32 of the second group 32B are electrically connected to the second toner circuit board 24B in a state where the second toner cartridge 2B is attached to the frame 12 of the drum cartridge 1. The toner-side terminals 32 of the third group 32C are electrically connected to the third toner circuit board 24C in a state where the third toner cartridge 2C is attached to the frame 12 of the drum cartridge 1. The toner-side terminals 32 of the fourth group 32D are electrically connected to the fourth toner circuit board 24D in a state where the fourth toner cartridge 2D is attached to the frame 12 of the drum cartridge 1.

The four toner-side terminals 32 of each of the first group 32A through the fourth group 32D include a toner-side voltage terminal 32*a*, a toner-side ground terminal 32*b*, a toner-side clock terminal 32*c*, and a toner-side signal terminal 32*d*.

The toner-side voltage terminal 32*a* for each of the first group 32A through the fourth group 32D is electrically connected to the main body-side voltage terminal 31*a* through a voltage relay line 33*a* (described later). Further, in a state where the toner cartridges 2 are attached to the frame 12 of the drum cartridge 1, each of the toner-side voltage terminal 32*a* is electrically connected to a corresponding one of voltage terminals 242*a* of the terminals 242 of the toner cartridges 2. With this connection, power supply voltage is supplied from the controller 102 to the toner circuit boards 24 through the drum circuit board 15.

The toner-side ground terminal 32*b* for each of the first group 32A through the fourth group 32D is electrically connected to the main body-side ground terminal 31*b* through a ground relay line 33*b* (described later). Further, in a state where the toner cartridges 2 are attached to the frame 12 of the drum cartridge 1, each of the toner-side ground terminals 32*b* is electrically connected to a corresponding one of ground terminals 242*b* of the toner cartridges 2. As a result, ground voltage is supplied from the controller 102 to the toner circuit boards 24 through the drum circuit board 15.

The toner-side clock terminal 32*c* for each of the first group 32A through the fourth group 32D is electrically connected to the main body-side clock terminal 31*c* through a clock relay line 33*c* (described later). Further, in a state where the toner cartridges 2 are attached to the frame 12 of the drum cartridge 1, each of the toner-side clock terminals 32*c* is electrically connected to a corresponding one of the clock terminals 242*c* of the toner cartridges 2. Accordingly, a clock signal is supplied from the controller 102 to the toner circuit boards 24 through the drum circuit board 15 at constant time intervals.

The toner-side signal terminal 32*d* for each of the first group 32A through the fourth group 32D is electrically connected to the corresponding one of the main body-side signal terminals 31*d* through a signal relay line 33*d* (described later). Specifically, the toner-side signal terminal 32*d* of the first group 32A, the toner-side signal terminal 32*d* of the second group 32B, the toner-side signal terminal 32*d* of the third group 32C, and the toner-side signal terminal 32*d* of the fourth group 32D are electrically connected to the main body-side signal terminals 31*d* different from one another, respectively.

Further, in a state where the toner cartridges 2 are attached to the frame 12 of the drum cartridge 1, each of the toner-side signal terminals 32*d* is electrically connected to a corresponding one of signal terminals 242*d* of the toner cartridges 2. This configuration enables a signal indicating various information to be exchanged between the controller 102 and the toner circuit boards 24 through the drum circuit board 15.

<1-4-3. Relay Lines>

As described above, the relay lines 33 include the voltage relay line 33*a*, the ground relay line 33*b*, the clock relay line 33*c*, and the signal relay lines 33*d*. In the present embodiment, the number of the relay lines 33 is plural, specifically, eight as illustrated in FIG. 6. More specifically, the number of the voltage relay lines 33*a* is one, the number of the ground relay lines 33*b* is one, the number of the clock relay lines 33*c* is one, and the number of the signal relay lines 33*d* is five.

The voltage relay line 33*a* has one end portion electrically connected to the main body-side voltage terminal 31*a*, and another end portion divided into five end portions. Specifically, the other end portion of the voltage relay line 33*a* includes a first end portion, a second end portion, a third end portion, a fourth end portion, and a fifth end portion.

The first end portion of the voltage relay line 33*a* is electrically connected to the toner-side voltage terminal 32*a* of the first group 32A. The second end portion of the voltage relay line 33*a* is electrically connected to the toner-side voltage terminal 32*a* of the second group 32B. The third end portion of the voltage relay line 33*a* is electrically connected to the toner-side voltage terminal 32*a* of the third group 32C. The fourth end portion of the voltage relay line 33*a* is electrically connected to the toner-side voltage terminal 32*a* of the fourth group 32D. The fifth end portion of the voltage relay line 33*a* is electrically connected to the drum memory 151.

Accordingly, in the drum circuit board 15, power supply voltage inputted into the main body-side voltage terminal 31*a* is supplied to the four toner-side voltage terminals 32*a* and the drum memory 151. In this way, by sharing the main body-side voltage terminal 31*a*, the number of the main body-side terminals 31 can be reduced.

The ground relay line 33*b* has one end portion electrically connected to the main body-side ground terminal 31*b* and another end portion divided into five end portions. Specifically, the other end portion of the ground relay line 33*b* includes a first end portion, a second end portion, a third end portion, a fourth end portion, and a fifth end portion.

The first end portion of the ground relay line 33*b* is electrically connected to the toner-side ground terminal 32*b* of the first group 32A. The second end portion of the ground relay line 33*b* is electrically connected to the toner-side ground terminal 32*b* of the second group 32B. The third end portion of the ground relay line 33*b* is electrically connected to the toner-side ground terminal 32*b* of the third group 32C. The fourth end portion of the ground relay line 33*b* is electrically connected to the toner-side ground terminal 32*b* of the fourth group 32D. The fifth end portion of the ground relay line 33*b* is electrically connected to the drum memory 151.

Accordingly, in the drum circuit board 15, ground voltage inputted into the main body-side ground terminal 31*b* is supplied to the four toner-side ground terminals 32*b* and the drum memory 151. Thus, by sharing the main body-side ground terminal 31*b*, the number of the main body-side terminals 31 can be reduced.

The clock relay line 33*c* has one end portion electrically connected to the main body-side clock terminal 31*c*, and another end portion divided into five end portions. More specifically, the other end portion of the clock relay line 33*c* includes a first end portion, a second end portion, a third end portion, a fourth end portion, and a fifth end portion.

The first end portion of the clock relay line 33*c* is electrically connected to the toner-side clock terminal 32*c* of the first group 32A. The second end portion of the clock relay line 33*c* is electrically connected to the toner-side clock terminal 32*c* of the second group 32B. The third end portion of the clock relay line 33*c* is electrically connected to the toner-side clock terminal 32*c* of the third group 32C. The fourth end portion of the clock relay line 33*c* is electrically connected to the toner-side clock terminal 32*c* of the fourth group 32D. The fifth end portion of the clock relay line 33*c* is electrically connected to the drum memory 151.

Accordingly, in the drum circuit board 15, a clock signal inputted into the main body-side clock terminal 31*c* is supplied to the four toner-side clock terminals 32*c* and the drum memory 151. Thus, by sharing the main body-side clock terminal 31*c*, the number of the main body-side terminals 31 can be reduced.

As described above, five signal relay lines 33*d* are provided in the drum circuit board 15. Each of the five signal relay lines 33*d* has one end portion electrically connected to the corresponding one of the main body-side signal terminals 31*d*. Of the five signal relay lines 33*d*, four signal relay line 33*d* have other end portions electrically connected to the corresponding toner-side signal terminals 32*d*. The remaining one signal relay line 33*d* has another end portion electrically connected to the drum memory 151.

That is, the four main body-side signal terminals 31*d* and the four toner-side signal terminals 32*d* are connected to each other in one-to-one correspondence by the four signal relay lines 33*d*, respectively. Further, the remaining one main body-side signal terminal 31*d* and the drum memory 151 are connected to each other in one-to-one correspondence by the remaining one signal relay line 33*d*.

<1-4-4. Relay of Information by Drum Circuit Board>

As described above, the controller 102 and the toner circuit boards 24 are electrically connected to each other through the drum circuit board 15 in a state where the drum cartridge 1 to which the toner cartridges 2 are attached is attached to the main casing 101 of the image forming apparatus 100. This configuration enables the drum circuit board 15 to relay transmission of information between the controller 102 and the toner circuit board 24.

For example, the drum circuit board 15 can acquire information stored in each of the toner memories 241 through the second harness 17 and the corresponding toner-side terminal 32 and output the acquired information to the controller 102 through the corresponding main body-side terminal 31 and the first harness 16. Further, the drum circuit board 15 can acquire information supplied from the controller 102 through the first harness 16 and the corresponding main body-side terminal 31 and output the acquired information to each of the toner circuit boards 24 through the corresponding toner-side terminal 32 and the second harness 17.

Note that, as will be described in the following second embodiment through ninth embodiment, the drum cartridge 1 may further include a multiplexer 34, a transistor array 35, and/or a CPU 37. In this case, the drum circuit board 15 relays information between the controller 102 and the toner circuit boards 24 through the multiplexer 34, the transistor array 35, and/or the CPU 37.

When the drum circuit board 15 relays the controller 102 to the toner circuit boards 24 as described above, the number of the terminals required can be reduced in comparison with a case where the drum circuit board 15 and the toner circuit boards 24 are directly connected to the controller 102. For example, as illustrated in FIG. 6, power supply voltage to be supplied to the drum memory 151 of the drum circuit board 15 and the toner memories 241 of the four toner circuit boards 24 can be outputted through one main body-side voltage terminal 31*a*.

Further, as illustrated in FIG. 6, ground voltage to be supplied to the drum memory 151 of the drum circuit board 15 and the toner memories 241 of the four toner circuit boards 24 can be outputted through one main body-side ground terminal 31*b*. Still further, as illustrated in FIG. 6, a clock signal to be supplied to the drum memory 151 of the drum circuit board 15 and the toner memories 241 of the four toner circuit boards 24 can be outputted through one main body-side clock terminal 31*c*. With this configuration, the number of the terminals 104 of the controller 102 can be reduced.

In particular, when the plurality of toner circuit boards 24 is provided as in the present embodiment, the number of the terminals can be further reduced by connecting the controller 102 and the plurality of the toner circuit boards 24 through the drum circuit board 15. For example, as illustrated in FIG. 6, power supply voltage to be supplied to the plurality of toner circuit boards 24 can be outputted through one main body-side voltage terminal 31*a*. Further, as illustrated in FIG. 6, ground voltage to be supplied to the plurality of toner circuit boards 24 can be outputted through one main body-side ground terminal 31*b*. Further, as illustrated in FIG. 6, a clock signal to be supplied to the plurality of toner circuit boards 24 can be outputted through one main body-side clock terminal 31*c*. Accordingly, the number of the terminals 104 can be further reduced.

<1-5. Process Executed after Attachment of Drum Cartridge>

Figure 7:
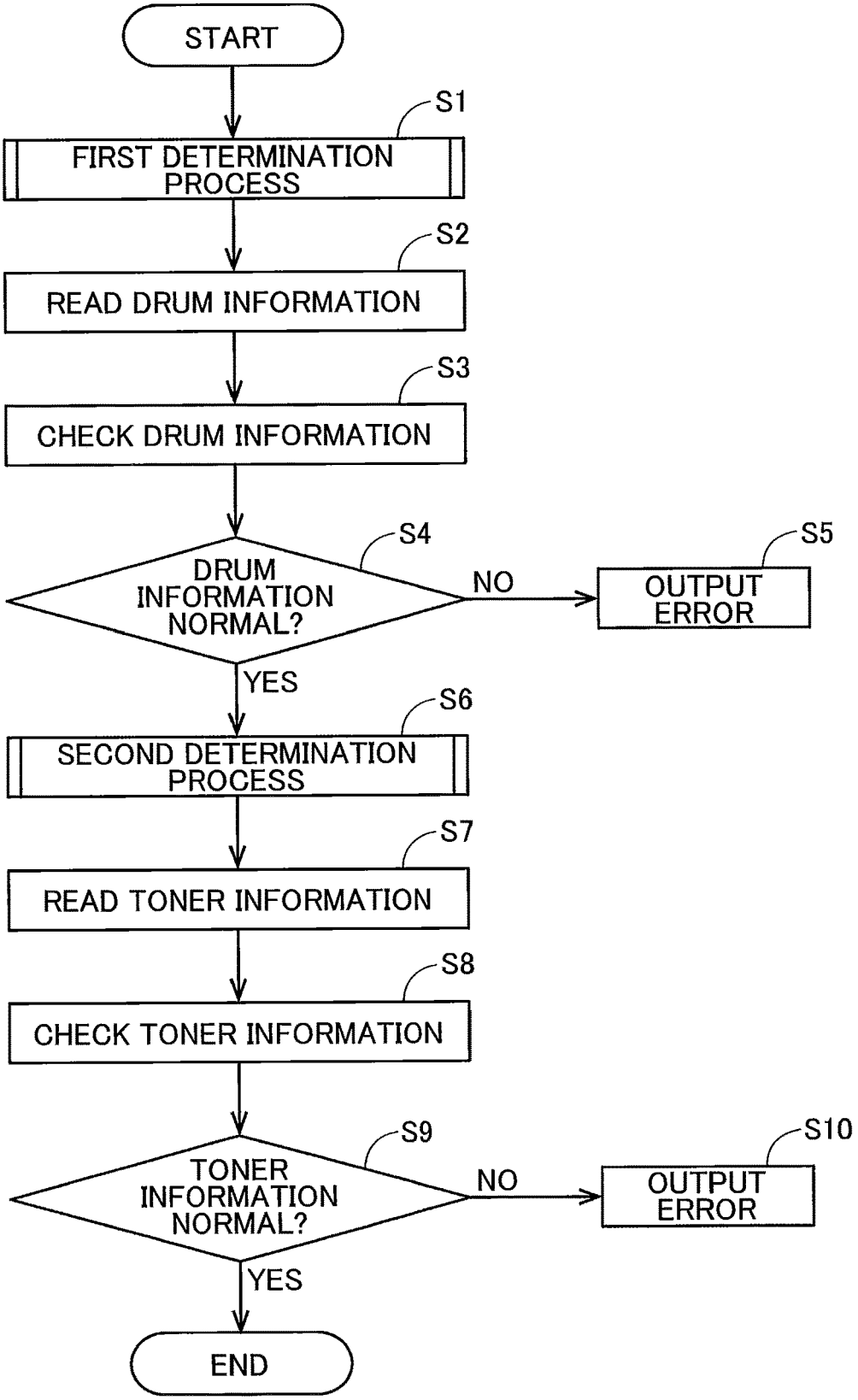
FIG. 7 is a flowchart illustrating steps executed by the controller after attachment of the drum cartridge to a main casing of the image forming apparatus according to the first embodiment.

Next, a process executed by the controller 102 after attachment of the drum cartridge 1 to the main casing 101 of the image forming apparatus 100 will be described. FIG. 7 is a flowchart illustrating steps of the above process executed by the controller 102.

When a cover provided at the front side of the main casing 101 is closed after attaching the drum cartridge 1 to the main casing 101 of the image forming apparatus 100, in S1 the controller 102 executes a first determination process. In the first determination process, the controller 102 determines whether or not the controller 102 is capable of communicating with the drum memory 151, and performs authentication of the drum memory 151.

Figure 8:
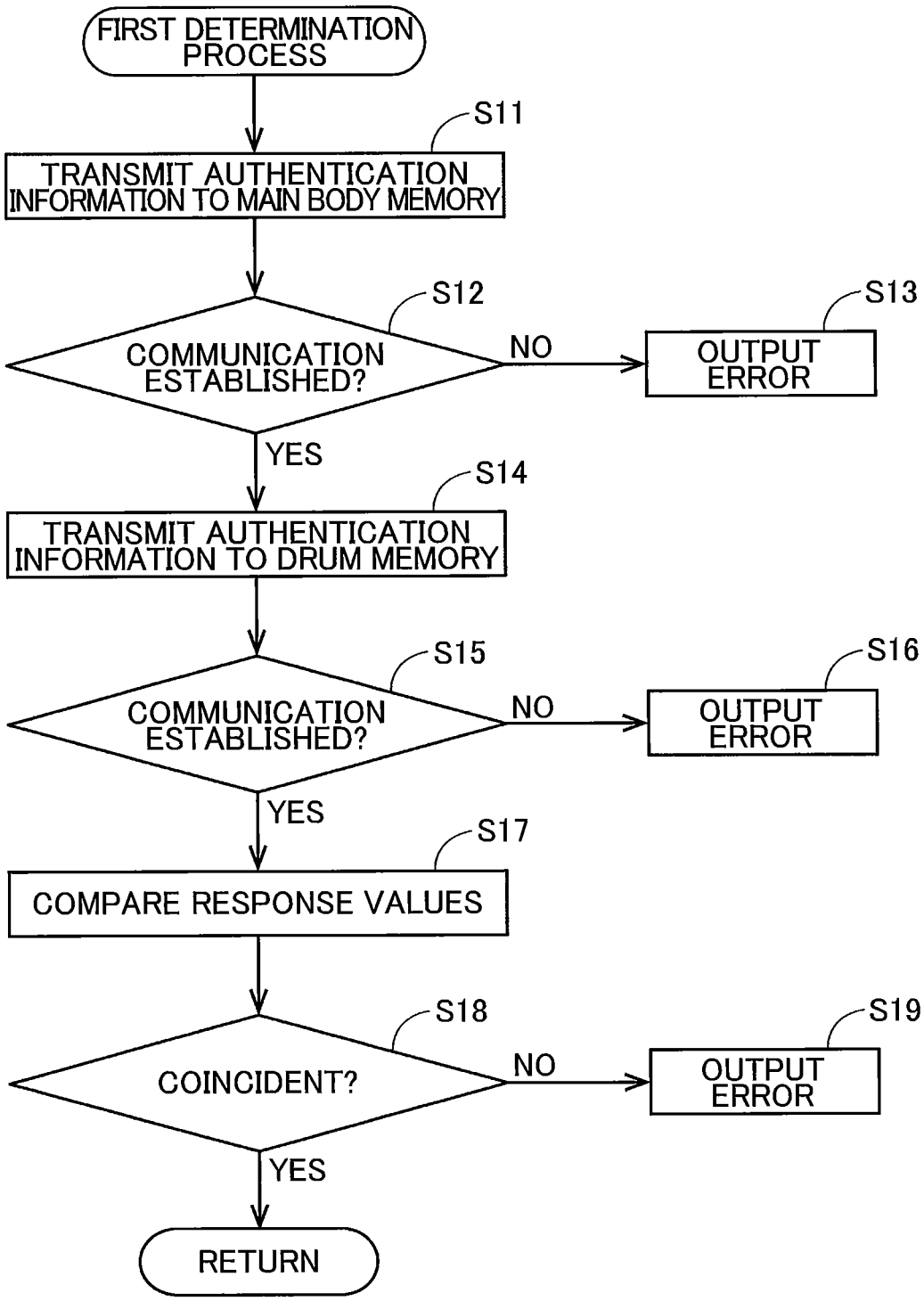
FIG. 8 is a flowchart illustrating steps in a first determination process executed by the controller in the image forming apparatus according to the first embodiment.

FIG. 8 is a flowchart illustrating steps of the first determination process. At the beginning of the first determination process, in S11 the processor 105 of the controller 102 transmits authentication information (second drum authentication information) to the main body memory 106 (a third transmission process).

For example, the processor 105 retrieves the second drum authentication information stored in a given storage area of the main body memory 106 and transmits the retrieved second drum authentication information to another storage area of the main body memory 106 to store the second drum authentication information in the other storage area. Upon receiving the second drum authentication information from the processor 105, the main body memory 106 transmits a response value (a third response value) to the processor 105.

In S12 the processor 105 determines whether communication with the main body memory 106 is established. That is, the processor 105 determines whether the processor 105 has received the third response value from the main body memory 106. When the processor 105 has failed to receive the response value from the main body memory 106 (S12: NO), communication between the processor 105 and the main body memory 106 is not valid. In this case, in S13 the processor 105 outputs an error. Specifically, for example, the processor 105 retrieves main body communication error message information stored in the main body memory 106. Then, the processor 105 displays an error message on the display 103 based on the retrieved main body communication error message information.

On the other hand, when the processor 105 has received the response value from the main body memory 106 (S12: YES), communication between the processor 105 and the main body memory 106 is valid. In this case, in S14 the processor 105 transmits authentication information (first drum authentication information) to the drum memory 151 (a first transmission process). For example, the processor 105 reads out the first drum authentication information stored in the main body memory 106.

Then, the processor 105 transmits the read out first drum authentication information to the drum memory 151 and stores the first drum authentication information in the drum memory 151. When the drum memory 151 receives the first drum authentication information from the processor 105, the drum memory 151 transmits a response value (a first response value) to the processor 105.

In S15 the processor 105 determines whether communication between the processor 105 and the drum memory 151 is established. In other words, the processor 105 determines whether the processor 105 has received the response value transmitted from the drum memory 151.

When the processor 105 has not received the response value from the drum memory 151 (S15: NO), communication between the processor 105 and the drum memory 151 is not valid. In this case, in S16 the processor 105 outputs an error (a first error output process). Specifically, for example, the processor 105 retrieves drum communication error message information stored in the main body memory 106 and displays an error message on the display 103 on a basis of the retrieved drum communication error message information.

On the other hand, when the processor 105 has received the response value from the drum memory 151 (S15: YES; a first reception process), communication between the processor 105 and the drum memory 151 is valid. In this case, in S17 the processor 105 compares the third response value received from the main body memory 106 with the first response value received from the drum memory 151 (a first comparison process).

Then in S18 the processor 105 determines whether or not the third response value received from the main body memory 106 is coincident with the first response value received from the drum memory 151.

When the third response value from the main body memory 106 and the first response value from the drum memory 151 are not coincident with each other (S18: NO), the authentication of the drum memory 151 in the first determination process results in failure. In this case, in S19 the processor 105 outputs an error (the first error output process). Specifically, for example, the processor 105 retrieves drum authentication error message information stored in the main body memory 106, and then displays an error message on the display 103 on a basis of the retrieved drum authentication error message information.

On the other hand, when the third response value from the main body memory 106 is coincident with the first response value from the drum memory 151 (S18: YES), the authentication of the drum memory 151 in the first determination process is successful. That is, the drum memory 151 is authenticated. In this case, the processor 105 ends the first determination process and advances to the process in S2.

While the processor 105 compares the third response value received from the main body memory 106 with the first response value received from the drum memory 151 in the present embodiment, the main body memory 106 may store a first prescribed value, and the processor 105 may compare the first response value with the first prescribed value. In a first determination process' illustrated in FIG. 10, in S21 the processor 105 retrieves the first prescribed value from the main body memory 106. Then, the processor 105 transmits the second drum authentication information to the drum memory 151 similarly to the embodiment. Note that processes in S22 to S24 are identical to those in S14 to S16 described above, description as to the processes in S22 to S24 is omitted. In S25, the processor 105 compares the first response value received from the drum memory 151 and the first prescribed value retrieved from the main body memory 106. Then, in S26 the processor 105 determines whether or not the first response value and the first prescribed value are coincident with each other.

In this modification, when the first response value received from the drum memory 151 is not coincident with the first prescribed value (S26: NO), the authentication of the drum memory 151 is unsuccessful. Thus, in S27 the processor 105 outputs an error. On the other hand, when the first response value from the drum memory 151 is coincident with the first prescribed value (S26: YES), the authentication of the drum memory 151 is successful. Accordingly, the processor 105 advances to S2 as in the first determination process illustrated in FIG. 8.

Referring back to FIG. 7, after confirming that the drum memory 151 is authenticated, in S2 the processor 105 reads information stored in the drum memory 151. Here, the information read from the drum memory 151 includes at least one of, for example, the manufacturer's serial number of the drum cartridge 1, the identification code indicating that the drum cartridge 1 is a genuine product, the models compatible with the drum cartridge 1, the specification of the drum cartridge 1, the lifetime of each photosensitive drum 11, the charging characteristics of the photosensitive drum 11, the information indicating whether or not the drum cartridge 1 is unused, the accumulated rotation amount of each photosensitive drum 11, the accumulated period of time for which each photosensitive drum 11 is charged, the number of sheets that have been printed, and the error history those are described above.

In S3 the processor 105 checks the information retrieved from the drum memory, and subsequently in S4 the processor 105 determines whether or not the information retrieved from the drum memory 151 is normal. Specifically, the processor 105 determines whether or not the information retrieved from the drum memory 151 satisfies a predetermined condition.

When the information retrieved from the drum memory 151 is not normal (S4: NO), the information does not satisfy the predetermined condition. In this case, in S5 the processor 105 outputs an error. Specifically, the processor 105 retrieves drum error message information stored in the main body memory 106. Then, the processor 105 displays an error message on the display 103 base on the retrieved drum error message information.

On the other hand, when the information retrieved from the drum memory 151 is normal (S4: YES), the information satisfies the predetermined condition. In this case, in S6 the processor 105 executes a second determination process. In the second determination process, the controller 102 determines whether or not the controller 102 is capable of communicating with the toner memory 241, and performs authentication of the toner memory 241.

Figure 9:
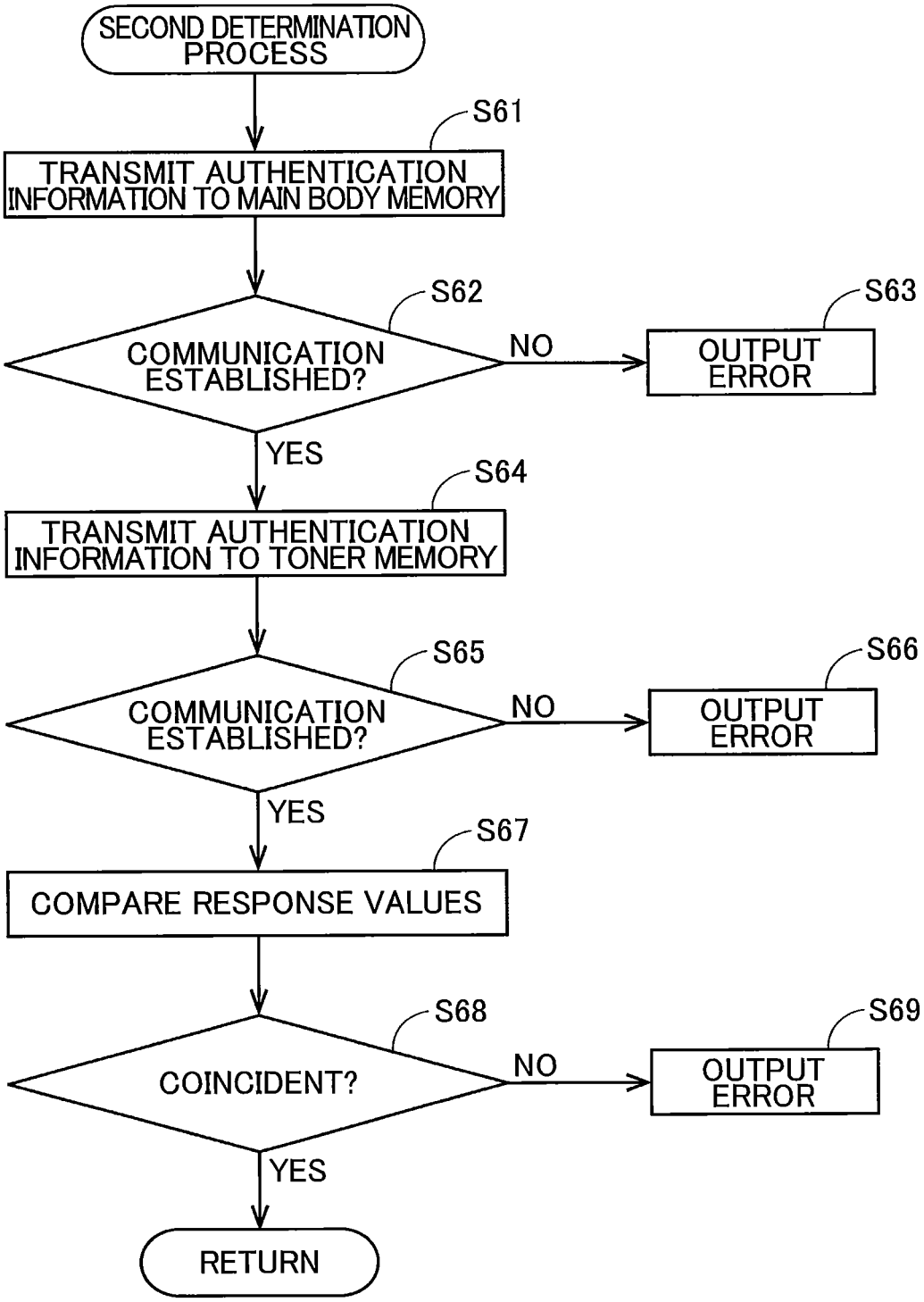
FIG. 9 is a flowchart illustrating steps in a second determination process executed by the controller in the image forming apparatus according to the first embodiment.
Figure 10:
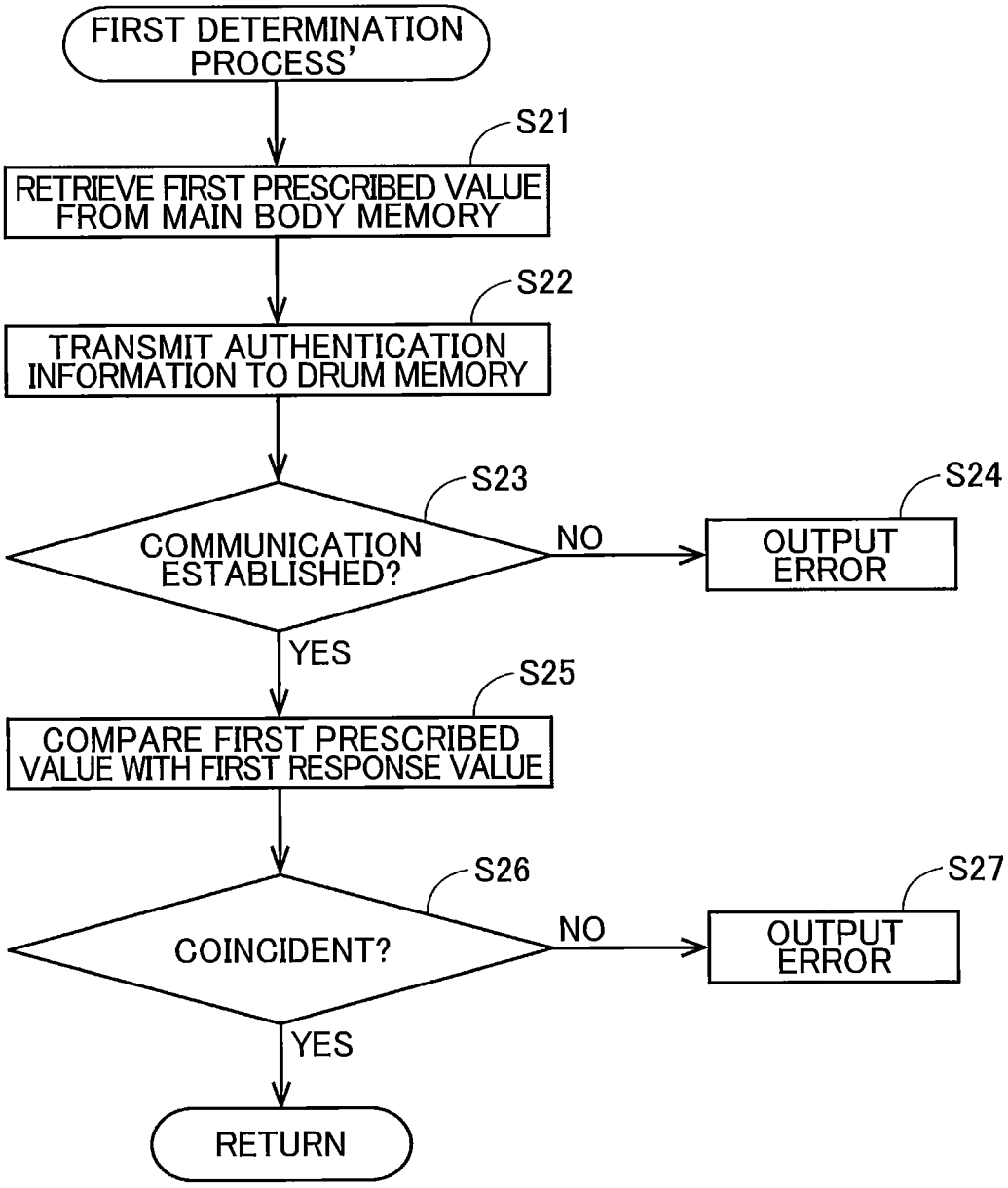
FIG. 10 is a flowchart illustrating steps in a first determination process' executed by a controller in an image forming apparatus according to a modification to the first embodiment.
Figure 11:
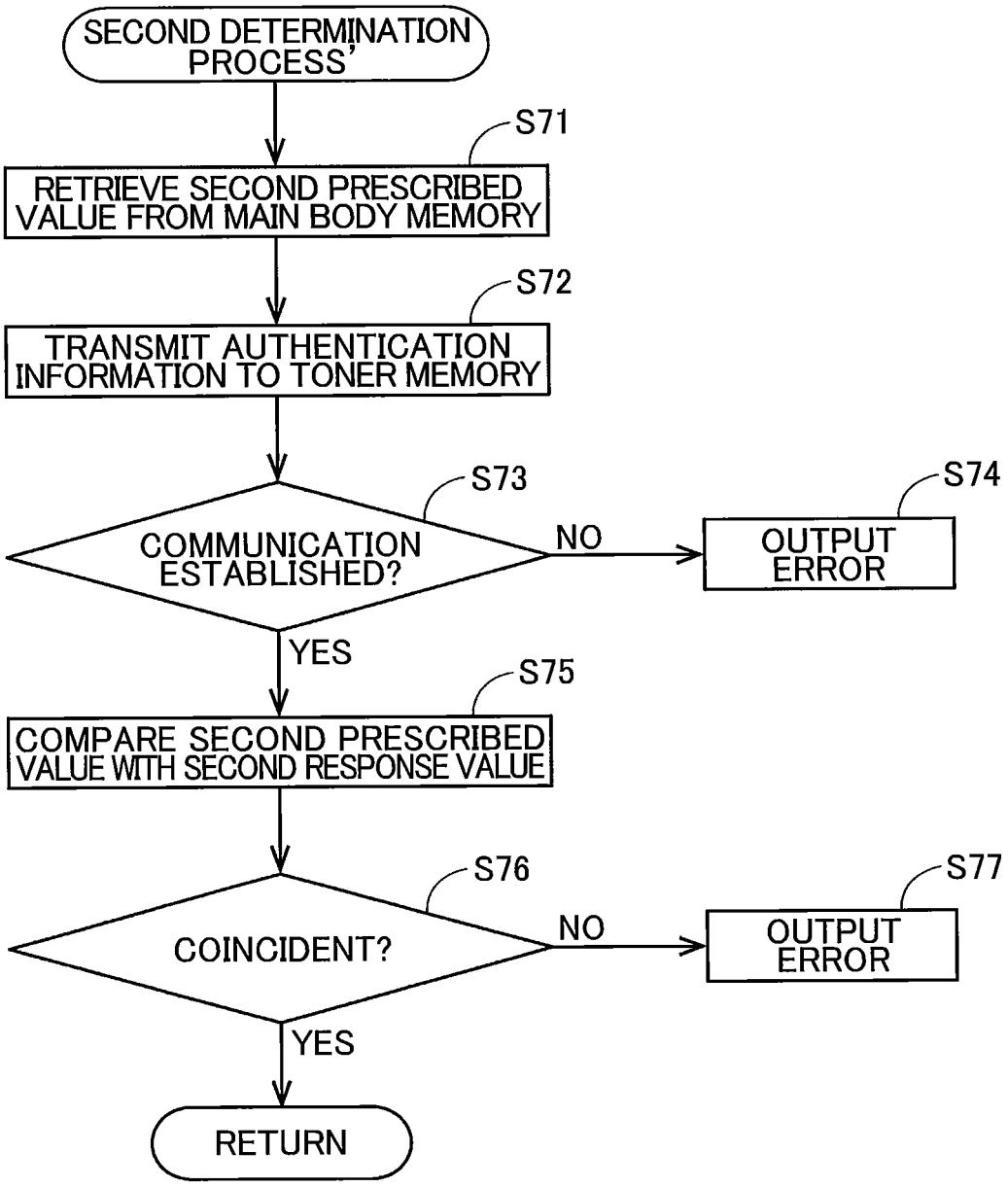
FIG. 11 is a flowchart illustrating steps in a second determination process' executed by the controller in the image forming apparatus according to the modification to the first embodiment.

FIG. 9 is a flowchart illustrating steps of the second determination process. At the beginning of the second determination process, in S61 the processor 105 of the controller 102 transmits authentication information (second toner authentication information) to the main body memory 106 (a fourth transmission process).

For example, the processor 105 retrieves authentication information stored in a given storage area of the main body memory 106, and transmits the retrieved authentication information to another storage area of the main body memory 106 to store the authentication information in the other storage area. Upon receiving the second toner authentication information from the processor 105, the main body memory 106 transmits a response value (a fourth response value) to the processor 105.

Then in S62 the processor 105 determines communication with the main body memory 106 is established. That is, the processor 105 determines whether the processor 105 has received the fourth response value from the main body memory 106.

When the processor 105 has not received the response value from the main body memory 106 (S62: NO), communication between the processor 105 and the main body memory 106 is not valid. In this case, in S63 the processor 105 outputs an error. Specifically, for example, the processor 105 retrieves main body communication error message information stored in the main body memory 106. Then, the processor 105 displays an error message on the display 103 base on the retrieved main body communication error message information.

On the other hand, when the processor 105 has received the response value from the main body memory 106 (S62: YES), communication between the processor 105 and the main body memory 106 is valid. In this case, in S64 the processor 105 transmits authentication information (first toner authentication information) to the toner memory 241 (a second transmission process).

For example, the processor 105 retrieves the authentication information stored in the main body memory 106, transmits the retrieved authentication information to the toner memory 241, and then stores the authentication information in the toner memory 241. When the toner memory 241 receives the first toner authentication information from the processor 105, the toner memory 241 transmits a response value (a second response value) to the processor 105.

Then in S65 the processor 105 determines communication with the toner memory 241 is established. That is, the processor 105 determines whether the processor 105 has received the second response value from the toner memory 241.

When the processor 105 has failed to receive the response value from the toner memory 241 (S65: NO), communication between the processor 105 and the toner memory 241 is not valid. In this case, in S66 the processor 105 outputs an error (a second error output process). Specifically, for example, the processor 105 reads toner communication error message information stored in the main body memory 106, and displays an error message on the display 103 on a basis of the read toner communication error message information.

On the other hand, when the processor 105 has received the response value from the toner memory 241 (S65: YES; a second reception process), communication between the processor 105 and the toner memory 241 is valid. In this case, in S67 the processor 105 compares the fourth response value received from the main body memory 106 with the second response value received from the toner memory 241 (a second comparison process).

Then in S68, the processor 105 determines whether or not the fourth response value from the main body memory 106 is coincident with the second response value from the toner memory 241.

When the fourth response value received from the main body memory 106 is not coincident with the second response value received from the toner memory 241 (S68: NO), the authentication of the toner memory 241 in the second determination process is unsuccessful.

In this case, in S69 the processor 105 outputs an error (the second error output process). Specifically, for example, the processor 105 retrieves toner authentication error message information stored in the main body memory 106. Then, the processor 105 displays an error message on the display 103 on a basis of the retrieved toner authentication error message information.

On the other hand, when the fourth response value received from the main body memory 106 is coincident with the second response value received from the toner memory 241 (S68: YES), the authentication of the toner memory 241 in the second determination process is successful. That is, the toner memory 241 is authenticated. In this case, the processor 105 ends the second determination process and advances to the process in S7.

Instead of receiving the fourth response value from the main body memory 106, the main body memory 106 may store a second prescribed value, and the processor 105 may retrieve the second prescribed value stored in the main body memory 106. In a second determination process' illustrated in FIG. 11, in S71 the processor 105 retrieves the second prescribed value from the main body memory 106. After the process in S71, the processor 105 transmits the second toner authentication information to the toner memory 241. Description as to processes in S72 to S74 will be omitted since the processes in S72 to S74 are the same as the processes in S64 to S66. Then, in S75 the processors 105 compares the second response value received from the toner memory 241 with the second prescribed value retrieved from the main body memory 106. Subsequently, in S76 the processor 105 determines whether or not the second response value is coincident with the second prescribed value.

When the second response value received from the toner memory 241 and the second prescribed value retrieved from the main body memory 106 is not coincident with each other (S76: NO), the authentication of the toner memory 241 is unsuccessful. Accordingly, in S77 the processor 105 outputs an error. On the other hand, when the second response value is coincident with the second prescribed value (S76: YES), the authentication of the toner memory 241 is successful. Thus, the processor 105 ends the second determination process' and advances to S7.

Referring back to FIG. 7, when the authentication of the toner memory 241 is successful, in S7 the processor 105 reads information stored in the toner memory 241. Here, the information read from the toner memory 241 includes at least one of, for example, the manufacturer's serial number of the toner cartridge 2, the identification code indicating that the toner cartridge 2 is a genuine product, the models compatible with the toner cartridge 2, the specification of the toner cartridge 2, the amount of toner accommodated in the cartridge casing 21, the lifetime of the developing roller 22, the information indicating whether or not the toner cartridge 2 is unused, the accumulated rotation amount of the developing roller 22, the number of sheets that have been printed, and the error history those are mentioned above.

Subsequently, in S8 the processor 105 checks the information retrieved from the toner memory 241, and in S9 the processor 105 determines whether or not the information retrieved from the toner memory 241 is normal. Specifically, the processor 105 determines whether or not the information retrieved from the toner memory 241 satisfies a predetermined condition.

When the information retrieved from the toner memory 241 is not normal (S9: NO), the information does not satisfy a predetermined condition. In this case, in S10 the processor 105 outputs an error. Specifically, the processor 105 reads toner error message information stored in the main body memory 106, and displays an error message on the display 103 based on the read toner error message information.

On the other hand, when the information retrieved from the toner memory 241 is normal (S9: YES), the information satisfies the predetermined condition. In this case, the processor 105 ends the current process and enters a standby state in which the processor 105 waits for a print command.

The process of S6 to S10 are executed for each of the toner memories 241 of the four toner cartridges 2.

As described above, in the image forming apparatus 100 according to the present embodiment, after attachment of the drum cartridge 1 to the main casing 101, the processor 105 first executes the first determination process of S1 for the drum memory 151, and subsequently executes the second determination process of S6 for each of the toner memories 241. Therefore, the processor 105 can efficiently execute both the first determination process for the drum memory 151 and the second determination process for each of the toner memories 241.

More specifically, in the above image forming apparatus 100, the controller 102 and each of the toner circuit boards 24 are connected to each other through the drum circuit board 15. Thus, if the processor 105 executes the second determination process before executing the first determination process and an error is outputted in the second determination process, the processor 105 cannot determine the error is caused by which one of communication between the controller 102 and the drum circuit board 15 and communication between the drum circuit board 15 and the toner circuit boards 24. In this case, for accurately identifying source of the error, the processor 105 also needs to execute the first determination process subsequent to the second determination process.

To the contrary, by operating the processor 105 to execute the first determination process prior to the second determination process as described above, the second determination process can be omitted when the first determination process results in error, since the second determination process will definitely result in error in this case. With the above configuration, the processor 105 can omit the determination process unnecessary to execute, thereby improving operation efficiency in executing the first determination process and the second determination process.

Further, the processor 105 is configured to output an error (a first error) in S16 or S19 of the first determination process in preference to outputting an error (a second error) in S66 or S69 of the second determination process. Specifically, for example, the processor 105 displays a message corresponding to the first error on the display 103 in preference to a message corresponding to the second error.

In this way, a user of the image forming apparatus 100 can address a communication failure with respect to the drum circuit board 15 prior to a communication failure with respect to the toner circuit boards 24. Thus, the user can effective perform actions necessary against the error.

More specifically, assuming that the processor 105 outputs the second error in preference to the first error, the processor 105 cannot determine which one of the communication between the controller 102 and the drum circuit board 15 and the communication between the drum circuit board 15 and the toner circuit board 24 is causing the second error. In this case, the user may need to unnecessary actions to deal with the second error.

On the other hand, when the processor 105 outputs the first error in preference to the second error as described above, the first error is considered to be caused by the communication failure between the controller 102 and the drum circuit board 15. Further, when the processor 105 outputs the second error without outputting the first error, it is considered that the second error is caused by the communication failure between the drum circuit board 15 and the toner circuit board 24. In this way, the user of the image forming apparatus 100 can properly determine a component of the image forming apparatus to be dealt with.

In the above-described embodiment, the processor 105 executes the second determination process (S6) after executing the first determination process (S1). However, the processor 105 may output the first error in preference to the second error while executing the first determination process concurrently with the second determination process. Specifically, the processor 105 may display the first error prior to the second error as in the above embodiment while the first determination process and the second determination process are simultaneously executed.

Alternatively, the processor 105 may output the first error and the second error at the same time such that the first error is recognized by the user in preference to the second error. For example, the processor 105 may display the first error more largely or in a more conspicuous color than the second error.

Further, in the above embodiment, the controller 102 receives response information after transmitting authentication information in both the first determination process and the second determination process. That is, in the first determination process and the second determination process, the controller 102 performs authentication of the drum memory 151 and the toner memories 241 through bidirectional communication. However, the controller 102 may perform authentication of the drum memory 151 and the toner memories 241 through unidirectional communication.

<1-6. Writing of Main Body Information into Drum Memory>

Figure 12:
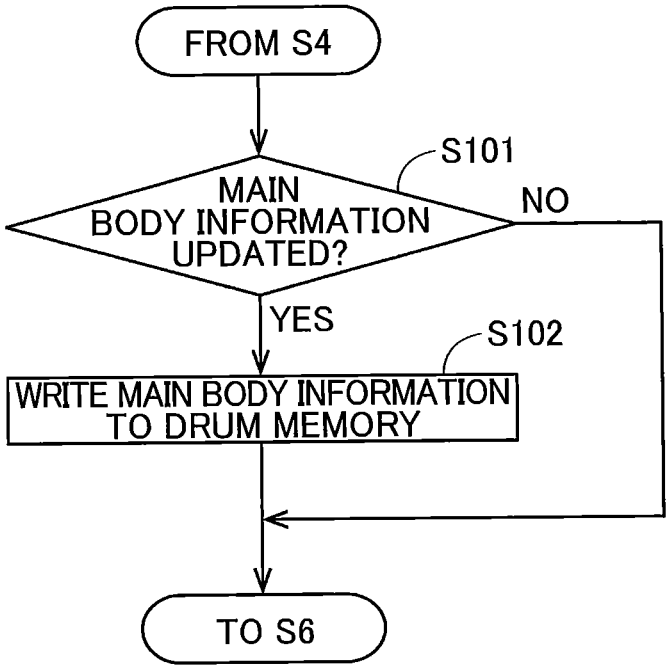
FIG. 12 is a flowchart illustrating steps in a process for writing main body information to the drum memory executed by the controller in the image forming apparatus according to the first embodiment.

FIG. 12 is a flowchart illustrating an example of process that can be added to the process of FIG. 7. In the process of FIG. 12, when the information retrieved from the drum memory 151 is determined to be normal in S4, in S101 the processor 105 determines whether information stored in the main body memory 106 (hereinafter referred to as "main body information") has been updated. When the main body information has not been updated (S101: NO), the processor 105 directly advances to S6.

On the other hand, when the main body information has been updated (S101: YES), in S120 the processor 105 writes the updated main body information stored in the main body memory 106 into the drum memory 151. Specifically, the processor 105 executes a retrieving process for retrieving the main body information from the main body memory 106 and a writing process for writing the retrieved main body information into the drum memory 151.

The main body information includes at least one of, for example, information for identifying the image forming apparatus 100 and information indicating the characteristics of the image forming apparatus 100. The information for identifying the image forming apparatus 100 includes a manufacturer's serial number of the image forming apparatus 100, for example.

The information indicating the characteristics of the image forming apparatus 100 includes at least one of, for example, a model code of the image forming apparatus 100, specification of the image forming apparatus 100, characteristics of the components of the image forming apparatus 100, usage history of the image forming apparatus 100, and an error history of the image forming apparatus 100.

As described above, by storing a part of information as to the image forming apparatus 100 in the drum memory 151, the state of the image forming apparatus 100 can be grasped based on the information stored in the drum memory 151. Thus, when a malfunction occurs in the image forming apparatus 100, it is not necessary for a manufacturer to collect the whole image forming apparatus 100. That is, the manufacturer only needs to collect the drum memory 151 and can analyze the malfunction based on the main body information stored in the drum memory 151.

<1-7. Writing of Toner Information into Drum Memory>

Figure 13:
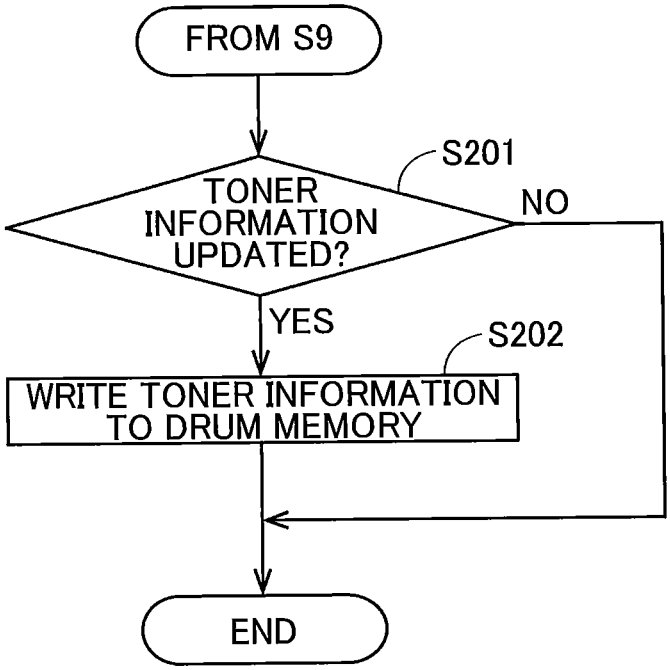
FIG. 13 is a flowchart illustrating steps in a process for writing toner information to the drum memory executed by the controller in the image forming apparatus according to the first embodiment.

FIG. 13 is a flowchart illustrating another example of process that can be added to the process of FIG. 7. In the process of FIG. 13, when determining that the information retrieved from the toner memory 241 is normal in S9, in S201 the processor 105 first determines whether or not information stored in the toner memory 241 (hereinafter referred to as "toner information") has been updated. When the toner information has not been updated (S201: NO), the processor 105 ends the current process and enters a standby state in which the processor 105 waits for a print command.

On the other hand, when determining that the toner information has been updated (S201: YES), in S202 the processor 105 writes the updated toner information stored in the toner memory 241 into the drum memory 151. Specifically, the processor 105 executes a retrieving process for retrieving the toner information from the toner memory 241, and a writing process for writing the retrieved toner information into the drum memory 151.

In S201, whether or not the toner information has been updated is determined for each of the toner memories 241 of the four toner cartridges 2. Then, when the toner information for at least one toner memory 241 has been updated, the processor 105 executes the process of S202. Then, the processor 105 writes toner information of all the toner memories 241 determined to have been updated into the drum memory 151.

The toner information includes at least one of, for example, the manufacturer's serial number of the toner cartridge 2, the identification code indicating that the toner cartridge 2 is a genuine product, the models compatible with the toner cartridge 2, the specification of the toner cartridge 2, the amount of toner accommodated in the cartridge casing 21, the lifetime of the developing roller 22, the information indicating whether or not the toner cartridge 2 is unused, the accumulated rotation amount of the developing roller 22, the number of sheets that have been printed, and the error history those are mentioned above.

By storing a part of information as to the toner cartridges 2 in the drum memory 151 as described above, the information for the toner cartridges 2 attached to the drum cartridge 1 can be grasped based on the information stored in the drum memory 151. Thus, when a malfunction occurs in any of the drum cartridge 1 and the four toner cartridges 2, it is not necessary for a manufacturer to collect all of the drum cartridge 1 and four toner cartridges 2. That is, the manufacturer only needs to collect the drum memory 151 and then can analyze the malfunction based on the toner information stored in the drum memory 151.

Further, upon attachment of the toner cartridges 2 to the drum cartridge 1, the processor 105 can determine based on the toner information stored in the drum memory 151 whether or not the attached toner cartridge 2 has been previously attached.

<1-8. Updating Process of Rotation Amount for Photosensitive Drums>

As described above, the drum memory 151 can store information as to rotation amount of photosensitive drum 11. The rotation amount of the photosensitive drum 11 is an accumulated rotation amount indicating how many times the photosensitive drum 11 has rotated since start of use of the photosensitive drum 11. The rotation amount the photosensitive drum 11 stored in the drum memory 151 is updated accompanying the execution of the printing process in the image forming apparatus 100. Hereinafter, an updating process of the rotation amount of the photosensitive drum 11 will be described with reference to the flowchart of FIG. 14.

Figure 14:
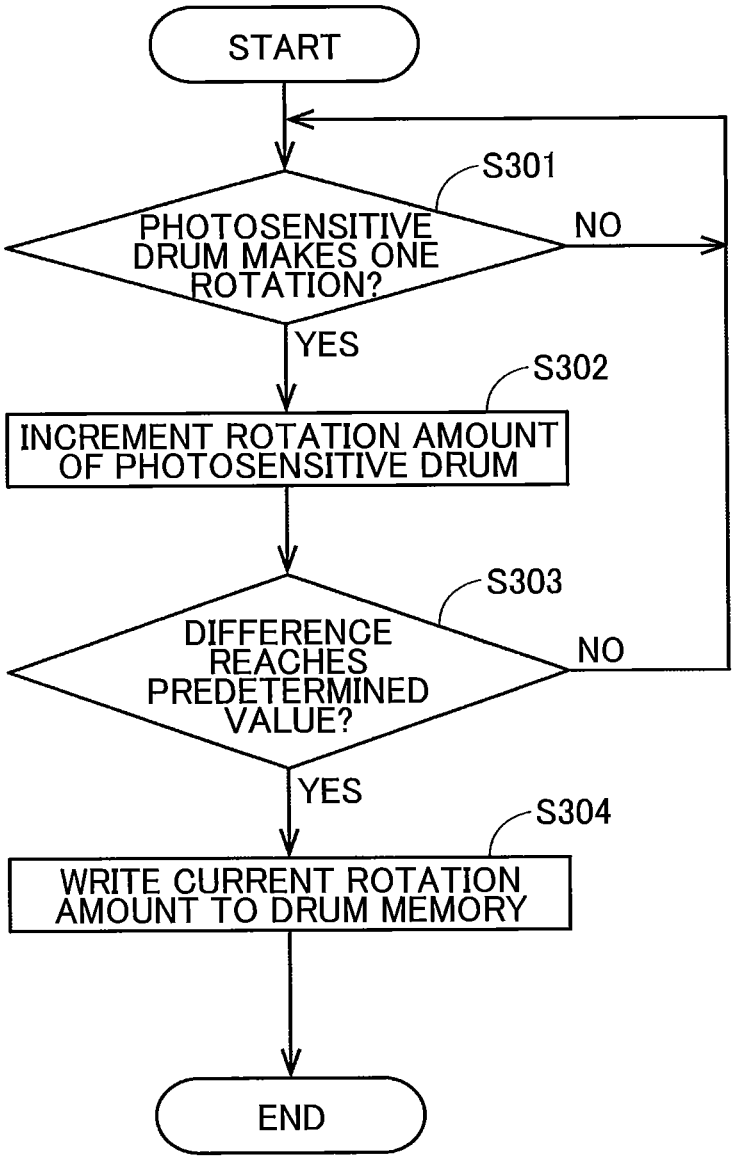
FIG. 14 is a flowchart illustrating steps in a process for updating accumulated rotation amount of a photosensitive drum of the drum cartridge executed by the controller in the image forming apparatus according to the first embodiment.

The image forming apparatus 100 further includes a sensor (not illustrated) for detecting rotations of the photosensitive drums 11. The sensor is configured to output a detection signal each time of the photosensitive drum 11 makes one rotation. Note that the process in FIG. 14 is executed concurrently with a printing process. That is, the processor 105 starts the process in FIG. 14 when the printing process is started, and ends the process in FIG. 14 at the time when the printing process is ended.

At the time of executing the printing process, the processor 105 of the controller 102 first retrieves the rotation amount of the photosensitive drum 11 stored in the drum memory 151 from the drum memory 151. Then, in S301 the processor 105 determines whether or not a detection signal is detected. When the processor 105 does not detect the detection signal (S301: NO), the processor 105 continues waiting until the detection signal is detected.

Each time the photosensitive drum 11 rotates, the sensor outputs a detection signal. When the processor 105 detects the detection signal outputted from the sensor (S301: YES), then in S302 the processor 105 increments the rotation amount of the photosensitive drum 11 by one.

Subsequently in S303 the processor 105 determines whether or not a difference between the rotation amount of the photosensitive drum 11 retrieved from the drum memory 151 (i.e., the rotation amount of the photosensitive drum 11 that has been updated immediately before) and the incremented rotation amount reaches a predetermined value. That is, the processor 105 determines whether the photosensitive drum 11 has rotated by a prescribed number of times since the processor 105 updated the rotation amount of the photosensitive drum 11 immediately before.

The predetermined value may previously be stored in, for example, the main body memory 106. When the difference between the rotation amount of the photosensitive drum 11 that has been updated immediately before and the incremented rotation amount does not reach the predetermined value (S303: NO), the processor 105 continues repeating the process of S301 to S303.

When the difference between the rotation amount of the photosensitive drum 11 that has been updated immediately before and the incremented rotation amount reaches the predetermined value (S303: YES), in S304 the processor 105 writes the current incremented rotation amount of the photosensitive drum 11 into the drum memory 151. That is, the processor 105 updates the rotation amount of the photosensitive drum 11 stored in the drum memory 151.

The processor 105 executes the process of S301 to S304 for each of the four photosensitive drums 11.

In this way, when the rotation amount of the photosensitive drum 11 stored in the drum memory 151 is updated at prescribed timing, there is no need to manage the information as to the rotation amount of the photosensitive drum 11 in the main body memory 106 of the image forming apparatus 100. Accordingly, even when the drum cartridge 1 is replaced with another drum cartridge 1 in the image forming apparatus 100 and another image forming apparatus 100, the rotation amount of the photosensitive drum 11 can be adequately managed in each of the drum cartridges 1. Consequently, the processor 105 can appropriately determine the lifetime of the photosensitive drums 11 on a basis of the rotation amount of the photosensitive drums 11 stored in the drum memory 151.

Particularly, in the example of FIG. 14, the rotation amount of the photosensitive drum 11 stored in the drum memory 151 is not updated each time the photosensitive drum 11 makes one rotation, but is updated each time the photosensitive drum 11 rotates by the predetermined number of times. This can reduce a process burden on the processor 105, thereby enabling delay of the printing process to be suppressed.

<1-9. Updating Process of Charged Time>

As described above, the drum memory 151 can store the information as to a charged time of each of the photosensitive drums 11. The charged time of the photosensitive drum 11 is an accumulated period of time indicating how long the photosensitive drum 11 has been charged by a charger (not illustrated) in total measured since the start of use of the photosensitive drum 11.

The charged time of the photosensitive drum 11 stored in the drum memory 151 is updated accompanying the execution of the printing process in the image forming apparatus 100. Hereinafter, an updating process of the charged time of the photosensitive drum 11 will be described with reference to the flowchart of FIG. 15.

Figure 15:
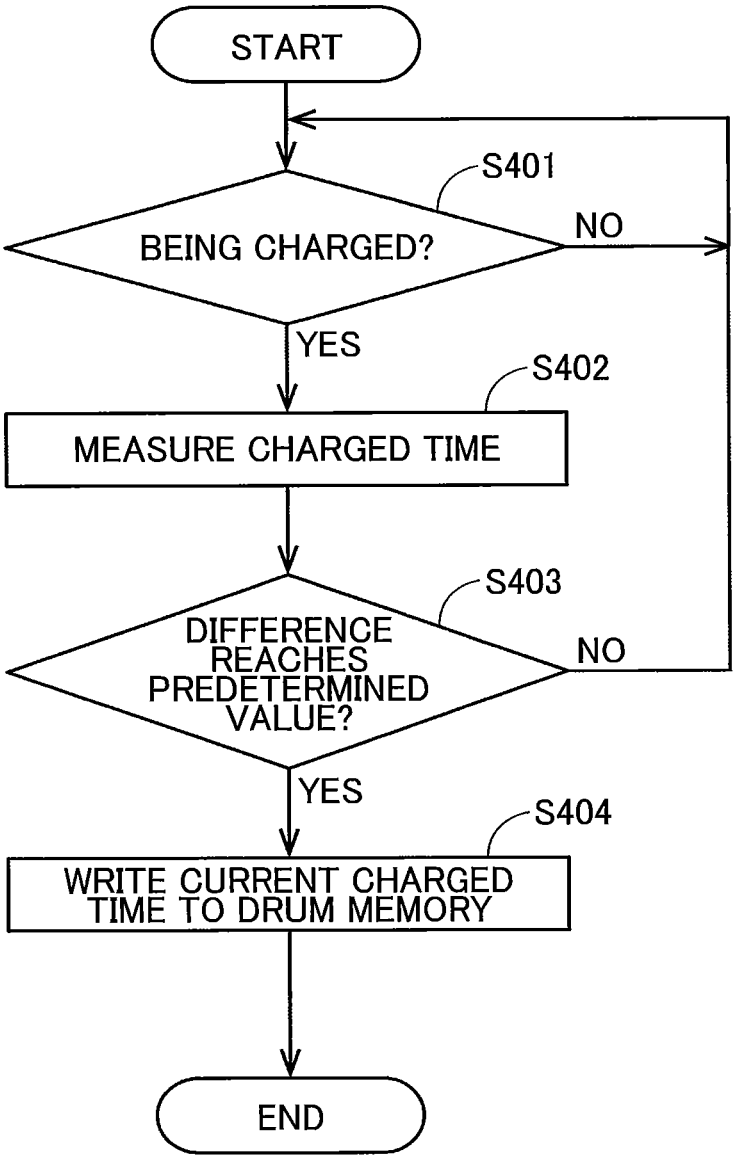
FIG. 15 is a flowchart illustrating steps in a process for updating a accumulated period of time for which the photosensitive drum has been charged executed by the controller in the image forming apparatus according to the first embodiment.

Note that the process in FIG. 15 is executed concurrently with a printing process. That is, the processor 105 starts the process in FIG. 15 when the printing process is started, and ends the process in FIG. 15 at the time when the printing process is ended. At the time of executing the printing process, the processor 105 of the controller 102 first retrieves the charged time of the photosensitive drum 11 stored in the drum memory 151.

Then, in S401 the processor 105 determines whether or not the photosensitive drum 11 is being charged. When the photosensitive drum 11 is not being charged (S401: NO), the processor 105 continues determining whether or not the photosensitive drum 11 is being charged.

When determining that the photosensitive drum 11 is being charged (S401: YES), in S402 the processor 105 measures a period of time during which the photosensitive drum 11 is charged. Further, the processor 105 increments the charged time of the photosensitive drum 11 retrieved from the drum memory 151 by the measured period of time.

Next, in S403 the processor 105 determines whether or not the difference between the charged time of the photosensitive drum 11 retrieved from the drum memory 151 (i.e., the charged time that has been updated immediately before) and the incremented charged time of the photosensitive drum 11 reaches a predetermined value. That is, the processor 105 determines whether or not the photosensitive drum 11 has been charged for the predetermined period of time since the processor 105 updated the charged time immediately before.

The predetermined value may previously be stored in, for example, the main body memory 106. When the difference between the charged time that has been updated immediately before and the incremented charged time does not reach the predetermined value (S403: NO), the processor 105 continues repeating the process of S401 to S403.

On the other hand, when the difference between the charged time of the photosensitive drum 11 that has been updated immediately before and the incremented charged time of the photosensitive drum 11 reaches the predetermined value (S403: YES), in S404 the processor 105 writes the current incremented charged time of the photosensitive drum 11 into the drum memory 151. That is, the processor 105 updates the charged time of the photosensitive drum 11 stored in the drum memory 151.

The processor 105 executes the process of S401 to S404 for each of the four photosensitive drums 11.

When the charged time of the photosensitive drum 11 stored in the drum memory 151 is updated at prescribed timing as described above, there is no need to manage the information for the charged time of the photosensitive drum 11 in the main body memory 106 of the image forming apparatus 100. That is, even when the plurality of drum cartridges 1 are replaced with each other among a plurality of the image forming apparatuses 100, the charged time of the photosensitive drum 11 can be adequately managed in each of the drum cartridges 1. Thus, the processor 105 can appropriately determine the lifetime of the photosensitive drum 11 based on the charged time of the photosensitive drum 11 stored in the drum memory 151.

Particularly, in the example of FIG. 15, the charged time of the photosensitive drum 11 stored in the drum memory 151 is not updated continuously, but is updated each time the photosensitive drum 11 is charged for a predetermined period of time. This can reduce a process burden on the processor 105. Thus, delay of the printing process can be prevented.

<1-10. Process Performed when Error Occurs>

As described above, the drum memory 151 can store an error history. The error history is written into the drum memory 151 when an error occurs in the drum cartridge 1. Hereinafter, a writing process of the error history into the drum memory 151 will be described with reference to the flowchart of FIG. 16.

In the following description, the respective four photosensitive drums 11 of the drum cartridge 1 are referred to as a first photosensitive drum 11A, a second photosensitive drum 11B, a third photosensitive drum 11C, and a fourth photosensitive drum 11D.

Figure 16:
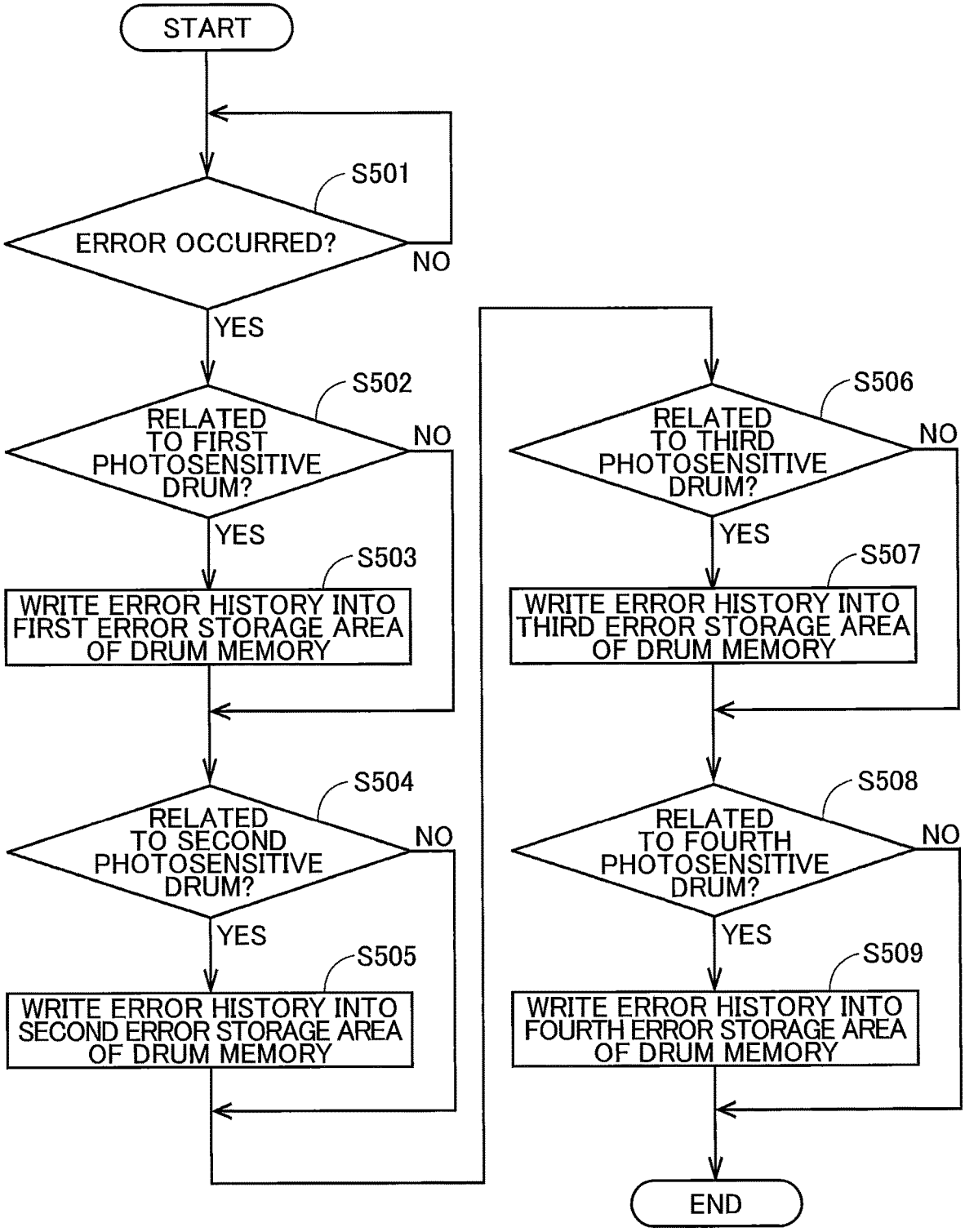
FIG. 16 is a flowchart illustrating steps in a process for writing an error history to the drum memory executed by the controller in the image forming apparatus according to the first embodiment.

Note that the process in FIG. 16 is executed concurrently with a printing process. That is, the processor 105 starts the process in FIG. 16 when the printing process is started, and ends the process in FIG. 16 at the time when the printing process is ended. When executing the printing process, in S501 the processor 105 of the controller 102 always monitors whether an error is detected in the drum cartridge 1. An error is detected by a sensor (not illustrated) provided in the main casing 101 of the image forming apparatus 100. When no error is detected (S501: NO), the processor 105 continues to monitor whether an error is detected.

When an error is detected through the sensor (S501: YES), in S502 the processor 105 first determines whether or not the error is related to the first photosensitive drum 11A. This is determined by, for example, whether or not the sensor that has detected the error is a sensor corresponding to the first photosensitive drum 11A.

When the error is related to the first photosensitive drum 11A (S502: YES), in S503 the processor 105 writes an error history into a first error storage area of the drum memory 151. The error history includes at least one of, for example, the time and date when the error occurs and type of the error. On the other hand, when the error is not related to the first photosensitive drum 11A (S502: NO), the processor 105 skips S503 and directly advances to S504.

In S504 the processor 105 determines whether or not the error is related to the second photosensitive drum 11B. This is determined by whether or not the sensor that has detected the error is a sensor corresponding to the second photosensitive drum 11B, for example. When the error is related to the second photosensitive drum 11B (S504: YES), in S505 the processor 105 writes an error history into a second error storage area of the drum memory 151 that is different from the first error storage area. The error history includes at least one of, for example, the time and date when the error occurs and type of the error. On the other hand, when the error is not related to the second photosensitive drum 11B (S504: NO), the processor 105 skips S505 and directly advances to S506.

Then in S506 the processor 105 determines whether or not the error is related to the third photosensitive drum 11C. This is determined by whether or not the sensor that has detected the error is a sensor corresponding to the third photosensitive drum 11C, for example. When the error is related to the third photosensitive drum 11C (S506: YES), in S507 the processor 105 writes an error history into a third error storage area of the drum memory 151 different from both the first error storage area and the second error storage area. The error history includes at least one of, for example, the time and date when the error occurs and type of the error. On the other hand, when the error is not related to the third photosensitive drum 11C (S506: NO), the processor 105 advances to S508 without executing the process in S507.

In S508 the processor 105 determines whether or not the error is related to the fourth photosensitive drum 11D. This is determined by whether or not the sensor that has detected the error is a sensor corresponding to the fourth photosensitive drum 11D, for example.

When the error is related to the fourth photosensitive drum 11D (S508: YES), in S509 the processor 105 writes an error history into a fourth error storage area of the drum memory 151 different from the first error storage area, the second error storage area, and the third error storage area. The error history includes at least one of, for example, the time and date when the error occurs and type of the error. Subsequently, the processor 105 ends the current process. When the occurred error is not related to the fourth photosensitive drum 11D (S508: NO), the processor 105 ends the process without executing the process in S509.

2. Second Embodiment

Figure 17:
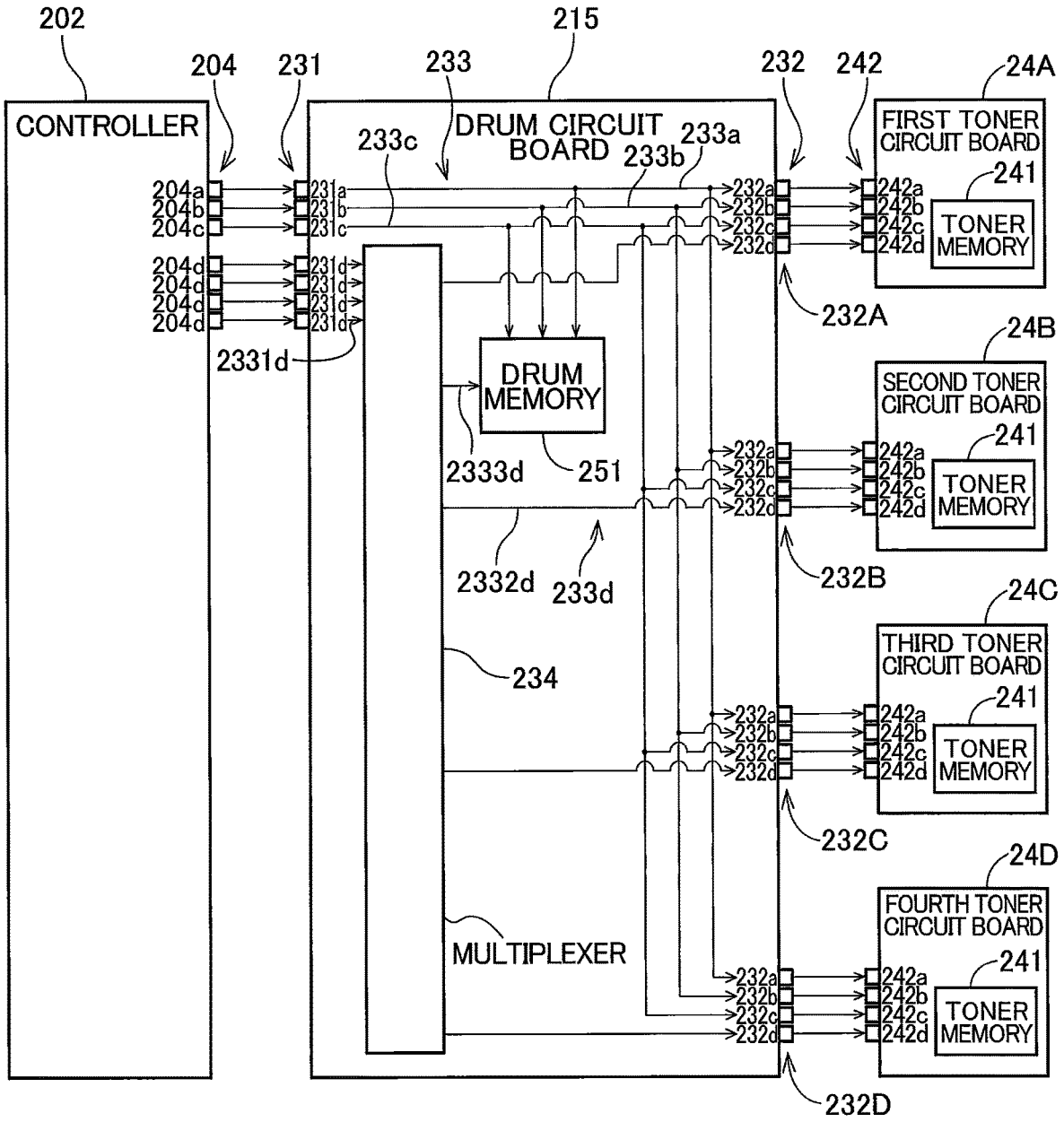
FIG. 17 is a block diagram illustrating electrical connection among a controller, a drum circuit board, and four toner circuit boards in an image forming apparatus according to a second embodiment.

Next, a second embodiment of the present disclosure will be described with reference to FIG. 17, wherein like parts and components are designated by the same reference numerals as those illustrated in the first embodiment. FIG. 17 is a block diagram illustrating electrical connection among a controller 202, a drum circuit board 215, and the four toner circuit boards 24 according to the second embodiment.

In the example of FIG. 17, the drum cartridge 1 includes the drum circuit board 215, a drum memory 251, and a multiplexer 234. The drum circuit board 215 includes main body-side terminals 231, toner-side terminals 232, and relay lines 233. The drum memory 251 and the multiplexer 234 are positioned on the drum circuit board 215. However, the drum memory 251 and the multiplexer 234 may not necessarily be positioned on the drum circuit board 215. Specifically, the drum memory 251 may be positioned on the surface of the frame 12.

<2-1. Main Body-Side Terminals>

The main body-side terminals 231 are electrically connected to terminals 204 of the controller 202 through the first electrical terminal 13 in a state where the drum cartridge 1 is attached to the main casing 101 of the image forming apparatus 100. As a result, the drum circuit board 215 and the controller 202 are electrically connected to each other.

As illustrated in FIG. 17, the number of the main body-side terminals 231 in the present embodiment is plural, more specifically, seven. More specifically, the main body-side terminals 231 include one main body-side voltage terminal 231*a*, one main body-side ground terminal 231*b*, one main body-side clock terminal 231*c*, and four main body-side signal terminals 231*d*.

The main body-side voltage terminal 231*a* is electrically connected to a voltage terminal 204*a* of the terminals 204 of the controller 202 in a state where the drum cartridge 1 is attached to the main casing 101 of the image forming apparatus 100. With this configuration, power supply voltage is supplied from the controller 202 to the drum circuit board 215.

The main body-side ground terminal 231*b* is electrically connected to a ground terminal 204*b* of the terminals 204 of the controller 202 in a state where the drum cartridge 1 is attached to the main casing 101 of the image forming apparatus 100. This configuration allows ground voltage to be supplied from the controller 202 to the drum circuit board 215.

The main body-side clock terminal 231*c* is electrically connected to a clock terminal 204*c* of the terminals 204 of the controller 202 in a state where the drum cartridge 1 is attached to the main casing 101 of the image forming apparatus 100. Accordingly, a clock signal is supplied from the controller 202 to the drum circuit board 215 at constant time intervals.

The main body-side signal terminals 231*d* are electrically connected to respective signal terminals 204*d* of the terminals 204 of the controller 202 in a state where the drum cartridge 1 is attached to the main casing 101 of the image forming apparatus 100. This allows a signal indicating various information to be exchanged between the controller 202 and the drum circuit board 215.

<2-2. Toner-Side Terminals>

Each of the toner-side terminals 232 is electrically connected to the corresponding toner circuit board 24 of the toner cartridges 2 through the corresponding second electrical terminal 14 in a state where the toner cartridges 2 are attached to the frame 12 of the drum cartridge 1. Accordingly, the drum circuit board 215 is electrically connected to each of the toner circuit boards 24. As illustrated in FIG. 17, in the present embodiment, the number of the toner-side terminals 232 is plural, i.e., sixteen (16) in total.

The toner-side terminals 232 include a first group 232A having four toner-side terminals 232, a second group 232B having four toner-side terminals 232, a third group 232C having four toner-side terminals 232, and a fourth group 232D having four toner-side terminals 232.

The toner-side terminals 232 of the first group 232A are electrically connected to the first toner circuit board 24A in a state where the first toner cartridge 2A is attached to the frame 12 of the drum cartridge 1. The toner-side terminals 232 of the second group 232B are electrically connected to the second toner circuit board 24B in a state where the second toner cartridge 2B is attached to the frame 12 of the drum cartridge 1. The toner-side terminals 232 of the third group 232C are electrically connected to the third toner circuit board 24C in a state where the third toner cartridge 2C is attached to the frame 12 of the drum cartridge 1. The toner-side terminals 232 of the fourth group 232D are electrically connected to the fourth toner circuit board 24D in a state where the fourth toner cartridge 2D is attached to the frame 12 of the drum cartridge 1.

The toner-side terminals 232 of each of the first group 232A through the fourth group 232D include a toner-side voltage terminal 232*a*, a toner-side ground terminal 232*b*, a toner-side clock terminal 232*c*, and a toner-side signal terminal 232*d*.

The toner-side voltage terminal 232*a* for each of the first group 232A through the fourth group 232D is electrically connected to the main body-side voltage terminal 231*a* through a voltage relay line 233*a* (described later). Further, in a state where each of the toner cartridges 2 is attached to the frame 12 of the drum cartridge 1, each of the toner-side voltage terminals 232*a* is electrically connected to the corresponding voltage terminal 242*a* of the toner circuit boards 24. With this connection, power supply voltage is supplied from the controller 202 to each of the toner circuit boards 24 through the drum circuit board 215.

The toner-side ground terminal 232*b* for each of the first group 232A through the fourth group 232D is electrically connected to the main body-side ground terminal 231*b* through a ground relay line 233*b* (described later). Further, in a state where each of the toner cartridge 2 is attached to the frame 12 of the drum cartridge 1, each of the toner-side ground terminals 232*b* is electrically connected to the corresponding ground terminal 242*b* of the toner circuit boards 24. As a result, ground voltage is supplied from the controller 202 to each of the toner circuit board 24 through the drum circuit board 215.

The toner-side clock terminal 232*c* for each of the first group 232A through the fourth group 232D is electrically connected to the main body-side clock terminal 231*c* through a clock relay line 233*c* (described later). Further, in a state where each toner cartridge 2 is attached to the frame 12 of the drum cartridge 1, each toner-side clock terminal 232*c* is electrically connected to the corresponding clock terminal 242*c* of the toner circuit boards 24. Accordingly, a clock signal is supplied from the controller 202 to each of the toner circuit boards 24 through the drum circuit board 215 at constant time intervals.

The toner-side signal terminal 232*d* for each of the first group 232A through the fourth group 232D is electrically connected to the multiplexer 234 through corresponding signal relay lines 233*d* (described later). Further, in a state where each of the toner cartridges 2 is attached to the frame 12 of the drum cartridge 1, each of the toner-side signal terminals 232*d* is electrically connected to the corresponding signal terminal 242*d* of the toner circuit boards 24.

<2-3. Relay Lines>

As illustrated in FIG. 17, the relay lines 233 include the voltage relay line 233*a*, the ground relay line 233*b*, the clock relay line 233*c*, and the signal relay lines 233*d*. The number of the voltage relay lines 233*a* is one, the number of the ground relay lines 233*b* is one, the number of the clock relay lines 233*c* is one, and the number of the signal relay lines 233*d* is plural.

The voltage relay line 233*a* has one end portion electrically connected to the main body-side voltage terminal 231*a*, and another end portion divided into five end portions. Specifically, the other end portion of the voltage relay line 233*a* includes a first end portion, a second end portion, a third end portion, a fourth end portion, and a fifth end portion.

The first end portion of the voltage relay line 233*a* is electrically connected to the toner-side voltage terminal 232*a* of the first group 232A. The second end portion of the voltage relay line 233*a* is electrically connected to the toner-side voltage terminal 232*a* of the second group 232B. The third end portion of the voltage relay line 233*a* is electrically connected to the toner-side voltage terminal 232*a* of the third group 232C. The fourth end portion of the voltage relay line 233*a* is electrically connected to the toner-side voltage terminal 232*a* of the fourth group 232D. The fifth end portion of the voltage relay line 233*a* is electrically connected to the drum memory 251.

Accordingly, in the drum circuit board 215, power supply voltage inputted into the main body-side voltage terminal 231*a* is supplied to the four toner-side voltage terminals 232*a* and the drum memory 251. In this way, by sharing the main body-side voltage terminal 231*a*, the number of the main body-side terminals 231 can be reduced.

The ground relay line 233*b* has one end portion electrically connected to the main body-side ground terminal 231*b*, and another end portion divided into five end portions. Specifically, the other end portion of the ground relay line 233*b* includes a first end portion, a second end portion, a third end portion, a fourth end portion, and a fifth end portion.

The first end portion of the ground relay line 233*b* is electrically connected to the toner-side ground terminal 232*b* of the first group 232A. The second end portion of the ground relay line 233*b* is electrically connected to the toner-side ground terminal 232*b* of the second group 232B. The third end portion of the ground relay line 233*b* is electrically connected to the toner-side ground terminal 232*b* of the third group 232C. The fourth end portion of the ground relay line 233*b* is electrically connected to the toner-side ground terminal 232*b* of the fourth group 232D. The fifth end portion of the ground relay line 233*b* is electrically connected to the drum memory 251.

Accordingly, in the drum circuit board 215, ground voltage inputted into the main body-side ground terminal 231*b* is supplied to the four toner-side ground terminals 232*b* and the drum memory 251. Thus, by sharing the main body-side ground terminal 231*b*, the number of the main body-side terminals 231 can be reduced.

The clock relay line 233*c* has one end portion electrically connected to the main body-side clock terminal 231*c*, and another end portion divided into five end portions. More specifically, the other end portion of the clock relay line 233*c* includes a first end portion, a second end portion, a third end portion, a fourth end portion, and a fifth end portion.

The first end portion of the clock relay line 233*c* is electrically connected to the toner-side clock terminal 232*c* of the first group 232A. The second end portion of the clock relay line 233*c* is electrically connected to the toner-side clock terminal 232*c* of the second group 232B. The third end portion of the clock relay line 233*c* is electrically connected to the toner-side clock terminal 232*c* of the third group 232C. The fourth end portion of the clock relay line 233*c* is electrically connected to the toner-side clock terminal 232*c* of the fourth group 232D. The fifth end portion of the clock relay line 233*c* is electrically connected to the drum memory 251.

Accordingly, in the drum circuit board 215, a clock signal inputted into the main body-side clock terminal 231*c* is supplied to the four toner-side clock terminals 232*c* and the drum memory 251. Thus, by sharing the main body-side clock terminal 231*c*, the number of the main body-side terminals 231 can be reduced.

The signal relay lines 233*d* include main body-side signal relay lines 2331*d*, toner-side signal relay lines 2332*d*, and a drum signal line 2333*d*. The number of the main body-side signal relay lines 2331*d* in the present embodiment is plural, specifically, four. The number of the toner-side signal relay lines 2332*d* is plural, specifically, four. The number of the drum signal lines 2333*d* is one.

The main body-side signal relay lines 2331*d* electrically connect the corresponding main body-side signal terminals 231*d* and the multiplexer 234. The toner-side signal relay lines 2332*d* electrically connect the corresponding toner-side signal terminals 232*d* and the multiplexer 234. The drum signal line 2333*d* electrically connects the multiplexer 234 and the drum memory 251 to each other.

<2-4. Multiplexer>

The multiplexer 234 is a switch circuit for switching connection of signal lines. The main body-side signal terminals 231*d* include main body-side address signal terminals, and a main body-side data signal terminal. In the present embodiment, the number of the main body-side signal terminals 231*d* is four. More specifically, the number of the main body-side address signal terminals is three, and the number of the main body-side data signal terminals is one.

The multiplexer 234 receives an address signal from the controller 202 through the main body-side address signal terminals. The address signal is a signal for designating a communication destination. The multiplexer 234 selects the communication destination with which the controller 202 is to communicate among the drum memory 251 and the four toner-side signal terminals 232*d* according to the address signal received through the main body-side address signal terminals.

Further, the multiplexer 234 receives a data signal from the controller 202 through the main body-side data signal terminal. The data signal is a signal indicating various information that is to be transmitted to a communication destination. The multiplexer 234 outputs the data signal received through the main body-side data signal terminal to the drum memory 251 or one of the toner-side signal terminals 232*d* selected as the communication destination.

As described above, by using the multiplexer 234, the controller 202 can output the data signal to a communication destination after designating the communication destination among the drum memory 251 and the toner memories 241. Therefore, it is not necessary to provide the main body-side signal terminals 231*d* individually for each of the drum memory 251 and the four toner-side signal terminals 232*d*. Thus, the number of the main body-side signal terminals 231*d* can be reduced. Further, the number of the signal terminals 204*d* of the controller 202 can be also reduced.

Specifically, while five main body-side signal terminals 31*d* are required in the first embodiment (FIG. 6), four main body-side signal terminals 231*d* are sufficient in the second embodiment (FIG. 17). Further, while five signal terminals 104*d* of the controller 202 are required in the first embodiment, four signal terminals 204*d* are sufficient in the present embodiment.

<2-5. Relay of Information by Drum Circuit Board>

Also in the present embodiment, the controller 202 and each of the toner circuit boards 24 are connected to each other through the drum circuit board 215. Thus, the number of the terminals can be reduced in comparison with a case where each of the drum circuit board 215 and each of the toner circuit boards 24 are directly connected to the controller 202.

For example, as illustrated in FIG. 17, power supply voltage to be supplied to the drum memory 251 of the drum circuit board 215 and the toner memories 241 of the toner circuit boards 24 can be outputted through one main body-side voltage terminal 231*a*. Further, as illustrated in FIG. 17, ground voltage to be supplied to the drum memory 251 of the drum circuit board 215 and the toner memories 241 of the toner circuit boards 24 can be outputted through one main body-side ground terminal 231*b*. Further, as illustrated in FIG. 17, a clock signal to be supplied to the drum memory 251 of the drum circuit board 215 and the toner memories 241 of the toner circuit boards 24 can be outputted through one main body-side clock terminal 231*c*. This allows reduction in the number of the terminals 204 of the controller 202.

In particular, when the plurality of toner circuit boards 24 is provided as in the present embodiment, the number of the terminals can be further reduced by connecting the controller 202 and the plurality of the toner circuit boards 24 through the drum circuit board 215. For example, as illustrated in FIG. 17, power supply voltage to be supplied to the four toner circuit boards 24 can be outputted through one main body-side voltage terminal 231*a*. Further, as illustrated in FIG. 17, ground voltage to be supplied to the four toner circuit boards 24 can be outputted through one main body-side ground terminal 231*b*. Further, as illustrated in FIG. 17, a clock signal to be supplied to the four toner circuit boards 24 can be outputted through one main body-side clock terminal 231*c*. Accordingly, the number of the terminals 204 can be further reduced.

3. Third Embodiment

Figure 18:
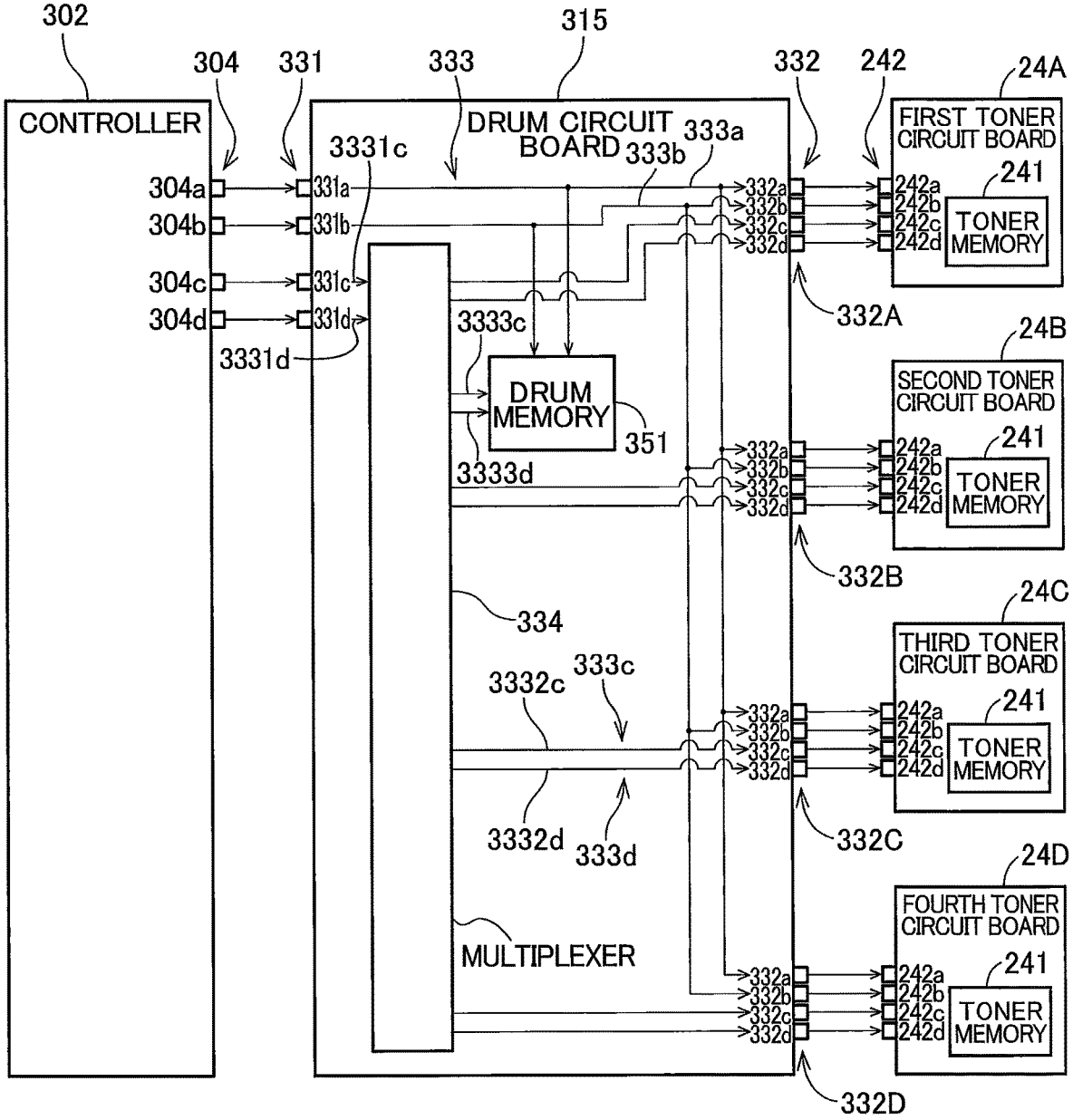
FIG. 18 is a block diagram illustrating electrical connection among a controller, a drum circuit board, and four toner circuit boards in an image forming apparatus according to a third embodiment.

A third embodiment of the present disclosure will be described with reference to FIG. 18, wherein like parts and components are designated by the same reference numerals as those illustrated in the first embodiment and the second embodiment. FIG. 18 is a block diagram illustrating electrical connection among a controller 302, a drum circuit board 315, and the fourth toner circuit boards 24 according to the third embodiment.

In the embodiment of FIG. 18, the drum cartridge 1 includes the drum circuit board 315, a drum memory 351, and a multiplexer 334. The drum circuit board 315 includes main body-side terminals 331, toner-side terminals 332, and relay lines 333. The drum memory 351 and the multiplexer 334 are positioned on the drum circuit board 315. Note that the drum memory 351 and the multiplexer 334 may not be positioned on the drum circuit board 315. Specifically, the drum memory 351 may be positioned at the surface of the frame 12.

<3-1. Main Body-Side Terminals>

The main body-side terminals 331 are electrically connected to terminals 304 of the controller 302 through the first electrical terminal 13 in a state where the drum cartridge 1 is attached to the main casing 101 of the image forming apparatus 100. As a result, the drum circuit board 315 and the controller 302 are electrically connected to each other.

As illustrated in FIG. 18, the number of the main body-side terminals 331 in the present embodiment is plural, more specifically, four. That is, the main body-side terminals 331 include one main body-side voltage terminal 331*a*, one main body-side ground terminal 331*b*, one main body-side clock terminal 331*c*, and one main body-side signal terminal 331*d*.

The main body-side voltage terminal 331*a* is electrically connected to a voltage terminal 304*a* of the terminals 304 of the controller 302 in a state where the drum cartridge 1 is attached to the main casing 101 of the image forming apparatus 100. With this configuration, power supply voltage is supplied from the controller 302 to the drum circuit board 315.

The main body-side ground terminal 331*b* is electrically connected to a ground terminal 304*b* of the terminals 304 of the controller 302 in a state where the drum cartridge 1 is attached to the main casing 101 of the image forming apparatus 100. This configuration allows ground voltage to be supplied from the controller 302 to the drum circuit board 315.

The main body-side clock terminal 331*c* is electrically connected to a clock terminal 304*c* of the terminals 304 of the controller 302 in a state where the drum cartridge 1 is attached to the main casing 101 of the image forming apparatus 100. Accordingly, a clock signal is supplied from the controller 302 to the drum circuit board 315 at constant time intervals.

The main body-side signal terminal 331*d* is electrically connected to a signal terminal 304*d* of the terminals 304 of the controller 302 in a state where the drum cartridge 1 is attached to the main casing 101 of the image forming apparatus 100. This allows a signal indicating various information to be exchanged between the controller 302 and the drum circuit board 315.

<3-2. Toner-Side Terminals>

Each of the toner-side terminals 332 is electrically connected to the corresponding toner circuit board 24 of the toner cartridges 2 through the corresponding second electrical terminal 14 in a state where the toner cartridges 2 are attached to the frame 12 of the drum cartridge 1. Accordingly, the drum circuit board 315 is electrically connected to the toner circuit boards 24. As illustrated in FIG. 18, in the present embodiment, the number of the toner-side terminals 332 is plural, i.e., sixteen (16) in total.

The toner-side terminals 332 include a first group 332A having four toner-side terminals 332, a second group 332B having four toner-side terminals 332, a third group 332C having four toner-side terminals 332, and a fourth group 332D having four toner-side terminals 332.

The toner-side terminals 332 of the first group 332A are electrically connected to the first toner circuit board 24A in a state where the first toner cartridge 2A is attached to the frame 12 of the drum cartridge 1. The toner-side terminals 332 of the second group 332B are electrically connected to the second toner circuit board 24B in a state where the second toner cartridge 2B is attached to the frame 12 of the drum cartridge 1. The toner-side terminals 332 of the third group 332C are electrically connected to the third toner circuit board 24C in a state where the third toner cartridge 2C is attached to the frame 12 of the drum cartridge 1. The toner-side terminals 332 of the fourth group 332D are electrically connected to the fourth toner circuit board 24D in a state where the fourth toner cartridge 2D is attached to the frame 12 of the drum cartridge 1.

The toner-side terminals 332 of each of the first group 332A through the fourth group 332D include a toner-side voltage terminal 332*a*, a toner-side ground terminal 332*b*, a toner-side clock terminal 332*c*, and a toner-side signal terminal 332*d*.

The toner-side voltage terminal 332*a* for each of the first group 332A through the fourth group 332D is electrically connected to the main body-side voltage terminal 331*a* through a voltage relay line 333*a* (described later). Further, in a state where each of the toner cartridges 2 is attached to the frame 12 of the drum cartridge 1, each of the toner-side voltage terminals 332*a* is electrically connected to the corresponding voltage terminal 242*a* of the toner circuit boards 24. With this connection, power supply voltage is supplied from the controller 302 to each of the toner circuit boards 24 through the drum circuit board 315.

The toner-side ground terminal 332*b* for each of the first group 332A through the fourth group 332D is electrically connected to the main body-side ground terminal 331*b* through a ground relay line 333*b* (described later). Further, in a state where each of the toner cartridges 2 is attached to the frame 12 of the drum cartridge 1, each of the toner-side ground terminals 332*b* is electrically connected to the corresponding ground terminal 242*b* of the toner circuit boards 24. As a result, ground voltage is supplied from the controller 302 to each of the toner circuit boards 24 through the drum circuit board 315.

The toner-side clock terminal 332*c* for each of the first group 332A through the fourth group 332D is electrically connected to the multiplexer 334 through clock relay lines 333*c* (described later). Further, in a state where each of the toner cartridges 2 is attached to the frame 12 of the drum cartridge 1, each of the toner-side clock terminals 332*c* is electrically connected to the corresponding clock terminal 242*c* of the toner circuit boards 24.

The toner-side signal terminal 332*d* for each of the first group 332A through the fourth group 332D is electrically connected to the multiplexer 334 through signal relay lines 333*d* (described later). Further, in a state where each of the toner cartridges 2 is attached to the frame 12 of the drum cartridge 1, each of the toner-side signal terminals 332*d* is electrically connected to the corresponding signal terminal 242*d* of the toner circuit boards 24.

<3-3. Relay Lines>

As illustrated in FIG. 18, the relay lines 333 in the third embodiment include the voltage relay line 333*a*, the ground relay line 333*b*, the clock relay lines 333*c*, and the signal relay lines 333*d*.

The voltage relay line 333*a* has one end portion electrically connected to the main body-side voltage terminal 331*a*, and another end portion divided into five end portions. Specifically, the other end portion of the voltage relay line 333*a* includes a first end portion, a second end portion, a third end portion, a fourth end portion, and a fifth end portion.

The first end portion of the voltage relay line 333*a* is electrically connected to the toner-side voltage terminal 332*a* of the first group 332A. The second end portion of the voltage relay line 333*a* is electrically connected to the toner-side voltage terminal 332*a* of the second group 332B. The third end portion of the voltage relay line 333*a* is electrically connected to the toner-side voltage terminal 332*a* of the third group 332C. The fourth end portion of the voltage relay line 333*a* is electrically connected to the toner-side voltage terminal 332*a* of the fourth group 332D. The fifth end portion of the voltage relay line 333*a* is electrically connected to the drum memory 351.

Accordingly, in the drum circuit board 315, power supply voltage inputted into the main body-side voltage terminal 331*a* is supplied to the four toner-side voltage terminals 332*a* and the drum memory 351. In this way, by sharing the main body-side voltage terminal 331*a*, the number of the main body-side terminals 331 can be reduced.

The ground relay line 333*b* has one end portion electrically connected to the main body-side ground terminal 331*b*, and another end portion divided into five end portions. Specifically, the other end portion of the ground relay line 333*b* includes a first end portion, a second end portion, a third end portion, a fourth end portion, and a fifth end portion.

The first end portion of the ground relay line 333*b* is electrically connected to the toner-side ground terminal 332*b* of the first group 332A. The second end portion of the ground relay line 333*b* is electrically connected to the toner-side ground terminal 332*b* of the second group 332B. The third end portion of the ground relay line 333*b* is electrically connected to the toner-side ground terminal 332*b* of the third group 332C. The fourth end portion of the ground relay line 333*b* is electrically connected to the toner-side ground terminal 332*b* of the fourth group 332D. The fifth end portion of the ground relay line 333*b* is electrically connected to the drum memory 351.

Accordingly, in the drum circuit board 315, ground voltage inputted into the main body-side ground terminal 331*b* is supplied to the four toner-side ground terminals 332*b* and the drum memory 351. Thus, by sharing the main body-side ground terminal 331*b*, the number of the main body-side terminals 331 can be reduced.

The clock relay lines 333*c* include a main body-side clock relay line 3331*c*, toner-side clock relay lines 3332*c*, and a drum clock line 3333*c*. The number of the main body-side clock relay lines 3331*c* is one. The number of the toner-side clock relay lines 3332*c* is plural, specifically, four. The number of the drum clock lines 3333*c* is one. The main body-side clock relay line 3331*c* electrically connects the main body-side clock terminal 331*c* and the multiplexer 334. Each of the toner-side clock relay lines 3332*c* electrically connects the multiplexer 334 and the corresponding one of the toner-side clock terminals 332*c*. The drum clock line 3333*c* electrically connects the multiplexer 334 and the drum memory 351.

The signal relay lines 333*d* include a main body-side signal relay line 3331*d*, toner-side signal relay lines 3332*d*, and a drum signal line 3333*d*. The number of the main body-side signal relay lines 3331*d* in the present embodiment is one. The number of the toner-side signal relay lines 3332*d* is plural, specifically, four. The number of the drum signal lines 3333*d* is one.

The main body-side signal relay line 3331*d* electrically connects the main body-side signal terminals 331*d* and the multiplexer 334. Each of the toner-side signal relay lines 3332*d* electrically connects the corresponding toner-side signal terminals 332*d* and the multiplexer 334. The drum signal line 3333*d* electrically connects the multiplexer 334 and the drum memory 351.

<3-4. Multiplexer>

The multiplexer 334 is a switch circuit for switching connection of the signal lines. The multiplexer 334 receives a clock signal from the controller 302 through the main body-side clock terminal 331*c*. Further, the multiplexer 334 supplies the obtained clock signal to each of the toner circuit boards 24 through the corresponding one of the toner-side clock terminals 332*c*, and to the drum memory 351. That is, in this drum circuit board 315, the clock signal inputted into the main body-side clock terminal 331*c* is supplied to the four toner-side clock terminals 332*c* and the drum memory 351. By sharing the main body-side clock terminal 331*c* in this way, the number of the main body-side terminals 331 can be reduced.

Further, the multiplexer 334 receives an address signal and a data signal from the controller 302 through the main body-side signal terminal 331*d*. The address signal is a signal for designating a communication destination. The data signal is a signal indicating various information to be transmitted to the communication destination. The multiplexer 334 selects the communication destination among the drum memory 351 and the four toner-side signal terminals 332*d* in accordance with the address signal received from the controller 302. Further, the multiplexer 334 outputs the received data signal to one of the drum memory 351 and the toner-side signal terminals 332*d*.

As described above, by using the multiplexer 334, the controller 302 can output the data signal to a communication destination after designating the communication destination among the drum memory 351 and the toner memory 241. Therefore, it is not necessary to provide the main body-side signal terminal 331*d* individually for each of the drum memory 351 and the toner-side signal terminals 332*d*. Thus, the number of the main body-side signal terminals 331*d* can be reduced. Further, the number of the signal terminals 304*d* of the controller 302 can be also reduced.

Particularly, the multiplexer 334 according to the present embodiment receives an address signal and a data signal from the controller 302 through one main body-side signal terminal 331*d*. With this configuration, the number of the main body-side signal terminal 331*d* can be further reduced. Also, the number of the signal terminals 304*d* of the controller 302 can be further reduced.

Specifically, while five main body-side signal terminals 31*d* are required in the first embodiment (FIG. 6), only one main body-side signal terminal 331*d* is required in the present embodiment (FIG. 18). Further, while five signal terminals 104*d* of the controller 302 are required in the first embodiment, only one signal terminal 304*d* is sufficient in the present embodiment.

<3-5. Relay of Information by Drum Circuit Board>

Also in the present embodiment, the controller 302 and each of the toner circuit boards 24 are connected to each other through the drum circuit board 315. Thus, the number of the terminals can be reduced in comparison with a case where each of the drum circuit board 315 and each of the toner circuit boards 24 are directly connected to the controller 302.

For example, as illustrated in FIG. 18, power supply voltage to be supplied to the drum memory 351 of the drum circuit board 315 and the toner memories 241 of the toner circuit boards 24 can be outputted through one main body-side voltage terminal 331*a*. Further, as illustrated in FIG. 18, ground voltage to be supplied to the drum memory 351 of the drum circuit board 315 and the toner memories 241 of the toner circuit boards 24 can be outputted through one main body-side ground terminal 331*b*. Further, as illustrated in FIG. 18, a clock signal to be supplied to the drum memory 351 of the drum circuit board 315 and the toner memories 241 of the toner circuit boards 24 can be outputted through one main body-side clock terminal 331*c*. This allows reduction in the number of the terminals 304 of the controller 302.

In particular, when the plurality of toner circuit boards 24 is provided as in the present embodiment, the number of the terminals can be further reduced by connecting the controller 302 and the plurality of the toner circuit boards 24 through the drum circuit board 315. For example, as illustrated in FIG. 18, power supply voltage to be supplied to the four toner circuit boards 24 can be outputted through one main body-side voltage terminal 331*a*. Further, as illustrated in FIG. 18, ground voltage to be supplied to the four toner circuit boards 24 can be outputted through one main body-side ground terminal 331*b*. Further, as illustrated in FIG. 18, a clock signal to be supplied to the four toner circuit boards 24 can be outputted through one main body-side clock terminal 331*c*. Accordingly, the number of the terminals 304 can be further reduced.

4. Fourth Embodiment

Figure 19:
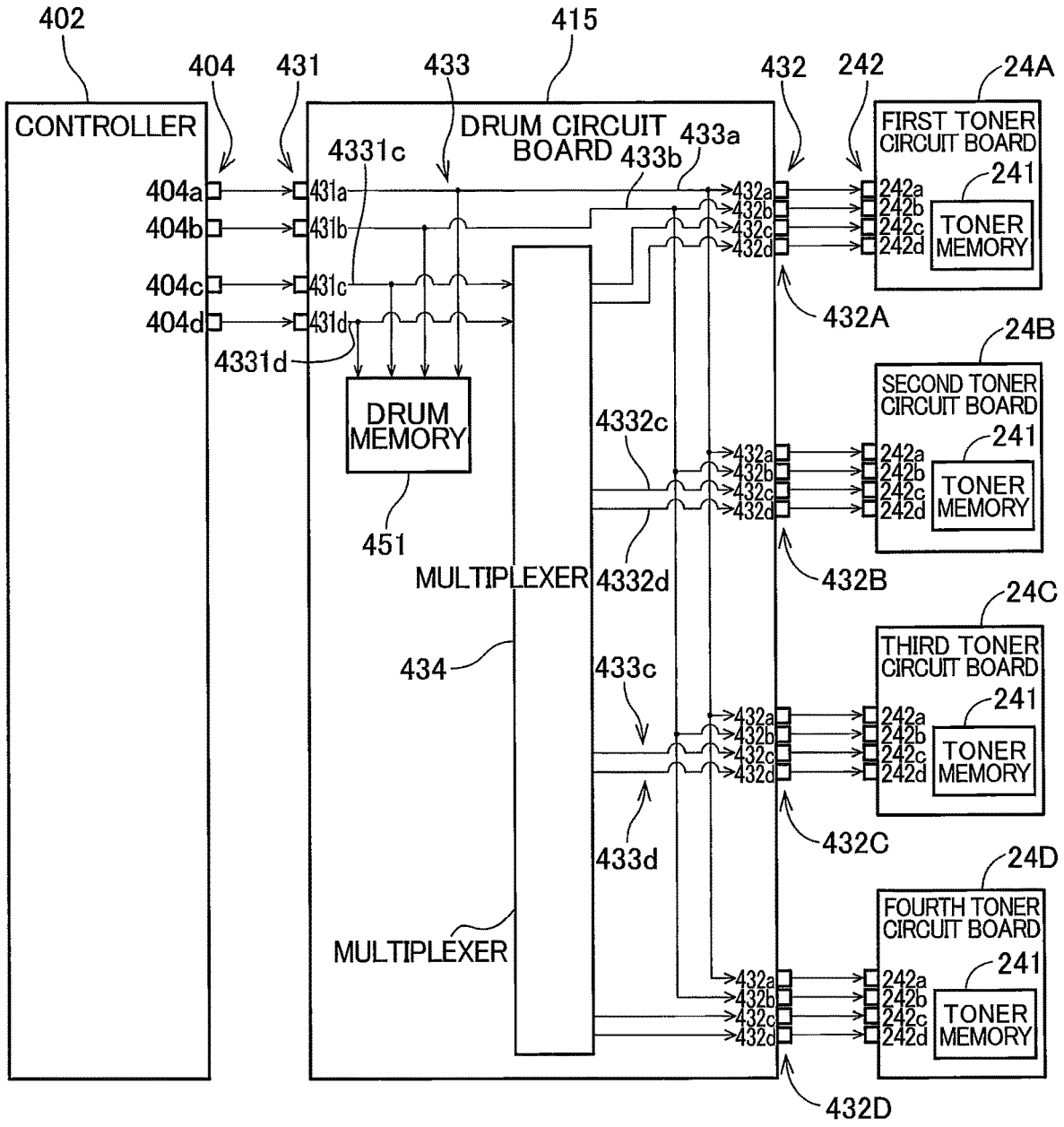
FIG. 19 is a block diagram illustrating electrical connection among a controller, a drum circuit board, and four toner circuit boards in an image forming apparatus according to a fourth embodiment.
Figure 20:
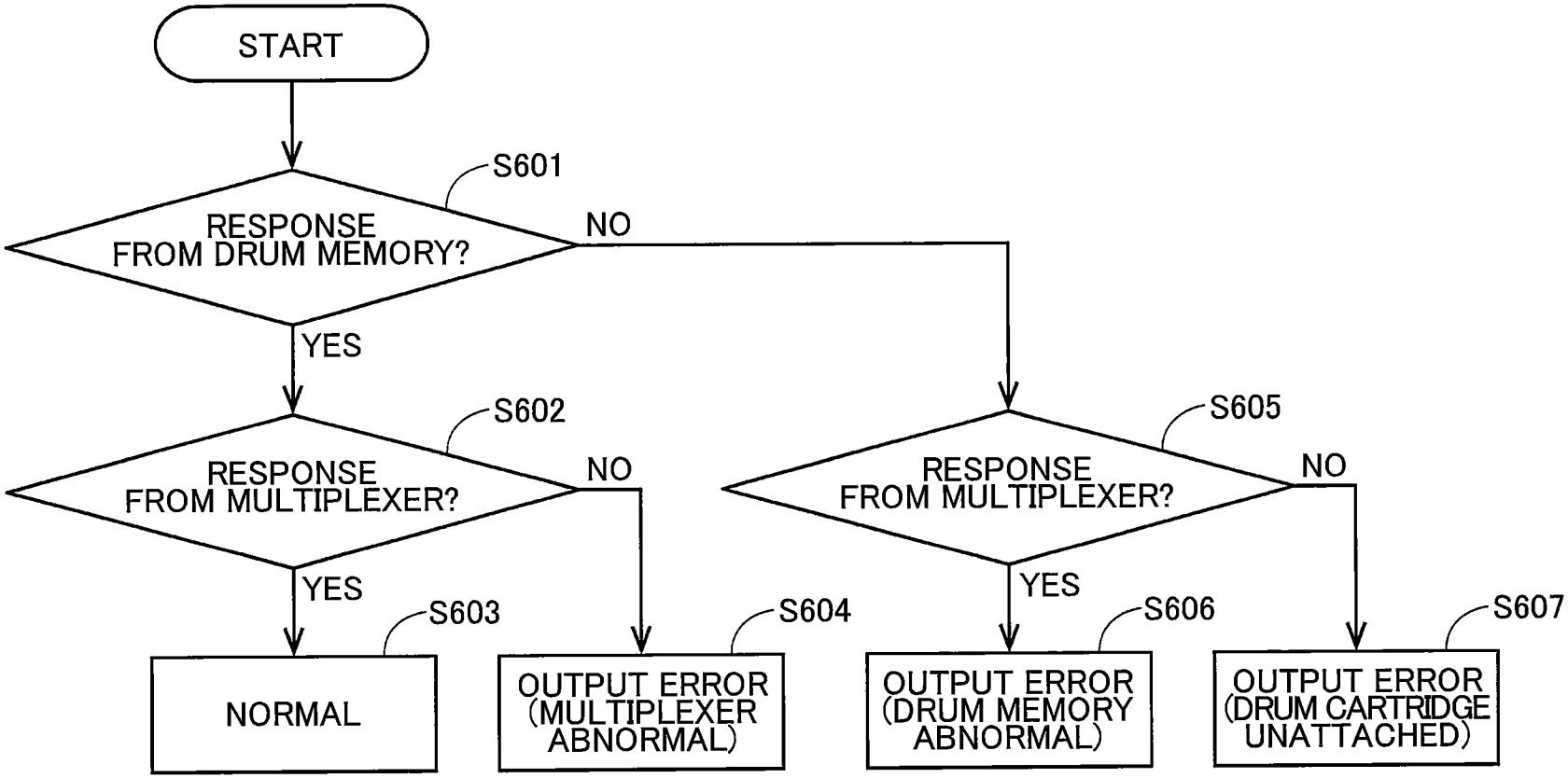
FIG. 20 is a flowchart illustrating steps in process for identifying source of abnormality executed by the controller in the image forming apparatus according to the fourth embodiment.

A fourth embodiment of the present disclosure will be described with reference to FIGS. 19 and 20, wherein like parts and components are designated by the same reference numerals as those illustrated in the first embodiment through third embodiment. FIG. 19 is a block diagram illustrating electrical connection among a controller 402, a drum circuit board 415, and the four toner circuit boards 24 according to the fourth embodiment.

In the embodiment of FIG. 19, the drum cartridge 1 includes the drum circuit board 415, a drum memory 451, and a multiplexer 434. The drum circuit board 415 includes a plurality of main body-side terminals 431, a plurality of toner-side terminals 432, and a plurality of relay lines 433. The drum memory 451 and the multiplexer 434 are positioned on the drum circuit board 415. Note that the drum memory 451 need not be positioned on the drum circuit board 415. Specifically, the drum memory 451 may be positioned on the surface of the frame 12, for example.

<4-1. Main Body-Side Terminals>

The main body-side terminals 431 are electrically connected to terminals 404 of the controller 402 through the first electrical terminal 13 in a state where the drum cartridge 1 is attached to the main casing 101 of the image forming apparatus 100. As a result, the drum circuit board 415 and the controller 402 are electrically connected to each other.

As illustrated in FIG. 19, the number of the main body-side terminals 431 in the present embodiment is plural, more specifically, four. More specifically, the main body-side terminals 431 include one main body-side voltage terminal 431*a*, one main body-side ground terminal 431*b*, one main body-side clock terminal 431*c*, and one main body-side signal terminal 431*d*.

The main body-side voltage terminal 431*a* is electrically connected to a voltage terminal 404*a* of the terminals 404 of the controller 402 in a state where the drum cartridge 1 is attached to the main casing 101 of the image forming apparatus 100. With this configuration, power supply voltage is supplied from the controller 402 to the drum circuit board 415.

The main body-side ground terminal 431*b* is electrically connected to a ground terminal 404*b* of the terminals 404 of the controller 402 in a state where the drum cartridge 1 is attached to the main casing 101 of the image forming apparatus 100. This configuration allows ground voltage to be supplied from the controller 402 to the drum circuit board 415.

The main body-side clock terminal 431*c* is electrically connected to a clock terminal 404*c* of the terminals 404 of the controller 402 in a state where the drum cartridge 1 is attached to the main casing 101 of the image forming apparatus 100. Accordingly, a clock signal is supplied from the controller 402 to the drum circuit board 415 at constant time intervals.

The main body-side signal terminal 431*d* is electrically connected to a signal terminal 404*d* of the terminals 404 of the controller 402 in a state where the drum cartridge 1 is attached to the main casing 101 of the image forming apparatus 100. This allows a signal indicating various information to be exchanged between the controller 402 and the drum circuit board 415.

<4-2. Toner-Side Terminals>

Each of the toner-side terminals 432 is electrically connected to the corresponding toner circuit board 24 of the toner cartridges 2 through the corresponding second electrical terminal 14 in a state where the four toner cartridges 2 are attached to the frame 12 of the drum cartridge 1. Accordingly, the drum circuit board 415 is electrically connected to the toner circuit boards 24. As illustrated in FIG. 19, in the present embodiment, the number of the toner-side terminals 432 is plural, i.e., sixteen (16) in total.

The toner-side terminals 432 include a first group 432A having four toner-side terminals 432, a second group 432B having four toner-side terminals 432, a third group 432C having four toner-side terminals 432, and a fourth group 432D having four toner-side terminals 432.

The toner-side terminals 432 of the first group 432A are electrically connected to the first toner circuit board 24A in a state where the first toner cartridge 2A is attached to the frame 12 of the drum cartridge 1. The toner-side terminals 432 of the second group 432B are electrically connected to the second toner circuit board 24B in a state where the second toner cartridge 2B is attached to the frame 12 of the drum cartridge 1. The toner-side terminals 432 of the third group 432C are electrically connected to the third toner circuit board 24C in a state where the third toner cartridge 2C is attached to the frame 12 of the drum cartridge 1. The toner-side terminals 432 of the fourth group 432D are electrically connected to the fourth toner circuit board 24D in a state where the fourth toner cartridge 2D is attached to the frame 12 of the drum cartridge 1.

The toner-side terminals 432 of each of the first group 432A through the fourth group 432D include a toner-side voltage terminal 432*a*, a toner-side ground terminal 432*b*, a toner-side clock terminal 432*c*, and a toner-side signal terminal 432*d*.

The toner-side voltage terminal 432*a* for each of the first group 432A through the fourth group 432D is electrically connected to the main body-side voltage terminal 431*a* through a voltage relay line 433*a* (described later). Further, in a state where each toner cartridge 2 is attached to the frame 12 of the drum cartridge 1, each of the toner-side voltage terminal 432*a* is electrically connected to the corresponding voltage terminal 242*a* of the toner circuit boards 24. With this connection, power supply voltage is supplied from the controller 402 to each of the toner circuit boards 24 through the drum circuit board 415.

The toner-side ground terminal 432*b* for each of the first group 432A through the fourth group 432D is electrically connected to the main body-side ground terminal 431*b* through a ground relay line 433*b* (described later). Further, in a state where each toner cartridge 2 is attached to the frame 12 of the drum cartridge 1, each of the toner-side ground terminals 432*b* is electrically connected to the corresponding ground terminal 242*b* of the toner circuit boards 24. As a result, ground voltage is supplied from the controller 402 to each of the toner circuit boards 24 through the drum circuit board 415.

The toner-side clock terminal 432*c* for each of the first group 432A through the fourth group 432D is electrically connected to the multiplexer 434 through a corresponding clock relay line 433*c* (described later). Further, in a state where each toner cartridge 2 is attached to the frame 12 of the drum cartridge 1, each of the toner-side clock terminals 432*c* is electrically connected to the corresponding clock terminal 242*c* of the toner circuit boards 24.

The toner-side signal terminal 432*d* for each of the first group 432A through the fourth group 432D is electrically connected to the multiplexer 434 through a corresponding signal relay line 433*d* (described later). Further, in a state where each toner cartridge 2 is attached to the frame 12 of the drum cartridge 1, each of the toner-side signal terminals 432*d* is electrically connected to the corresponding signal terminal 242*d* of the toner circuit boards 24.

<4-3. Relay Lines>

As illustrated in FIG. 19, the relay lines 433 include the voltage relay line 433*a*, the ground relay line 433*b*, the clock relay lines 433*c*, and the signal relay lines 433*d*. More specifically, the number of the voltage relay lines 433*a* is one, the number of the ground relay lines 433*b* is one, the number of the clock relay lines 433*c* is plural, and the number of the signal relay lines 433*d* is plural.

The voltage relay line 433*a* has one end portion electrically connected to the main body-side voltage terminal 431*a*, and another end portion divided into five end portions. Specifically, the other end portion of the voltage relay line 433*a* includes a first end portion, a second end portion, a third end portion, a fourth end portion, and a fifth end portion.

The first end portion of the voltage relay line 433*a* is electrically connected to the toner-side voltage terminal 432*a* of the first group 432A. The second end portion of the voltage relay line 433*a* is electrically connected to the toner-side voltage terminal 432*a* of the second group 432B. The third end portion of the voltage relay line 433*a* is electrically connected to the toner-side voltage terminal 432*a* of the third group 432C. The fourth end portion of the voltage relay line 433*a* is electrically connected to the toner-side voltage terminal 432*a* of the fourth group 432D. The fifth end portion of the voltage relay line 433*a* is electrically connected to the drum memory 451.

Accordingly, in the drum circuit board 415, power supply voltage inputted into the main body-side voltage terminal 431*a* is supplied to the four toner-side voltage terminals 432*a* and the drum memory 451. In this way, by sharing the main body-side voltage terminal 431*a*, the number of the main body-side terminals 431 can be reduced.

The ground relay line 433*b* has one end portion electrically connected to the main body-side ground terminal 431*b*, and another end portion divided into five end portions. Specifically, the other end portion of the ground relay line 433*b* includes a first end portion, a second end portion, a third end portion, a fourth end portion, and a fifth end portion.

The first end portion of the ground relay line 433*b* is electrically connected to the toner-side ground terminal 432*b* of the first group 432A. The second end portion of the ground relay line 433*b* is electrically connected to the toner-side ground terminal 432*b* of the second group 432B. The third end portion of the ground relay line 433*b* is electrically connected to the toner-side ground terminal 432*b* of the third group 432C. The fourth end portion of the ground relay line 433*b* is electrically connected to the toner-side ground terminal 432*b* of the fourth group 432D. The fifth end portion of the ground relay line 433*b* is electrically connected to the drum memory 451.

Accordingly, in the drum circuit board 415, ground voltage inputted into the main body-side ground terminal 431*b* is supplied to the four toner-side ground terminals 432*b* and the drum memory 451. Thus, by sharing the main body-side ground terminal 431*b*, the number of the main body-side terminals 431 can be reduced.

The clock relay lines 433*c* include a main body-side clock relay line 4331*c* and toner-side clock relay lines 4332*c*. In the present embodiment, the number of the main body-side clock relay lines 4331*c* is one, and the number of the toner-side clock relay lines 4332*c* is plural, specifically, four.

The main body-side clock relay line 4331*c* has one end portion electrically connected to the main body-side clock terminal 431*c*, and another end portion divided into two end portions. Specifically, the other end portion of the main body-side clock relay line 4331*c* include a first end portion and a second end portion. The first end portion of the main body-side clock relay line 4331*c* is electrically connected to the drum memory 451. The second end portion of the main body-side clock relay line 4331*c* is electrically connected to the multiplexer 434. Each of the toner-side clock relay lines 4332*c* electrically connects the multiplexer 434 and the corresponding one of the toner-side clock terminals 432*c*.

The signal relay lines 433*d* include a main body-side signal relay line 4331*d* and toner-side signal relay lines 4332*d*. In the present embodiment, the number of the main body-side signal relay lines 4331*d* is one, and the number of the toner-side signal relay lines 4332*d* is plural, specifically, four.

The main body-side signal relay line 4331*d* has one end portion electrically connected to the main body-side signal terminal 431*d*, and another end portion divided into two end portions. Specifically, other end portion of the main body-side signal relay line 4331*d* include a first end portion and a second end portion. The first end portion of the main body-side signal relay line 4331*d* is electrically connected to the drum memory 451. The second end portion of the main body-side signal relay line 4331*d* is electrically connected to the multiplexer 434. Each of the toner-side signal relay lines 4332*d* electrically connects the multiplexer 434 and the corresponding toner-side signal terminal 432*d*.

That is, in the present embodiment, the drum memory 451 is directly connected to the main body-side clock terminal 431*c* without interposing the multiplexer 434 therebetween. Thus, the clock signal inputted from the controller 402 to the main body-side clock terminal 431*c* is received by the drum memory 451 without relaying the multiplexer 434. Further, in the present embodiment, the drum memory 451 is directly connected to the main body-side signal terminal 431*d* without interposing the multiplexer 434 therebetween. Thus, the drum memory 451 receives a data signal inputted from the controller 402 through the main body-side signal terminal 431*d* without intervening the multiplexer 434.

<4-4. Multiplexer>

The multiplexer 434 is a switch circuit for switching connection of the signal lines. The multiplexer 434 receives a clock signal outputted from the controller 402 through the main body-side clock terminal 431*c*, and supplies the received clock signal to each of the toner circuit boards 24 through the corresponding toner-side clock terminal 432*c*.

That is, in this drum circuit board 415, a clock signal inputted into the main body-side clock terminal 431*c* is supplied to the four toner-side clock terminals 432*c* and the drum memory 451. In this way, by sharing the main body-side clock terminal 431*c*, the number of the main body-side terminals 431 can be decreased.

Further, the multiplexer 434 receives an address signal and a data signal from the controller 402 through the main body-side signal terminal 431*d*. The address signal is a signal for designating a communication destination. The data signal is a signal indicating various information to be transmitted to the communication destination. In accordance with the received address signal, the multiplexer 434 selects the communication destination among the four toner-side signal terminals 432*d*. Further, the multiplexer 434 outputs the received data signal to the toner-side signal terminal 432*d* selected as the communication destination.

As described above, by using the multiplexer 434, the controller 402 can output a data signal to a communication destination after designating the communication destination among the four toner memories 241. Therefore, it is not necessary to provide the main body-side signal terminal 431*d* individually for each of the toner-side signal terminals 432*d*. Thus, the number of the main body-side signal terminals 431*d* can be reduced. Further, the number of the signal terminals 404*d* of the controller 402 that corresponds to the main body-side signal terminal 431*d* can be also reduced.

Particularly, the multiplexer 434 according to the present embodiment receives both the address signal and the data signal through one main body-side signal terminal 431*d*. With this configuration, the number of the main body-side signal terminals 431*d* can be reduced. Also, the number of the signal terminals 404*d* of the controller 402 can be further reduced.

Specifically, while five main body-side signal terminals 31*d* are required in the example of FIG. 6 of the first embodiment, only one body-side signal terminal 431*d* is necessary in the example of FIG. 19 of the present embodiment. Further, while five signal terminals 104*d* of the controller 102 are required in the first embodiment, only one signal terminal 404*d* is required in the present embodiment.

<4-5. Relay of Information by Drum Circuit Board>

Also in the present embodiment, the controller 402 and each of the toner circuit board 24 are connected to each other through the drum circuit board 415. Thus, the number of the terminals can be reduced in comparison with a case where each of the drum circuit board 415 and each of the toner circuit boards 24 are directly connected to the controller 402.

For example, as illustrated in FIG. 19, power supply voltage to be supplied to the drum memory 451 of the drum circuit board 415 and the toner memories 241 of the toner circuit boards 24 can be outputted through one main body-side voltage terminal 431*a*. Further, as illustrated in FIG. 19, ground voltage to be supplied to the drum memory 451 of the drum circuit board 415 and the toner memories 241 of the toner circuit boards 24 can be outputted through one main body-side ground terminal 431*b*. Further, as illustrated in FIG. 19, a clock signal to be supplied to the drum memory 451 of the drum circuit board 415 and the toner memories 241 of the toner circuit boards 24 can be outputted through one main body-side clock terminal 431*c*. This allows reduction in the number of the terminals 404 of the controller 402.

In particular, when the plurality of toner circuit boards 24 is provided as in the present embodiment, the number of the terminals can be further reduced by relaying the controller 402 and the plurality of the toner circuit boards 24 by the drum circuit board 415. For example, as illustrated in FIG. 19, power supply voltage to be supplied to the four toner circuit boards 24 can be outputted through one main body-side voltage terminal 431*a*. Further, as illustrated in FIG. 19, ground voltage to be supplied to the four toner circuit boards 24 can be outputted through one main body-side ground terminal 431*b*. Further, as illustrated in FIG. 19, a clock signal to be supplied to the four toner circuit boards 24 can be outputted through one main body-side clock terminal 431*c*. Accordingly, the number of the terminals 404 can be further reduced.

<4-6. Identification for Source of Abnormality>

In the third embodiment (FIG. 16) described above, when there is no response from the drum memory 351 with respect to the authentication information that the controller 302 transmits to the drum memory 351, it is difficult to determine which one of the drum memory 351 itself and the communication path including the multiplexer 334 is abnormal.

To the contrary, in the present embodiment, the drum memory 451 is directly connected to the main body-side clock terminal 431*c* and the main body-side signal terminal 431*d* without interposing the multiplexer 434. That is, the main body-side clock relay line 4331*c* electrically connects the main body-side clock terminal 431*c* to the multiplexer 434, and electrically connects the main body-side clock terminal 431*c* to the drum memory 451. Further, the main body-side signal relay line 4331*d* electrically connects the main body-side signal terminal 431*d* to the multiplexer 434, and electrically connects the main body-side signal terminal 431*d* and the drum memory 451.

With the above configuration, when the controller 402 transmits the authentication information to the drum memory 451 and does not have any response thereto, the source of abnormality can be easily identified. FIG. 20 is a flowchart illustrating a process for identifying the abnormality executed after transmitting the authentication information from the controller 402 to the drum memory 451.

After transmitting the authentication information to the drum memory 451 in S14 of FIG. 8 described above, in S601 the processor 105 of the controller 402 determines whether or not there is a response from the drum memory 451.

When the processor 105 receives a response from the drum memory 451 (S601: YES), subsequently in S602 the processor 105 determines whether or not there is a response from the multiplexer 434.

When the processor 105 receives a response from the multiplexer 434 (S602: YES), both the drum memory 451 and the multiplexer 434 are normal (S603). In this case, the processor 105 executes the process subsequent to S17 of FIG. 8.

On the other hand, when the processor 105 does not receive a response from the multiplexer 434 (S602: NO), the drum memory 451 is normal, while the multiplexer 434 is abnormal. In this case, in S604 the processor 105 outputs an error. Specifically, for example, the processor 105 retrieves drum communication path error message information stored in the main body memory 106. Then, the processor 105 displays an error message on the display 103 based on the retrieved drum communication path error message information.

When the processor 105 does not receive a response from the drum memory 451 (S601: NO), in S605 the processor 105 determines whether or not there is a response from the multiplexer 434.

When there is a response from the multiplexer 434 (S605: YES), the drum memory 451 is abnormal, while the multiplexer 434 is normal. In this case, in S606 the processor 105 outputs an error. Specifically, for example, the processor 105 retrieves drum memory error message information stored in the main body memory 106. Then, the processor 105 displays an error message on the display 103 on a basis of the retrieved drum memory error message information.

On the other hand, when there is no response from the multiplexer 434 (S605: NO), the processor 105 determines that both the drum memory 451 and the multiplexer 434 are abnormal or that the drum cartridge 1 is not attached to the main casing 101 of the image forming apparatus 100. In this case, in S607 the processor 105 outputs an error. Since there is little possibility that the drum memory 451 and the multiplexer 434 are simultaneously broken down, in S607 the processor 105 retrieves, for example, drum cartridge attachment error message information stored in the main body memory 106. Subsequently, the processor 105 displays an error message on the display 103 based on the retrieved drum cartridge attachment error message information.

5. Fifth Embodiment

Figure 21:
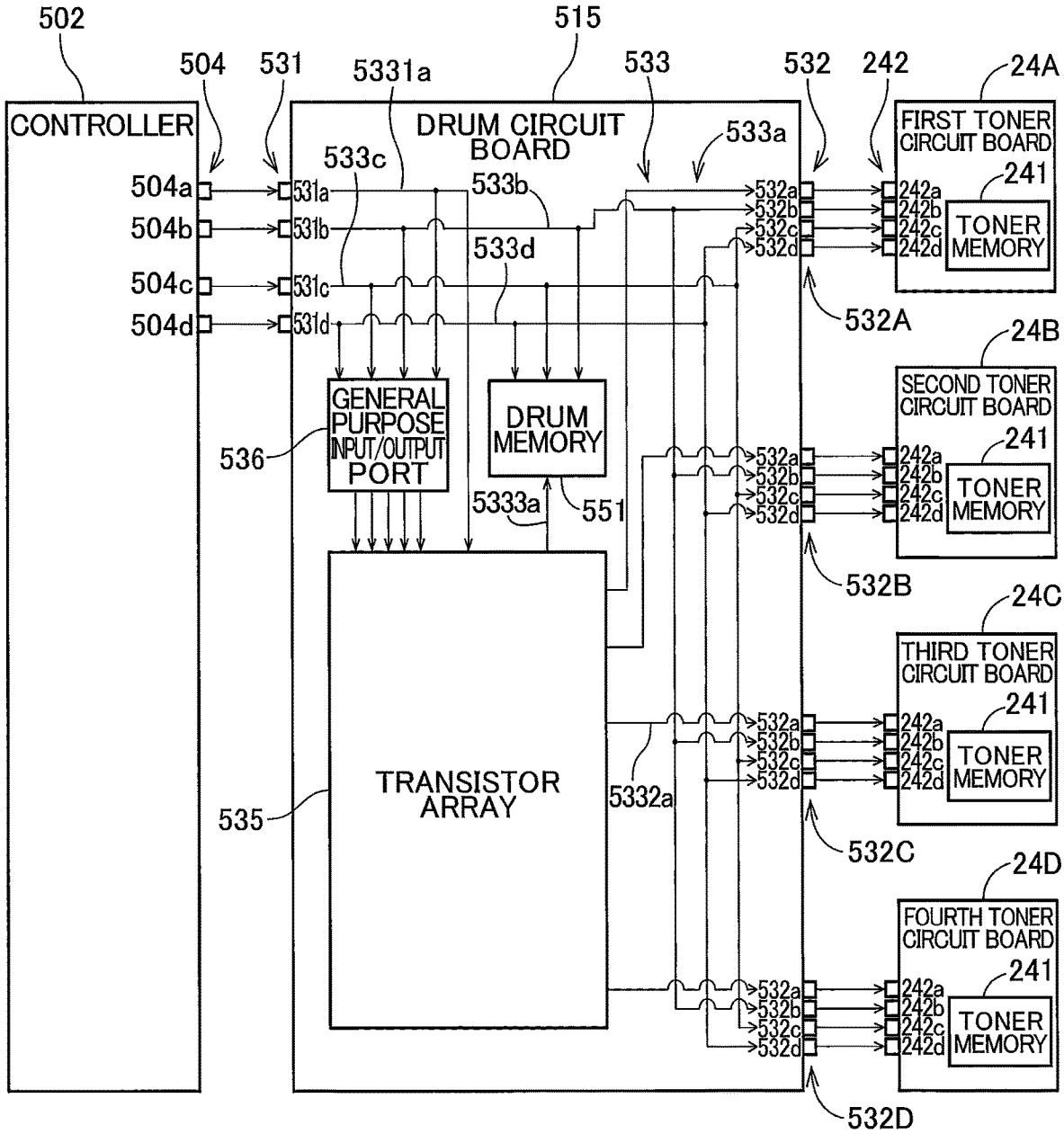
FIG. 21 is a block diagram illustrating electrical connection among a controller, a drum circuit board, and four toner circuit boards in an image forming apparatus according to a fifth embodiment.

A fifth embodiment of the present disclosure will be described with reference to FIG. 21, wherein like parts and components are designated by the same reference numerals as those illustrated in the first embodiment through fourth embodiment. FIG. 21 is a block diagram illustrating electrical connection among a controller 502, a drum circuit board 515, and the four toner circuit boards 24 according to the fifth embodiment.

In the example of FIG. 21, the drum cartridge 1 includes the drum circuit board 515, a drum memory 551, a transistor array 535, and a general purpose input/output port 536. The drum circuit board 515 includes a plurality of main body-side terminals 531, a plurality of toner-side terminals 532, and a plurality of relay lines 533. The drum memory 551, the transistor array 535, and the general purpose input/output port 536 are positioned on the drum circuit board 515. However, the drum memory 551 need not be positioned on the drum circuit board 515. Specifically, the drum memory 551 may be positioned on the surface of the frame 12.

<5-1. Main Body-Side Terminals>

Each of the main body-side terminals 531 are electrically connected to corresponding one of terminals 504 of the controller 502 through the first electrical terminal 13 in a state where the drum cartridge 1 is attached to the main casing 101 of the image forming apparatus 100. As a result, the drum circuit board 515 and the controller 502 are electrically connected to each other.

As illustrated in FIG. 21, the number of the main body-side terminals 531 in the present embodiment is plural, more specifically, four. More specifically, the main body-side terminals 531 include one main body-side voltage terminal 531*a*, one main body-side ground terminal 531*b*, one main body-side clock terminal 531*c*, and one main body-side signal terminal 531*d*.

The main body-side voltage terminal 531*a* is electrically connected to a voltage terminal 504*a* of the terminals 504 of the controller 502 in a state where the drum cartridge 1 is attached to the main casing 101 of the image forming apparatus 100. With this configuration, power supply voltage is supplied from the controller 502 to the drum circuit board 515.

The main body-side ground terminal 531*b* is electrically connected to a ground terminal 504*b* of the terminals 504 of the controller 502 in a state where the drum cartridge 1 is attached to the main casing 101 of the image forming apparatus 100. This configuration allows ground voltage to be supplied from the controller 502 to the drum circuit board 515.

The main body-side clock terminal 531*c* is electrically connected to a clock terminal 504*c* of the terminals 504 of the controller 502 in a state where the drum cartridge 1 is attached to the main casing 101 of the image forming apparatus 100. Accordingly, a clock signal is supplied from the controller 502 to the drum circuit board 515 at constant time intervals.

The main body-side signal terminal 531*d* is electrically connected to a signal terminal 504*d* of the terminals 504 of the controller 502 in a state where the drum cartridge 1 is attached to the main casing 101 of the image forming apparatus 100. This allows a signal indicating various information to be exchanged between the controller 502 and the drum circuit board 515.

<5-2. Toner-Side Terminals>

Each of the toner-side terminals 532 are electrically connected to the corresponding toner circuit board 24 of the toner cartridges 2 through the corresponding second electrical terminal 14 in a state where the four toner cartridges 2 are attached to the frame 12 of the drum cartridge 1. Accordingly, the drum circuit board 515 is electrically connected to the toner circuit boards 24. As illustrated in FIG. 21, in the present embodiment, the number of the toner-side terminals 532 is plural, i.e., sixteen (16) in total.

The sixteen toner-side terminals 532 include a first group 532A having four toner-side terminals 532, a second group 532B having four toner-side terminals 532, a third group 532C having four toner-side terminals 532, and a fourth group 532D having four toner-side terminals 532.

The four toner-side terminals 532 of the first group 532A are electrically connected to the first toner circuit board 24A in a state where the first toner cartridge 2A is attached to the frame 12 of the drum cartridge 1. The four toner-side terminals 532 of the second group 532B are electrically connected to the second toner circuit board 24B in a state where the second toner cartridge 2B is attached to the frame 12 of the drum cartridge 1. The four toner-side terminals 532 of the third group 532C are electrically connected to the third toner circuit board 24C in a state where the third toner cartridge 2C is attached to the frame 12 of the drum cartridge 1. The four toner-side terminals 532 of the fourth group 532D are electrically connected to the fourth toner circuit board 24D in a state where the fourth toner cartridge 2D is attached to the frame 12 of the drum cartridge 1.

The toner-side terminals 532 of each of the first group 532A through the fourth group 532D include one toner-side voltage terminal 532*a*, one toner-side ground terminal 532*b*, one toner-side clock terminal 532*c*, and one toner-side signal terminal 532*d*.

The toner-side voltage terminal 532*a* for each of the first group 532A through the fourth group 532D is electrically connected to the transistor array 535 through corresponding voltage relay line 533*a* (described later). Further, in a state where each toner cartridge 2 is attached to the frame 12 of the drum cartridge 1, each of the toner-side voltage terminals 532*a* is electrically connected to the corresponding voltage terminal 242*a* of the toner circuit boards 24.

The toner-side ground terminal 532*b* for each of the first group 532A through the fourth group 532D is electrically connected to the main body-side ground terminal 531*b* through a ground relay line 533*b* (described later). Further, in a state where each toner cartridge 2 is attached to the frame 12 of the drum cartridge 1, each of the toner-side ground terminals 532*b* is electrically connected to the corresponding one of the ground terminals 242*b* of the toner circuit boards 24. As a result, ground voltage is supplied from the controller 502 to each of the toner circuit boards 24 through the drum circuit board 515.

The toner-side clock terminal 532*c* for each of the first group 532A through the fourth group 532D is electrically connected to the main body-side clock terminal 531*c* through a clock relay line 533*c* (described later). Further, in a state where each toner cartridge 2 is attached to the frame 12 of the drum cartridge 1, each of the toner-side clock terminals 532*c* is electrically connected to the corresponding clock terminal 242*c* of the toner circuit boards 24. Accordingly, a clock signal is supplied from the controller 502 to each of the toner circuit boards 24 through the drum circuit board 515 at constant time intervals.

The toner-side signal terminal 532*d* for each of the first group 532A through the fourth group 532D is electrically connected to the main body-side signal terminal 531*d* through a signal relay line 533*d* (described later). Further, in a state where each toner cartridge 2 is attached to the frame 12 of the drum cartridge 1, each of the toner-side signal terminals 532*d* is electrically connected to the corresponding one of the signal terminals 242*d* of the toner circuit boards 24. This allows a signal indicating various information to be exchanged between the controller 502 and the drum circuit board 515.

<5-3. Relay Lines>

As illustrated in FIG. 21, the relay lines 533 include the voltage relay lines 533*a*, the ground relay line 533*b*, the clock relay line 533*c*, and the signal relay line 533*d*. Specifically, the number of the voltage relay lines 533*a* is plural, the number of the ground relay lines 533*b* is one, the number of the clock relay lines 533*c* is one, and the number of the signal relay lines 533*d* is one.

The voltage relay lines 533*a* include a main body-side voltage relay line 5331*a*, toner-side voltage relay lines

5332*a*, and a drum voltage line 5333*a*. In the present embodiment: the number of the main body-side voltage relay lines 5331*a* is one; the number of the toner-side voltage relay lines 5332*a* is plural (specifically, four); and the number of the drum voltage lines 5333*a* is one.

The main body-side voltage relay line 5331*a* has one end portion electrically connected to the main body-side voltage terminal 531*a*, and another end portion divided into two end portions. Specifically, the other end portion of the main body-side voltage relay line 5331*a* includes a first end portion and a second end portion. The first end portion of the main body-side voltage relay line 5331*a* is electrically connected to the transistor array 535. The second end portion of the main body-side voltage relay line 5331*a* is electrically connected to the general purpose input/output port 536.

Each of the toner-side voltage relay lines 5332*a* electrically connects the transistor array 535 and the corresponding one of the toner-side voltage terminals 532*a*. The drum voltage line 5333*a* electrically connects the transistor array 535 and the drum memory 551.

The ground relay line 533*b* has one end portion electrically connected to the main body-side ground terminal 531*b*, and another end portion divided into six lines. Specifically, the other end portion of the ground relay line 533*b* includes a first end portion, a second end portion, a third end portion, a fourth end portion, a fifth end portion, and a sixth end portion.

The first end portion of the ground relay line 533*b* is electrically connected to the toner-side ground terminal 532*b* of the first group 532A. The second end portion of the ground relay line 533*b* is electrically connected to the toner-side ground terminal 532*b* of the second group 532B. The third end portion of the ground relay line 533*b* is electrically connected to the toner-side ground terminal 532*b* of the third group 532C. The fourth end portion of the ground relay line 533*b* is electrically connected to the toner-side ground terminal 532*b* of the fourth group 532D. The fifth end portion of the ground relay line 533*b* is electrically connected to the drum memory 551. The sixth end portion of the ground relay line 533*b* is electrically connected to the general purpose input/output port 536.

Accordingly, in the drum circuit board 515, ground voltage inputted into the main body-side ground terminal 531*b* is supplied to the four toner-side ground terminals 532*b*, the drum memory 551, and the general purpose input/output port 536. In this way, by sharing the main body-side ground terminal 531*b*, the number of the main body-side terminals 531 can be reduced.

The clock relay line 533*c* has one end portion electrically connected to the main body-side clock terminal 531*c*, and another end portion divided into six end portions. More specifically, the other end portion of the clock relay line 533*c* includes a first end portion, a second end portion, a third end portion, a fourth end portion, a fifth end portion, and a sixth end portion.

The first end portion of the clock relay line 533*c* is electrically connected to the toner-side clock terminal 532*c* of the first group 532A. The second end portion of the clock relay line 533*c* is electrically connected to the toner-side clock terminal 532*c* of the second group 532B. The third end portion of the clock relay line 533*c* is electrically connected to the toner-side clock terminal 532*c* of the third group 532C. The fourth end portion of the clock relay line 533*c* is electrically connected to the toner-side clock terminal 532*c* of the fourth group 532D. The fifth end portion of the clock relay line 533*c* is electrically connected to the drum memory 551. The sixth end portion of the clock relay line 533*c* is electrically connected to the general purpose input/output port 536.

Accordingly, in the drum circuit board 515, a clock signal inputted into the main body-side clock terminal 531*c* is supplied to the four toner-side clock terminals 532*c*, the drum memory 551, and the general purpose input/output port 536. Thus, by sharing the main body-side clock terminal 531*c*, the number of the main body-side terminals 531 can be reduced.

The signal relay line 533*d* has one end portion electrically connected to the main body-side signal terminal 531*d*, and another end portion divided into six end portions. Specifically, the other end portion of the signal relay line 533*d* includes a first end portion, a second end portion, a third end portion, a fourth end portion, a fifth end portion, and a sixth end portion.

The first end portion of the signal relay line 533*d* is electrically connected to the toner-side signal terminal 532*d* of the first group 532A. The second end portion of the signal relay line 533*d* is electrically connected to the toner-side signal terminal 532*d* of the second group 532B. The third end portion of the signal relay line 533*d* is electrically connected to the toner-side signal terminal 532*d* of the third group 532C. The fourth end portion of the signal relay line 533*d* is electrically connected to the toner-side signal terminal 532*d* of the fourth group 532D. The fifth end portion of the signal relay line 533*d* is electrically connected to the drum memory 551. The sixth end portion of the signal relay line 533*d* is electrically connected to the general purpose input/output port 536.

Thus, in the drum circuit board 515, a signal inputted through the main body-side signal terminal 531*d* is supplied to the four toner-side signal terminals 532*d*, the drum memory 551, and the general purpose input/output port 536. Accordingly, by sharing the main body-side signal terminal 531*d*, the number of the main body-side terminals 531 can be reduced.

<5-4. Transistor Array>

The transistor array 535 is a switch circuit for switching connection of voltage lines. The transistor array 535 receives power supply voltage from the controller 502 through the main body-side voltage terminal 531*a*. Further, the transistor array 535 is electrically connected to the general purpose input/output port 536, and receives an address signal from the controller 502 through the main body-side signal terminal 531*d* and the general purpose input/output port 536. The address signal is a signal for designating a communication destination.

The transistor array 535 selects the communication destination among the drum memory 551 and the four toner-side signal terminals 532*d* in accordance with the received address signal. Then, the transistor array 535 supplies power supply voltage to the drum memory 551 or one of the toner-side signal terminals 532*d* (i.e., one of the four toner memories 241) selected as the communication destination.

That is, of the drum memory 551 and the four toner memories 241, the transistor array 535 supplies the power supply voltage only to the drum memory 551 or the toner memory 241 selected as the communication destination. Each of the drum memory 551 and the four toner memories 241 receives a data signal only when the power supply voltage is supplied thereto.

Thus, the controller 502 can transmit a required data signal to a desired communication destination selected from the drum memory 551 and the four toner memories 241. That is, there is no need to provide the main body-side signal terminal 531*d* for each of the four toner-side signal terminals 532*d* and the drum memory 551. Thus, the number of the main body-side signal terminals 531*d* can be reduced. Further, the number of the signal terminals 504*d* of the controller 502 can also be reduced.

Particularly, the drum circuit board 515 according to the present embodiment receives an address signal and a data signal through one main body-side signal terminal 531*d*. This allows reduction in the number of the main body-side signal terminals 531*d*. Further, the number of the signal terminals 504*d* of the controller 502 can also be further reduced.

Specifically, while five main body-side signal terminals 31*d* are required in the example of FIG. 6 of the first embodiment, only one main body-side signal terminal 531*d* is required in the example of FIG. 21 of the present embodiment. Further, while five signal terminals 104*d* of the controller 102 are required in the first embodiment, one signal terminal 504*d* is sufficient in the present embodiment.

<5-5. Relay of Information by Drum Circuit Board>

Also in the present embodiment, the controller 502 and each of the toner circuit boards 24 are connected to each other through the drum circuit board 515. Thus, the number of the terminals can be reduced in comparison with a case where each of the drum circuit board 515 and the toner circuit boards 24 are directly connected to the controller 502.

For example, as illustrated in FIG. 21, power supply voltage to be supplied to the drum memory 551 of the drum circuit board 515 and the toner memories 241 of the toner circuit boards 24 can be outputted through one main body-side voltage terminal 531*a*. Further, as illustrated in FIG. 21, ground voltage to be supplied to the drum memory 551 of the drum circuit board 515 and the toner memories 241 of the toner circuit boards 24 can be outputted through one main body-side ground terminal 531*b*. Further, as illustrated in FIG. 21, a clock signal to be supplied to the drum memory 551 of the drum circuit board 515 and the toner memories 241 of the toner circuit boards 24 can be outputted through one main body-side clock terminal 531*c*. This allows reduction in the number of the terminals 504 of the controller 502.

In particular, when the plurality of toner circuit boards 24 is provided as in the present embodiment, the number of the terminals can be further reduced by connecting the controller 502 and the plurality of the toner circuit boards 24 through the drum circuit board 515. For example, as illustrated in FIG. 21, power supply voltage to be supplied to the four toner circuit boards 24 can be outputted through one main body-side voltage terminal 531*a*. Further, as illustrated in FIG. 21, ground voltage to be supplied to the four toner circuit boards 24 can be outputted through one main body-side ground terminal 531*b*. Further, as illustrated in FIG. 21, a clock signal to be supplied to the four toner circuit boards 24 can be outputted through one main body-side clock terminal 531*c*. Accordingly, the number of the terminals 504 can be further reduced.

6. Sixth Embodiment

Figure 22:
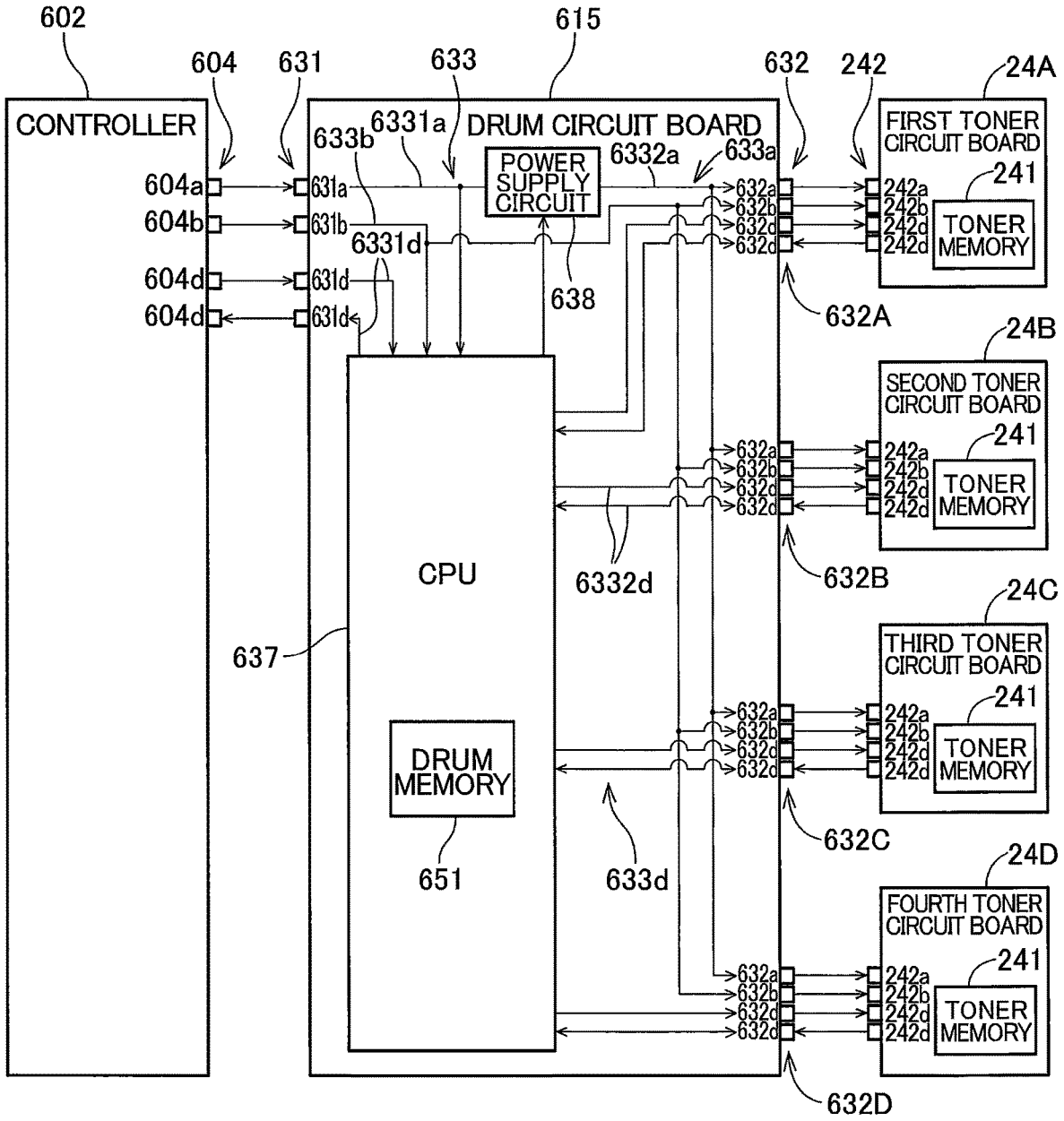
FIG. 22 is a block diagram illustrating electrical connection among a controller, a drum circuit board, and four toner circuit boards in an image forming apparatus according to a sixth embodiment.

A sixth embodiment of the present disclosure will be described with reference to FIG. 22, wherein like parts and components are designated by the same reference numerals as those illustrated in the first embodiment through fifth embodiment. FIG. 22 is a block diagram illustrating electrical connection among the controller 602, a drum circuit board 615, and the four toner circuit boards 24 according to the sixth embodiment.

In the embodiment of FIG. 22, the drum cartridge 1 includes the drum circuit board 615, a CPU 637, a drum memory 651, and a power supply circuit 638. The drum circuit board 615 includes a plurality of main body-side terminals 631, a plurality of toner-side terminals 632, and a plurality of relay lines 633. The CPU 637 are positioned on the drum circuit board 615.

<6-1. Main Body-Side Terminals>

Each of the main body-side terminals 631 is electrically connected to corresponding one of terminals 604 of the controller 602 through the first electrical terminal 13 in a state where the drum cartridge 1 is attached to the main casing 101 of the image forming apparatus 100. As a result, the drum circuit board 615 and the controller 602 are electrically connected to each other.

As illustrated in FIG. 22, the number of the main body-side terminals 631 according to the present embodiment is plural, that is, four. More specifically, the main body-side terminals 631 include one main body-side voltage terminal 631*a*, one main body-side ground terminal 631*b*, and two main body-side signal terminals 631*d*.

The main body-side voltage terminal 631*a* is electrically connected to a voltage terminal 604*a* of the terminals 604 of the controller 602 in a state where the drum cartridge 1 is attached to the main casing 101 of the image forming apparatus 100. With this configuration, power supply voltage is supplied from the controller 602 to the drum circuit board 615.

The main body-side ground terminal 631*b* is electrically connected to a ground terminal 604*b* of the terminals 604 of the controller 602 in a state where the drum cartridge 1 is attached to the main casing 101 of the image forming apparatus 100. This configuration allows ground voltage to be supplied from the controller 602 to the drum circuit board 615.

Each of the two main body-side signal terminals 631*d* is electrically connected to corresponding one of signal terminals 604*d* of the terminals 604 of the controller 602 in a state where the drum cartridge 1 is attached to the main casing 101 of the image forming apparatus 100. This allows a signal indicating various information to be exchanged between the controller 602 and the drum circuit board 615.

One of the two main body-side signal terminals 631*d* is a transmission terminal. The remaining one of the two main body-side signal terminals 631*d* is a reception terminal. In the present embodiment, information is transmitted and received between the controller 602 and the drum circuit board 615 using start-stop synchronous type serial communication. Thus, a main body-side clock terminal into which a clock signal is inputted is not provided in the present embodiment. Accordingly, the number of the main body-side terminals 631 can be further reduced.

<6-2. Toner-Side Terminals>

Each of the toner-side terminals 632 are electrically connected to the corresponding toner circuit board 24 of the toner cartridges 2 through the corresponding second electrical terminal 14 in a state where the four toner cartridges 2 are attached to the frame 12 of the drum cartridge 1. Accordingly, the drum circuit board 615 is electrically connected to each of the toner circuit boards 24. As illustrated in FIG. 22, in the present embodiment, the number of the toner-side terminals 632 is plural, i.e., sixteen (16) in total.

The sixteen toner-side terminals 632 include a first group 632A having four toner-side terminals 632, a second group 632B having four toner-side terminals 632, a third group 632C having four toner-side terminals 632, and a fourth group 632D having four toner-side terminals 632.

The four toner-side terminals 632 of the first group 632A are electrically connected to the first toner circuit board 24A in a state where the first toner cartridge 2A is attached to the frame 12 of the drum cartridge 1. The four toner-side terminals 632 of the second group 632B are electrically connected to the second toner circuit board 24B in a state where the second toner cartridge 2B is attached to the frame 12 of the drum cartridge 1. The four toner-side terminals 632 of the third group 632C are electrically connected to the third toner circuit board 24C in a state where the third toner cartridge 2C is attached to the frame 12 of the drum cartridge 1. The four toner-side terminals 632 of the fourth group 632D are electrically connected to the fourth toner circuit board 24D in a state where the fourth toner cartridge 2D is attached to the frame 12 of the drum cartridge 1.

The toner-side terminals 632 of each of the first group 632A through the fourth group 632D include one toner-side voltage terminal 632*a*, one toner-side ground terminal 632*b*, and two toner-side signal terminals 632*d*.

The toner-side voltage terminal 632*a* for each of the first group 632A through the fourth group 632D is electrically connected to the main body-side voltage terminal 631*a* through voltage relay lines 633*a* (described later), the CPU 637, and the power supply circuit 638. Further, in a state where the toner cartridges 2 are attached to the frame 12 of the drum cartridge 1, each of the toner-side voltage terminals 632*a* is electrically connected to the corresponding voltage terminal 242*a* of the toner circuit boards 24. With this configuration, power supply voltage is supplied from the controller 602 to each of the toner circuit boards 24 through the drum circuit board 615.

The toner-side ground terminal 632*b* for each of the first group 632A through the fourth group 632D is electrically connected to the main body-side ground terminal 631*b* through a ground relay line 633*b* (described later). Further, in a state where the toner cartridges 2 are attached to the frame 12 of the drum cartridge 1, each of the toner-side ground terminals 632*b* is electrically connected to the corresponding ground terminal 242*b* of the toner circuit boards 24. As a result, ground voltage is supplied from the controller 602 to each of the toner circuit boards 24 through the drum circuit board 615.

The toner-side signal terminals 632*d* for each of the first group 632A through the fourth group 632D are electrically connected to the CPU 637 through corresponding signal relay lines 633*d* (described later). Further, in a state where the toner cartridges 2 are attached to the frame 12 of the drum cartridge 1, each of the toner-side signal terminals 632*d* is electrically connected to the corresponding signal terminal 242*d* of the toner circuit boards 24.

One of the two toner-side signal terminals 632*d* of each of the first group 632A through the fourth group 632D is a transmission terminal. The remaining one of the two toner-side signal terminals 632*d* of each of the first group 632A through the fourth group 632D is a reception terminal. As described above, in the present embodiment, information is transmitted and received between the controller 602 and the drum circuit board 615 using start-stop synchronous type serial communication. Therefore, a toner-side clock terminal for outputting a clock signal is not provided in the present embodiment.

<6-3. Relay Lines>

As illustrated in FIG. 22, the relay lines 633 according to the sixth embodiment include the voltage relay lines 633*a*, the ground relay line 633*b*, and the signal relay lines 633*d*. More specifically, the number of the voltage relay lines 633*a* is plural, the number of the ground relay lines 633*b* is one, and the number of the signal relay lines 633*d* is plural.

The voltage relay lines 633*a* include a main body-side voltage relay line 6331*a* and a toner-side voltage relay line 6332*a*. In the present embodiment, the number of the main body-side voltage relay lines 6331*a* is one, and the number of the toner-side voltage relay lines 6332*a* is one. The main body-side voltage relay line 6331*a* has one end portion electrically connected to the main body-side voltage terminal 631*a*, and another end portion divided into two end portions. More specifically, the other end portion of the main body-side voltage relay line 6331*a* includes a first end portion and a second end portion.

The first end portion of the main body-side voltage relay line 6331*a* is electrically connected to the CPU 637, while the second end portion of the main body-side voltage relay line 6331*a* is electrically connected to the power supply circuit 638. Accordingly, power supply voltage inputted into the main body-side voltage terminal 631*a* is supplied to the CPU 637 and the power supply circuit 638 in the drum circuit board 615.

The CPU 637 and the power supply circuit 638 are electrically connected to each other. Further, the toner-side voltage relay line 6332*a* has one end portion electrically connected to the power supply circuit 638, and another end portion divided into four end portions. More specifically, the other end portion of the toner-side voltage relay line 6332*a* is divided into a first end portion, a second end portion, a third end portion, and a fourth end portion.

The first end portion of the toner-side voltage relay line 6332*a* is electrically connected to the toner-side voltage terminal 632*a* of the first group 632A. The second end portion of the toner-side voltage relay line 6332*a* is electrically connected to the toner-side voltage terminal 632*a* of the second group 632B. The third end portion of the toner-side voltage relay line 6332*a* is electrically connected to the toner-side voltage terminal 632*a* of the third group 632C. The fourth end portion of the toner-side voltage relay line 6332*a* is electrically connected to the toner-side voltage terminal 632*a* of the fourth group 632D. Therefore, in the drum circuit board 615, the power supply voltage outputted from the power supply circuit 638 is supplied to the four toner-side voltage terminals 632*a*.

The ground relay line 633*b* has one end portion electrically connected to the main body-side ground terminal 631*b*, and another end portion divided into five end portions. Specifically, the other end portion of the ground relay line 633*b* has a first end portion, a second end portion, a third end portion, a fourth end portion, and a fifth end portion.

The first end portion of the ground relay line 633*b* is electrically connected to the toner-side ground terminal 632*b* of the first group 632A. The second end portion of the ground relay line 633*b* is electrically connected to the toner-side ground terminal 632*b* of the second group 632B. The third end portion of the ground relay line 633*b* is electrically connected to the toner-side ground terminal 632*b* of the third group 632C. The fourth end portion of the ground relay line 633*b* is electrically connected to the toner-side ground terminal 632*b* of the fourth group 632D. The fifth end portion of the ground relay line 633*b* is electrically connected to the CPU 637.

Accordingly, in the drum circuit board 615, ground voltage inputted into the main body-side ground terminal 631*b* is supplied to the four toner-side ground terminals 632*b* and the CPU 637. In this way, by sharing the main body-side ground terminal 631*b*, the number of the main body-side terminals 631 can be reduced.

The signal relay lines 633*d* include main body-side signal relay lines 6331*d* and toner-side signal relay lines 6332*d*. The number of the main body-side signal relay lines 6331*d* in the present embodiment is plural, specifically, two. The number of the toner-side signal relay lines 6332*d* is plural, specifically, eight.

Each of the main body-side signal relay lines 6331*d* has one end portion electrically connected to the corresponding main body-side signal terminal 631*d*, and another end portion electrically connected to the CPU 637. Each of the toner-side signal relay lines 6332*d* has one end portion electrically connected to the CPU 637, and another end portion electrically connected to the corresponding one of the toner-side signal terminals 632*d*.

<6-4. CPU>

The CPU (Central Processing Unit) 637 is a processor for switching connection of signal lines in accordance with programs. In the present embodiment, the CPU 637 and the drum memory 651 are integrated as a single chip. However, the CPU 637 and the drum memory 651 may be separately formed. The drum memory 651 stores therein programs that can be read by the CPU 637. The programs may previously be stored in the drum memory 651 before shipping the drum cartridge 1. Alternatively, the programs may be previously stored in the main body memory 106 of the image forming apparatus 100. In this case, when the image forming apparatus 100 is powered, the programs may be retrieved from the main body memory 106 and stored in the drum memory 651.

The CPU 637 receives a data signal from the controller 602 through the main body-side signal terminal 631*d*. The data signal is a signal indicating various information to be transmitted to a communication destination. The CPU 637 selects the communication destination among one of the drum memory 651 and the four toner-side signal terminals 632*d* in accordance with programs acquired from the drum memory 651. Further, the CPU 637 outputs the received data signal to the drum memory 651 or one of the toner-side signal terminals 632*d* (i.e., one of the toner memories 241) selected as the communication destination.

By employing the CPU 637 as in the present embodiment, the communication destination of the data signal can be selected among the drum memory 651 and the four toner memories 241 and the data signal can be transmitted to the selected communication destination. Accordingly, it is not necessary to provide the main body-side signal terminal 631*d* individually for all of the drum memory 651 and the four toner-side signal terminals 632*d*. Thus, the number of the main body-side signal terminals 631*d* can be reduced. Further, the number of the signal terminals 604*d* of the controller 602 can be also reduced.

Specifically, while five main body-side signal terminals 31*d* are required in the example of FIG. 6 of the first embodiment, two main body-side signal terminals 631*d* are sufficient in the example of FIG. 22 of the present embodiment. Further, while five signal terminals 104*d* of the controller 102 are required in the first embodiment, two signal terminals 604*d* are sufficient in the present embodiment.

<6-5. Relay of Information by Drum Circuit Board>

Also in the present embodiment, the controller 602 and each of the toner circuit boards 24 are connected to each other through the drum circuit board 615. Thus, the number of the terminals can be reduced in comparison with a case where each of the drum circuit board 615 and each of the toner circuit boards 24 are directly connected to the controller 602.

For example, as illustrated in FIG. 22, power supply voltage to be supplied to the drum memory 651 of the drum circuit board 615 and the toner memories 241 of the toner circuit boards 24 can be outputted through one main body-side voltage terminal 631*a*. Further, as illustrated in FIG. 22, ground voltage to be supplied to the drum memory 651 of the drum circuit board 615 and the toner memories 241 of the toner circuit boards 24 can be outputted through one main body-side ground terminal 631*b*.

In particular, when the plurality of toner circuit boards 24 is provided as in the present embodiment, the number of the terminals can be further reduced by connecting the controller 602 and the plurality of the toner circuit boards 24 through the drum circuit board 615. For example, as illustrated in FIG. 22, power supply voltage to be supplied to the four toner circuit boards 24 can be outputted through one main body-side voltage terminal 631*a*. Further, as illustrated in FIG. 22, ground voltage to be supplied to the four toner circuit boards 24 can be outputted through one main body-side ground terminal 631*b*.

7. Seventh Embodiment

Figure 23:
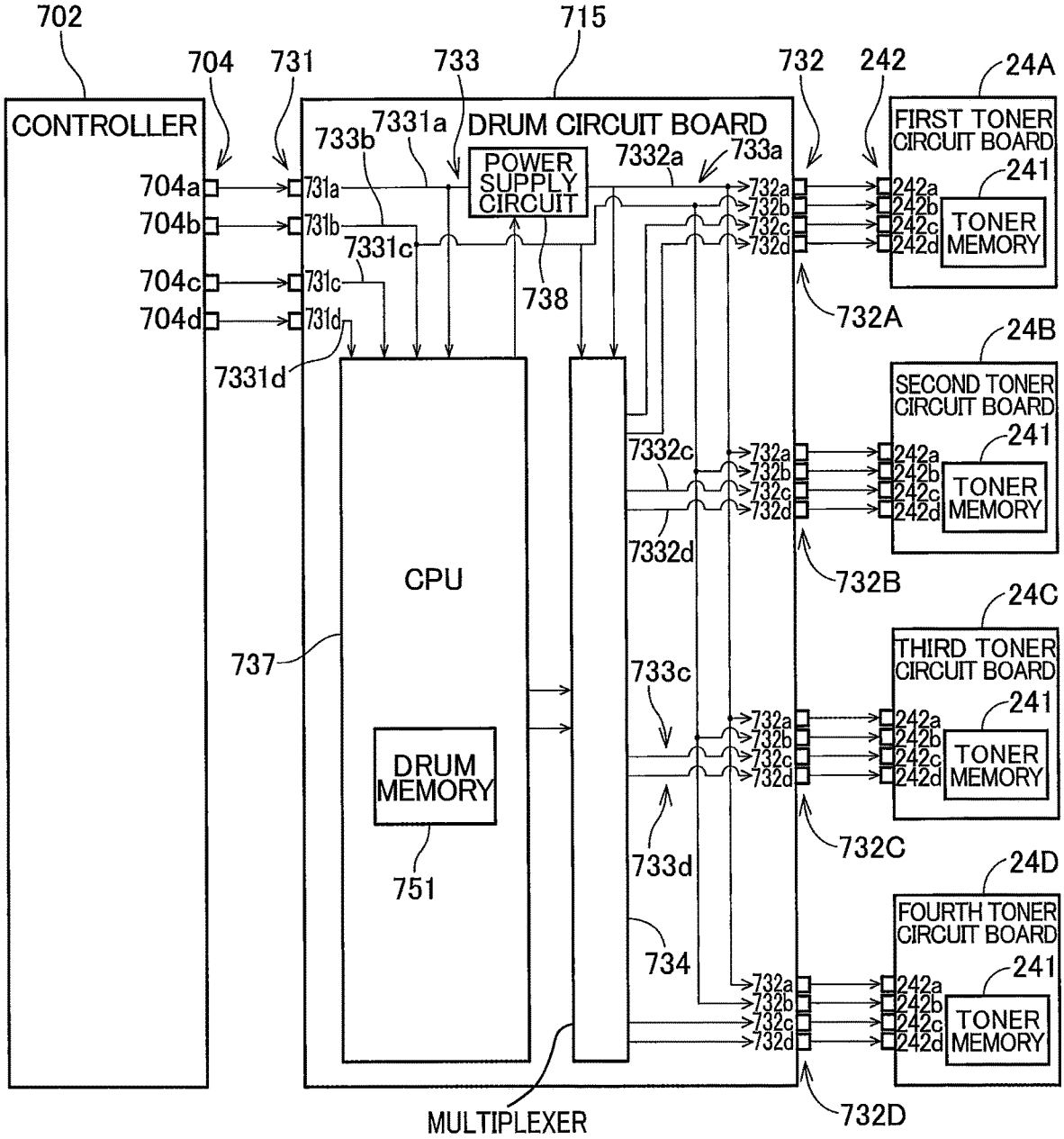
FIG. 23 is a block diagram illustrating electrical connection among a controller, a drum circuit board, and four toner circuit boards in an image forming apparatus according to a seventh embodiment.

A seventh embodiment of the present disclosure will be described with reference to FIG. 23, wherein like parts and components are designated by the same reference numerals as those illustrated in the first embodiment through sixth embodiment. FIG. 23 is a block diagram illustrating electrical connection among the controller 702, a drum circuit board 715, and the four toner circuit boards 24 according to the seventh embodiment.

In the embodiment of FIG. 23, the drum cartridge 1 includes the drum circuit board 715, a multiplexer 734, a CPU 737, a drum memory 751, and a power supply circuit 738. The drum circuit board 715 includes a plurality of main body-side terminals 731, a plurality of toner-side terminals 732, and a plurality of relay lines 733. The multiplexer 734 and the CPU 737 are positioned on the drum circuit board 715.

<7-1. Main Body-Side Terminals>

Each of the main body-side terminals 731 is electrically connected to corresponding one of terminals 704 of the controller 702 through the first electrical terminal 13 in a state where the drum cartridge 1 is attached to the main casing 101 of the image forming apparatus 100. As a result, the drum circuit board 715 and the controller 702 are electrically connected to each other.

As illustrated in FIG. 23, the number of the main body-side terminals 731 in the present embodiment is plural, that is, four. More specifically, the main body-side terminals 731 include one main body-side voltage terminal 731*a*, one main body-side ground terminal 731*b*, one main body-side clock terminal 731*c*, and one main body-side signal terminal 731*d*.

The main body-side voltage terminal 731*a* is electrically connected to a voltage terminal 704*a* of the terminals 704 of the controller 702 in a state where the drum cartridge 1 is attached to the main casing 101 of the image forming apparatus 100. With this configuration, power supply voltage is supplied from the controller 702 to the drum circuit board 715.

The main body-side ground terminal 731*b* is electrically connected to a ground terminal 704*b* of the terminals 704 of the controller 702 in a state where the drum cartridge 1 is attached to the main casing 101 of the image forming apparatus 100. This configuration allows ground voltage to be supplied from the controller 702 to the drum circuit board 715.

The main body-side clock terminal 731*c* is electrically connected to a clock terminal 704*c* of the terminals 704 of the controller 702 in a state where the drum cartridge 1 is attached to the main casing 101 of the image forming apparatus 100. Accordingly, a clock signal is supplied from the controller 702 to the drum circuit board 715 at constant time intervals.

The main body-side signal terminal 731*d* is electrically connected to a signal terminal 704*d* of the terminals 704 of the controller 702 in a state where the drum cartridge 1 is attached to the main casing 101 of the image forming apparatus 100. This allows a signal indicating various information to be exchanged between the controller 702 and the drum circuit board 715.

<7-2. Toner-Side Terminals>

Each of the toner-side terminals 732 is electrically connected to the corresponding toner circuit board 24 of the toner cartridges 2 through the corresponding second electrical terminal 14 in a state where the four toner cartridges 2 are attached to the frame 12 of the drum cartridge 1. Accordingly, the drum circuit board 715 is electrically connected to each of the toner circuit boards 24. As illustrated in FIG. 23, in the present embodiment, the number of the toner-side terminals 732 is plural, i.e., sixteen (16) in total.

The sixteen toner-side terminals 732 include a first group 732A having four toner-side terminals 732, a second group 732B having four toner-side terminals 732, a third group 732C having four toner-side terminals 732, and a fourth group 732D having four toner-side terminals 732.

The four toner-side terminals 732 of the first group 732A are electrically connected to the first toner circuit board 24A in a state where the first toner cartridge 2A is attached to the frame 12 of the drum cartridge 1. The four toner-side terminals 732 of the second group 732B are electrically connected to the second toner circuit board 24B in a state where the second toner cartridge 2B is attached to the frame 12 of the drum cartridge 1. The four toner-side terminals 732 of the third group 732C are electrically connected to the third toner circuit board 24C in a state where the third toner cartridge 2C is attached to the frame 12 of the drum cartridge 1. The four toner-side terminals 732 of the fourth group 732D are electrically connected to the fourth toner circuit board 24D in a state where the fourth toner cartridge 2D is attached to the frame 12 of the drum cartridge 1.

The toner-side terminals 732 of each of the first group 732A through the fourth group 732D include one toner-side voltage terminal 732*a*, one toner-side ground terminal 732*b*, one toner-side clock terminal 732*c*, and one toner-side signal terminal 732*d*.

The toner-side voltage terminal 732*a* for each of the first group 732A through the fourth group 732D is electrically connected to the main body-side voltage terminal 731*a* through voltage relay lines 733*a* (described later), the CPU 737, and the power supply circuit 738. Further, in a state where the toner cartridges 2 are attached to the frame 12 of the drum cartridge 1, each of the toner-side voltage terminals 732*a* is electrically connected to the corresponding one of the voltage terminals 242*a* of the toner circuit boards 24. With this configuration, power supply voltage is supplied from the controller 702 to each of the toner circuit boards 24 through the drum circuit board 715.

The toner-side ground terminal 732*b* for each of the first group 732A through the fourth group 732D is electrically connected to the main body-side ground terminal 731*b* through a ground relay line 733*b* (described later). Further, in a state where the toner cartridges 2 are attached to the frame 12 of the drum cartridge 1, each of the toner-side ground terminals 732*b* is electrically connected to the corresponding ground terminal 242*b* of the toner circuit boards 24. As a result, ground voltage is supplied from the controller 702 to each of the toner circuit boards 24 through the drum circuit board 715.

The toner-side clock terminal 732*c* for each of the first group 732A through the fourth group 732D is electrically connected to the multiplexer 734 through a corresponding clock relay line 733*c* (described later). Further, in a state where the toner cartridges 2 are attached to the frame 12 of the drum cartridge 1, each of the toner-side clock terminals 732*c* is electrically connected to the corresponding clock terminal 242*c* of the toner circuit boards 24.

The toner-side signal terminal 732*d* for each of the first group 732A through the fourth group 732D is electrically connected to the multiplexer 734 through a corresponding signal relay line 733*d* (described later). Further, in a state where the toner cartridges 2 are attached to the frame 12 of the drum cartridge 1, each of the toner-side signal terminals 732*d* is electrically connected to the corresponding signal terminal 242*d* of the toner circuit boards 24.

<7-3. Relay Lines>

As illustrated in FIG. 23, the relay lines 733 according to the present embodiment include the voltage relay lines 733*a*, the ground relay line 733*b*, the clock relay lines 733*c*, and the signal relay lines 733*d*. More specifically, the number of the voltage relay lines 733*a* is plural, the number of the ground relay lines 733*b* is one, the number of the clock relay lines 733*c* is plural, and the number of the signal relay lines 733*d* is plural.

The voltage relay lines 733*a* include a main body-side voltage relay line 7331*a* and a toner-side voltage relay line 7332*a*. In the present embodiment, the number of the main body-side voltage relay lines 7331*a* is one, and the number of the toner-side voltage relay lines 7332*a* is one.

The main body-side voltage relay line 7331*a* has one end portion electrically connected to the main body-side voltage terminal 731*a*, and another end portion divided into two end portions. More specifically, the other end portion of the main body-side voltage relay line 7331*a* includes a first end portion and a second end portion. The first end portion of the main body-side voltage relay line 7331*a* is electrically connected to the CPU 737, while the second end portion of the main body-side voltage relay line 7331*a* is electrically connected to the power supply circuit 738. Accordingly, power supply voltage inputted into the main body-side voltage terminal 731*a* is supplied to the CPU 737 and the power supply circuit 738 in the drum circuit board 715.

The CPU 737 and the power supply circuit 738 are electrically connected to each other. Further, the toner-side voltage relay line 7332*a* has one end portion electrically connected to the power supply circuit 738, and another end portion divided into five end portions. More specifically, the other end portion of the toner-side voltage relay line 7332*a* includes a first end portion, a second end portion, a third end portion, a fourth end portion, and a fifth end portion.

The first end portion of the toner-side voltage relay line 7332*a* is electrically connected to the toner-side voltage terminal 732*a* of the first group 732A. The second end portion of the toner-side voltage relay line 7332*a* is electrically connected to the toner-side voltage terminal 732*a* of the second group 732B. The third end portion of the toner-side voltage relay line 7332*a* is electrically connected to the toner-side voltage terminal 732*a* of the third group 732C. The fourth end portion of the toner-side voltage relay line 7332*a* is electrically connected to the toner-side voltage terminal 732*a* of the fourth group 732D. The fifth end portion of the toner-side voltage relay line 7332*a* is electrically connected to the multiplexer 734.

With this configuration, in the drum circuit board 715, the power supply voltage outputted from the power supply circuit 738 is supplied to the four toner-side voltage terminals 732*a* and to the multiplexer 734.

The ground relay line 733*b* has one end portion electrically connected to the main body-side ground terminal 731*b*, and another end portion divided into six lines. Specifically, the other end portion of the ground relay line 733*b* includes a first end portion, a second end portion, a third end portion, a fourth end portion, a fifth end portion, and a sixth end portion.

The first end portion of the ground relay line 733*b* is electrically connected to the toner-side ground terminal 732*b* of the first group 732A. The second end portion of the ground relay line 733*b* is electrically connected to the toner-side ground terminal 732*b* of the second group 732B. The third end portion of the ground relay line 733*b* is electrically connected to the toner-side ground terminal 732*b* of the third group 732C. The fourth end portion of the ground relay line 733*b* is electrically connected to the toner-side ground terminal 732*b* of the fourth group 732D. The fifth end portion of the ground relay line 733*b* is electrically connected to the CPU 737. The sixth end portion of the ground relay line 733*b* is electrically connected to the multiplexer 734.

In this way, in the drum circuit board 715, ground voltage is supplied to the four toner-side ground terminals 732*b*, the CPU 737, and the multiplexer 734 through the through the main body-side ground terminal 731*b*. By sharing the main body-side ground terminal 731*b* in this way, the number of the main body-side terminals 731 can be reduced.

The clock relay lines 733*c* include a main body-side clock relay line 7331*c* and toner-side clock relay lines 7332*c*. In the present embodiment, the number of the main body-side clock relay lines 7331*c* is one, and the number of the toner-side clock relay lines 7332*c* is plural, specifically, four.

The main body-side clock relay line 7331*c* has one end portion electrically connected to the main body-side clock terminal 731*c*, and another end portion electrically connected to the CPU 737. Each of the toner-side clock relay lines 7332*c* has one end portion electrically connected to the multiplexer 734, and another end portion electrically connected to the corresponding one of the toner-side clock terminals 732*c*.

The signal relay lines 733*d* include a main body-side signal relay line 7331*d* and toner-side signal relay lines 7332*d*. In the present embodiment, the number of the main body-side signal relay lines 7331*d* is one, and the number of the toner-side signal relay lines 7332*d* is plural, specifically, four.

The main body-side signal relay line 7331*d* has one end portion electrically connected to the main body-side signal terminal 731*d*, and another end portion electrically connected to the CPU 737. Each of the toner-side signal relay lines 7332*d* has one end portion electrically connected to the multiplexer 734, and another end portion electrically connected to the corresponding one of the toner-side signal terminals 732*d*.

The CPU 737 and the multiplexer 734 are electrically connected to each other.

<7-4. CPU and Multiplexer>

The CPU (Central Processing Unit) 737 is a processor configured to output an address signal in accordance with programs. In the present embodiment, the CPU 737 and the drum memory 751 are integrated as a single chip. However, the CPU 737 and the drum memory 751 may be provided as separate chips. The drum memory 751 stores therein programs which CPU 737 can retrieve. The programs may previously be stored in the drum memory 751 before shipping the drum cartridge 1. Alternatively, the programs may be previously stored in the main body memory 106 of the image forming apparatus 100. In this case, when the image forming apparatus 100 is powered, the programs may be retrieved from the main body memory 106 and stored in the drum memory 751.

The CPU 737 receives a data signal from the controller 702 through the main body-side signal terminal 731*d*. The CPU 737 transmits the received data signal to the multiplexer 734. The data signal is a signal indicating various information to be transmitted to a communication destination. The CPU 737 generates an address signal in accordance with programs retrieved from the drum memory 751, and transmits the generated address signal to the multiplexer 734. The address signal is a signal for designating a communication destination.

The multiplexer 734 is a switch circuit for switching connection of signal lines. The multiplexer 734 receives the address signal from the CPU 737, and selects a communication destination from the four toner-side signal terminals 732*d* (the four toner memories 241) in accordance with the received address signal. That is, the multiplexer 734 is controlled by the CPU 737. Further, the multiplexer 734 receives a data signal from the CPU 737, and then outputs the received data signal to the toner-side signal terminal 732*d* selected as the communication destination.

By employing the CPU 737 and the multiplexer 734 as in the present embodiment, the communication destination of the data signal can be selected from the four toner memories 241, and the data signal can be selectively transmitted to the communication destination (i.e., one of the four toner memories 241). Accordingly, it is unnecessary to provide the main body-side signal terminal 731*d* individually for each of the four toner-side signal terminals 732*d*, thereby enabling reduction in the number of the main body-side signal terminals 731*d*. Further, the number of the signal terminals 704*d* of the controller 702 can be also reduced.

Specifically, while five main body-side signal terminals 31*d* are required in the example of FIG. 6 of the first embodiment, one main body-side signal terminals 731*d* is sufficient in the example of FIG. 23 of the present embodiment. Further, while five signal terminals 104*d* of the controller 102 are required in the first embodiment, one signal terminal 704*d* is sufficient in the present embodiment.

<7-5. Relay of Information by Drum Circuit Board>

Also in the present embodiment, the controller 702 and each of the toner circuit boards 24 are electrically connected to each other through the drum circuit board 715. Thus, the number of the terminals can be reduced in comparison with a case where the drum circuit board 715 and each of the toner circuit boards 24 are directly connected to the controller 702.

For example, as illustrated in FIG. 23, power supply voltage to be supplied to the drum memory 751 of the drum circuit board 715 and the toner memories 241 of the toner circuit boards 24 can be outputted through one main body-side voltage terminal 731*a*. Further, as illustrated in FIG. 23, ground voltage to be supplied to the drum memory 751 of the drum circuit board 715 and the toner memories 241 of the toner circuit boards 24 can be outputted through one main body-side ground terminal 731*b*. Further, as illustrated in FIG. 23, a clock signal to be supplied to the drum memory 751 of the drum circuit board 715 and the toner memories 241 of the toner circuit boards 24 can be outputted through one main body-side clock terminal 731*c*. This allows reduction in the number of the terminals 704 of the controller 702.

In particular, when the plurality of toner circuit boards 24 is provided as in the present embodiment, the number of the terminals can be further reduced by connecting the controller 702 and the plurality of the toner circuit boards 24 through the drum circuit board 715. For example, as illustrated in FIG. 23, power supply voltage to be supplied to the four toner circuit boards 24 can be outputted through one main body-side voltage terminal 731*a*. Further, as illustrated in FIG. 23, ground voltage to be supplied to the four toner circuit boards 24 can be outputted through one main body-side ground terminal 731*b*. Further, as illustrated in FIG. 23, a clock signal to be supplied to the four toner circuit boards 24 can be outputted through one main body-side clock terminal 731*c*. Accordingly, the number of the terminals 704 can be further reduced.

8. Eighth Embodiment

Figure 24:
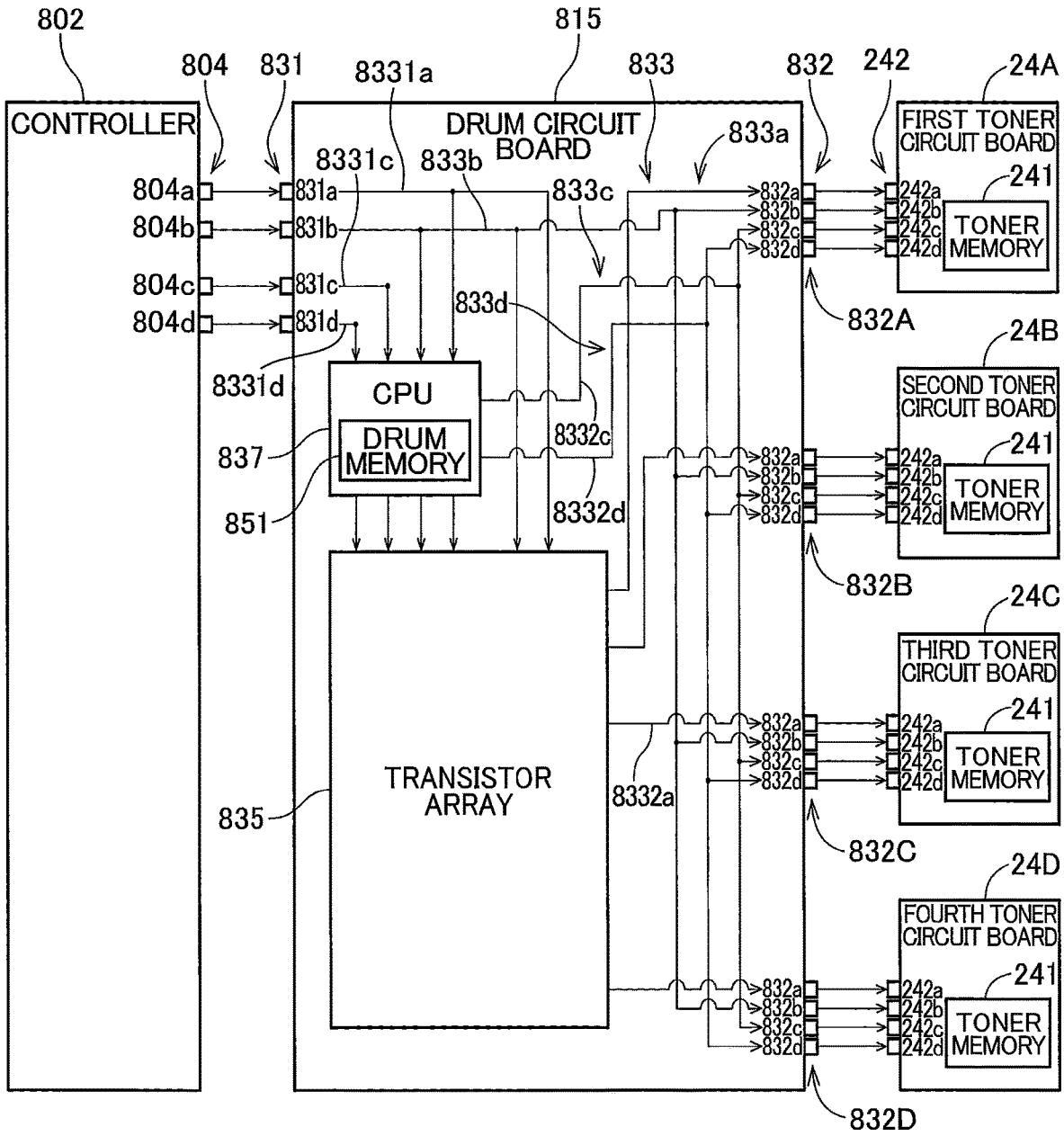
FIG. 24 is a block diagram illustrating electrical connection among a controller, a drum circuit board, and four toner circuit boards in an image forming apparatus according to an eighth embodiment.

An eighth embodiment of the present disclosure will be described with reference to FIG. 24, wherein like parts and components are designated by the same reference numerals as those illustrated in the first embodiment through seventh embodiment. FIG. 24 is a block diagram illustrating electrical connection among the controller 802, a drum circuit board 815, and the four toner circuit boards 24 according to the eighth embodiment.

In the eighth embodiment of FIG. 24, the drum cartridge 1 includes the drum circuit board 815, a drum memory 851, a transistor array 835, and a CPU 837. The drum circuit board 815 includes a plurality of main body-side terminals 831, a plurality of toner-side terminals 832, and a plurality of relay lines 833. The transistor array 835 and the CPU 837 are positioned on the drum circuit board 815.

<8-1. Main Body-Side Terminals>

Each of the main body-side terminals 831 are electrically connected to corresponding one of terminals 804 of the controller 802 through the first electrical terminal 13 in a state where the drum cartridge 1 is attached to the main casing 101 of the image forming apparatus 100. As a result, the drum circuit board 815 and the controller 802 are electrically connected to each other.

As illustrated in FIG. 24, the number of the main body-side terminals 831 in the present embodiment is plural, more specifically, four. More specifically, the main body-side terminals 831 include one main body-side voltage terminal 831*a*, one main body-side ground terminal 831*b*, one main body-side clock terminal 831*c*, and one main body-side signal terminal 831*d*.

The main body-side voltage terminal 831*a* is electrically connected to a voltage terminal 804*a* of the terminals 804 of the controller 802 in a state where the drum cartridge 1 is attached to the main casing 101 of the image forming apparatus 100. With this configuration, power supply voltage is supplied from the controller 802 to the drum circuit board 815.

The main body-side ground terminal 831*b* is electrically connected to a ground terminal 804*b* of the terminals 804 of the controller 802 in a state where the drum cartridge 1 is attached to the main casing 101 of the image forming apparatus 100. This configuration allows ground voltage to be supplied from the controller 802 to the drum circuit board 815.

The main body-side clock terminal 831*c* is electrically connected to a clock terminal 804*c* of the terminals 804 of the controller 802 in a state where the drum cartridge 1 is attached to the main casing 101 of the image forming apparatus 100. Accordingly, a clock signal is supplied from the controller 802 to the drum circuit board 815 at constant time intervals.

The main body-side signal terminal 831*d* is electrically connected to a signal terminal 804*d* of the terminals 804 of the controller 802 in a state where the drum cartridge 1 is attached to the main casing 101 of the image forming apparatus 100. This allows a signal indicating various information to be exchanged between the controller 802 and the drum circuit board 815.

<8-2. Toner-Side Terminals>

Each of the toner-side terminals 832 is electrically connected to the corresponding toner circuit board 24 of the toner cartridges 2 through the corresponding second electrical terminal 14 in a state where the four toner cartridges 2 are attached to the frame 12 of the drum cartridge 1. Accordingly, the drum circuit board 815 is electrically connected to each of the toner circuit boards 24. As illustrated in FIG. 24, in the present embodiment, the number of the toner-side terminals 832 is plural, i.e., sixteen (16) in total.

The sixteen toner-side terminals 832 include a first group 832A having four toner-side terminals 832, a second group 832B having four toner-side terminals 832, a third group 832C having four toner-side terminals 832, and a fourth group 832D having four toner-side terminals 832.

The four toner-side terminals 832 of the first group 832A are electrically connected to the first toner circuit board 24A in a state where the first toner cartridge 2A is attached to the frame 12 of the drum cartridge 1. The four toner-side terminals 832 of the second group 832B are electrically connected to the second toner circuit board 24B in a state where the second toner cartridge 2B is attached to the frame 12 of the drum cartridge 1. The four toner-side terminals 832 of the third group 832C are electrically connected to the third toner circuit board 24C in a state where the third toner cartridge 2C is attached to the frame 12 of the drum cartridge 1. The four toner-side terminals 832 of the fourth group 832D are electrically connected to the fourth toner circuit board 24D in a state where the fourth toner cartridge 2D is attached to the frame 12 of the drum cartridge 1.

The toner-side terminals 832 of each of the first group 832A through the fourth group 832D include one toner-side voltage terminal 832*a*, one toner-side ground terminal 832*b*, one toner-side clock terminal 832*c*, and one toner-side signal terminal 832*d*.

The toner-side voltage terminal 832*a* for each of the first group 832A through the fourth group 832D is electrically connected to the transistor array 835 through a corresponding voltage relay line 833*a* (described later). Further, in a state where the toner cartridges 2 are attached to the frame 12 of the drum cartridge 1, each of the toner-side voltage terminals 832*a* is electrically connected to the corresponding voltage terminal 242*a* of the toner circuit board 24.

The toner-side ground terminal 832*b* for each of the first group 832A through the fourth group 832D is electrically connected to the main body-side ground terminal 831*b* through a ground relay line 833*b* (described later). Further, in a state where the toner cartridges 2 are attached to the frame 12 of the drum cartridge 1, each of the toner-side ground terminals 832*b* is electrically connected to the corresponding ground terminal 242*b* of the toner circuit board 24. As a result, ground voltage is supplied from the controller 802 to each of the toner circuit boards 24 through the drum circuit board 815.

The toner-side clock terminal 832*c* for each of the first group 832A through the fourth group 832D is electrically connected to CPU 837 through a toner-side clock relay line 8332*c* of clock relay lines 833*c* (described later). Further, in a state where the toner cartridges 2 are attached to the frame 12 of the drum cartridge 1, each of the toner-side clock terminals 832*c* is electrically connected to the corresponding clock terminal 242*c* of the toner circuit boards 24.

The toner-side signal terminal 832*d* for each of the first group 832A through the fourth group 832D is electrically connected to the CPU 837 through a toner-side signal relay lines 8332*d* of signal relay lines 833*d* (described later). Further, in a state where the toner cartridges 2 are attached to the frame 12 of the drum cartridge 1, each of the toner-side signal terminals 832*d* is electrically connected to the corresponding signal terminal 242*d* of the toner circuit boards 24. This allows a signal indicating various information to be exchanged between the controller 802 and the drum circuit board 815.

<8-3. Relay Lines>

As illustrated in FIG. 24, the relay lines 833 in the present embodiment include the voltage relay lines 833*a*, the ground relay line 833*b*, the clock relay lines 833*c*, and the signal relay lines 833*d*. Specifically, the number of the voltage relay lines 833*a* is plural, the number of the ground relay lines 833*b* is one, the number of the clock relay lines 833*c* is plural, and the number of the signal relay lines 833*d* is plural.

The voltage relay lines 833*a* include a main body-side voltage relay line 8331*a*, and toner-side voltage relay lines 8332*a*. In the present embodiment, the number of the main body-side voltage relay lines 8331*a* is one, and the number of the toner-side voltage relay lines 8332*a* is plural, specifically, four.

The main body-side voltage relay line 8331*a* has one end portion electrically connected to the main body-side voltage terminal 831*a*, and another end portion divided into two end portions. Specifically, the other end portion of the main body-side voltage relay line 8331*a* includes a first end portion and a second end portion. The first end portion of the main body-side voltage relay line 8331*a* is electrically connected to the CPU 837. The second end portion of the main body-side voltage relay line 8331*a* is electrically connected to the transistor array 835. Accordingly, in the drum circuit board 815, power supply voltage inputted into the main body-side voltage terminal 831*a* is supplied to the CPU 837 and the transistor array 835.

Each of the toner-side voltage relay lines 8332*a* has one end portion electrically connected to the transistor array 835, and another end portion electrically connected to the corresponding one of the toner-side voltage terminals 832*a*. Note that the CPU 837 and the transistor array 835 are electrically connected to each other.

The ground relay line 833*b* has one end portion electrically connected to the main body-side ground terminal 831*b*, and another end portion divided into six end portions. Specifically, the other end portion of the ground relay line 833*b* includes a first end portion, a second end portion, a third end portion, a fourth end portion, a fifth end portion, and a sixth end portion.

The first end portion of the ground relay line 833*b* is electrically connected to the toner-side ground terminal 832*b* of the first group 832A. The second end portion of the ground relay line 833*b* is electrically connected to the toner-side ground terminal 832*b* of the second group 832B. The third end portion of the ground relay line 833*b* is electrically connected to the toner-side ground terminal 832*b* of the third group 832C. The fourth end portion of the ground relay line 833*b* is electrically connected to the toner-side ground terminal 832*b* of the fourth group 832D. The fifth end portion of the ground relay line 833*b* is electrically connected to the CPU 837. The sixth end portion of the ground relay line 833*b* is electrically connected to the transistor array 835.

Accordingly, in the drum circuit board 815, ground voltage inputted into the main body-side ground terminal 831*b* is supplied to the four toner-side ground terminals 832*b*, the CPU 837, and the transistor array 835. In this way, by sharing the main body-side ground terminal 831*b*, the number of the main body-side terminals 831 can be reduced.

The clock relay lines 833*c* include a main body-side clock relay line 8331*c* and the toner-side clock relay line 8332*c*. In the present embodiment, the number of the main body-side clock relay lines 8331*c* is one, and the number of the toner-side clock relay lines 8332*c* is one.

The main body-side clock relay line 8331*c* has one end portion electrically connected to the main body-side clock terminal 831*c*, and another end portion electrically connected to the CPU 837. The toner-side clock relay line 8332*c* has one end portion electrically connected to the CPU 837, and another end portion divided into four end portions. Specifically, the other end portion of the toner-side clock relay line 8332*c* includes a first end portion, a second end portion, a third end portion, and a fourth end portion.

The first end portion of the toner-side clock relay line 8332*c* is electrically connected to the toner-side clock terminal 832*c* of the first group 832A. The second end portion of the toner-side clock relay line 8332*c* is electrically connected to the toner-side clock terminal 832*c* of the second group 832B. The third end portion of the toner-side clock relay line 8332*c* is electrically connected to the toner-side clock terminal 832*c* of the third group 832C. The fourth end portion of the toner-side clock relay line 8332*c* is electrically connected to the toner-side clock terminal 832*c* of the fourth group 832D.

Accordingly, in the drum circuit board 815, a clock signal inputted into the main body-side clock terminal 831*c* is supplied to the four toner-side clock terminals 832*c* through the CPU 837. By sharing the main body-side clock terminal 831*c* in this way, the number of the main body-side terminals 831 can be reduced.

The signal relay lines 833*d* include a main body-side signal relay line 8331*d*, and the toner-side signal relay line 8332*d*. In the present embodiment, the number of the main body-side signal relay lines 8331*d* is one, and the number of the toner-side signal relay lines 8332*d* is one.

The main body-side signal relay line 8331*d* has one end portion electrically connected to the main body-side signal terminal 831*d*, and another end portion electrically connected to the CPU 837. The toner-side signal relay line 8332*d* has one end portion electrically connected to the CPU 837, and another end portion divided into four end portions. Specifically, the other end portion of the toner-side signal relay line 8332*d* includes a first end portion, a second end portion, a third end portion, and a fourth end portion.

The first end portion of the toner-side signal relay line 8332*d* is electrically connected to the toner-side signal terminal 832*d* of the first group 832A. The second end portion of the toner-side signal relay line 8332*d* is electrically connected to the toner-side signal terminal 832*d* of the second group 832B. The third end portion of the toner-side signal relay line 8332*d* is electrically connected to the toner-side signal terminal 832*d* of the third group 832C. The fourth end portion of the toner-side signal relay line 8332*d* is electrically connected to the toner-side signal terminal 832*d* of the fourth group 832D.

Accordingly, in the drum circuit board 815, a signal inputted into the main body-side signal terminal 831*d* is supplied to the four toner-side signal terminals 832*d* the CPU 837. Thus, by sharing the main body-side signal terminal 831*d*, the number of the main body-side terminals 831 can be reduced.

<8-4. CPU and Transistor Array>

The CPU (Central Processing Unit) 837 is a processor configured to output an address signal in accordance with programs. In the present embodiment, the CPU 837 and the drum memory 851 are integrated as a single chip. However, the CPU 837 and the drum memory 851 may be chips separated from each other. The drum memory 851 stores therein programs that can be read by the CPU 837. The programs may be previously stored in the drum memory 851 before shipping the drum cartridge 1. Alternatively, the programs may be previously stored in the main body memory 106 of the image forming apparatus 100. In this case, when the image forming apparatus 100 is powered, the programs may be retrieved from the main body memory 106 and may be stored in the drum memory 851.

The CPU 837 receives a data signal from the controller 802 through the main body-side signal terminal 831*d*, and transmits the received data signal to each of the four toner-side signal terminals 832*d*. The data signal is a signal that indicates various information to be transmitted to a communication destination. Further, the CPU 837 generates an address signal in accordance with programs retrieved from the drum memory 851, then transmits the generated address signal to the transistor array 835. The address signal is a signal for selecting a communication destination.

The transistor array 835 is a switch circuit for switching connection of voltage lines. The transistor array 835 receives power supply voltage from the controller 802 through the main body-side voltage terminal 831*a*. Further, the transistor array 835 receives an address signal transmitted from the CPU 837. The transistor array 835 selects a communication destination from the four toner-side signal terminals 832*d* in accordance with the received address signal. With this configuration, the transistor array 835 selectively supplies power supply voltage to the toner-side signal terminal 832*d* that is designated as the communication destination.

That is, the transistor array 835 supplies power supply voltage to any of the four toner memories 241 selected as the communication destination. Each of the four toner memories 241 receives the data signal transmitted from the CPU 837 only when the power supply voltage is supplied thereto. Accordingly, a data signal can be selectively transmitted to a desired communication destination selected from the four toner memories 241. Therefore, there is no need to provide the main body-side signal terminal 831*d* for each of the four toner-side signal terminals 832*d*. Thus, the number of the main body-side signal terminals 831*d* can be reduced, and the number of the signal terminals 804*d* of the controller 802 can be reduced.

Particularly, the drum circuit board 815 according to the present embodiment receives an address signal and a data signal through one main body-side signal terminal 831*d*. This enables further reduction in the number of the main body-side signal terminals 831*d*. Further, the number of the signal terminals 804*d* of the controller 802 can also be further reduced.

Specifically, while five main body-side signal terminals 31*d* are required in the example of FIG. 6 of the first embodiment, only one main body-side signal terminal 831*d* is required in the example of FIG. 24 of the present embodiment. Further, while five signal terminals 104*d* of the controller 102 are required in the first embodiment, one signal terminal 804*d* is sufficient in the present embodiment.

<8-5. Relay of Information by Drum Circuit Board>

Also in the present embodiment, the controller 802 and each of the toner circuit boards 24 are connected to each other through the drum circuit board 815. Thus, the number of the terminals can be reduced in comparison with a case where each of the drum circuit board 815 and each of the toner circuit boards 24 are directly connected to the controller 802.

For example, as illustrated in FIG. 24, power supply voltage to be supplied to the drum memory 851 of the drum circuit board 815 and the toner memories 241 of the toner circuit boards 24 can be outputted through one main body-side voltage terminal 831*a*. Further, as illustrated in FIG. 24, ground voltage to be supplied to the drum memory 851 of the drum circuit board 815 and the toner memories 241 of the toner circuit boards 24 can be outputted through one main body-side ground terminal 831*b*. Further, as illustrated in FIG. 24, a clock signal to be supplied to the drum memory 851 of the drum circuit board 815 and the toner memories 241 of the toner circuit boards 24 can be outputted through one main body-side clock terminal 831*c*. This allows reduction in the number of the terminals 804 of the controller 802.

In particular, when the plurality of toner circuit boards 24 is provided as in the present embodiment, the number of the terminals can be further reduced by connecting the controller 802 and the plurality of the toner circuit boards 24 through the drum circuit board 815. For example, as illustrated in FIG. 24, power supply voltage to be supplied to the four toner circuit boards 24 can be outputted through one main body-side voltage terminal 831*a*. Further, as illustrated in FIG. 24, ground voltage to be supplied to the four toner circuit boards 24 can be outputted through one main body-side ground terminal 831*b*. Further, as illustrated in FIG. 24, a clock signal to be supplied to the four toner circuit boards 24 can be outputted through one main body-side clock terminal 831*c*. Accordingly, the number of the terminals 804 can be further reduced.

9. Ninth Embodiment

Figure 25:
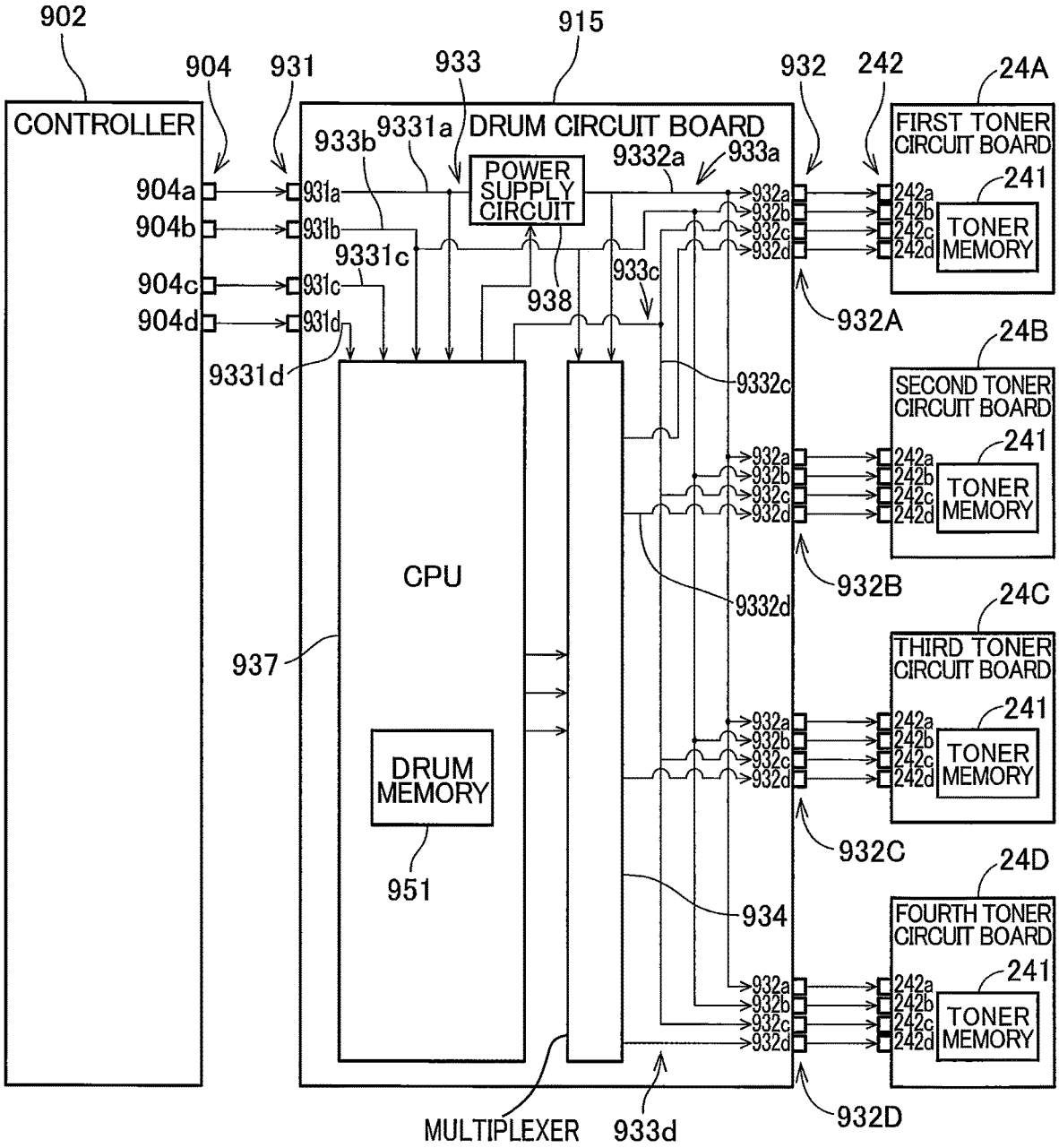
FIG. 25 is a block diagram illustrating electrical connection among a controller, a drum circuit board, and four toner circuit boards in an image forming apparatus according to a ninth embodiment.

A ninth embodiment of the present disclosure will be described with reference to FIG. 25, wherein like parts and components are designated by the same reference numerals as those illustrated in the first embodiment through eighth embodiment. FIG. 25 is a block diagram illustrating electrical connection among the controller 902, a drum circuit board 915, and the four toner circuit boards 24 according to the ninth embodiment.

In the ninth embodiment of FIG. 25, the drum cartridge 1 includes the drum circuit board 915, a drum memory 951, a multiplexer 934, a CPU 937, and a power supply circuit 938. The drum circuit board 915 includes a plurality of main body-side terminals 931, a plurality of toner-side terminals 932, and a plurality of relay lines 933. The multiplexer 934, the CPU 937, and the power supply circuit 938 are positioned on the drum circuit board 915.

<9-1. Main Body-Side Terminals>

Each of the main body-side terminals 931 is electrically connected to corresponding one of terminals 904 of the controller 902 through the first electrical terminal 13 in a state where the drum cartridge 1 is attached to the main casing 101 of the image forming apparatus 100. As a result, the drum circuit board 915 and the controller 902 are electrically connected to each other.

As illustrated in FIG. 25, the number of the main body-side terminals 931 according to the present embodiment is plural, that is, four. More specifically, the main body-side terminals 931 include one main body-side voltage terminal 931*a*, one main body-side ground terminal 931*b*, one main body-side clock terminal 931*c*, and one main body-side signal terminal 931*d*.

The main body-side voltage terminal 931*a* is electrically connected to a voltage terminal 904*a* of the terminals 904 of the controller 902 in a state where the drum cartridge 1 is attached to the main casing 101 of the image forming apparatus 100. With this configuration, power supply voltage is supplied from the controller 902 to the drum circuit board 915.

The main body-side ground terminal 931*b* is electrically connected to a ground terminal 904*b* of the terminals 904 of the controller 902 in a state where the drum cartridge 1 is attached to the main casing 101 of the image forming apparatus 100. This configuration allows ground voltage to be supplied from the controller 902 to the drum circuit board 915.

The main body-side clock terminal 931*c* is electrically connected to a clock terminal 904*c* of the terminals 904 of the controller 902 in a state where the drum cartridge 1 is attached to the main casing 101 of the image forming apparatus 100. Accordingly, a clock signal is supplied from the controller 902 to the drum circuit board 915 at constant time intervals.

The main body-side signal terminal 931*d* is electrically connected to a signal terminal 904*d* of the terminals 904 of the controller 902 in a state where the drum cartridge 1 is attached to the main casing 101 of the image forming apparatus 100. This allows a signal indicating various information to be exchanged between the controller 902 and the drum circuit board 915.

<9-2. Toner-Side Terminals>

Each of the toner-side terminals 932 is electrically connected to the corresponding toner circuit board 24 of the toner cartridges 2 through the corresponding second electrical terminal 14 in a state where the four toner cartridges 2 are attached to the frame 12 of the drum cartridge 1. Accordingly, the drum circuit board 915 is electrically connected to each of the toner circuit boards 24. As illustrated in FIG. 25, in the present embodiment, the number of the toner-side terminals 932 is sixteen (16) in total.

The sixteen toner-side terminals 932 include a first group 932A having four toner-side terminals 932, a second group 932B having four toner-side terminals 932, a third group 932C having four toner-side terminals 932, and a fourth group 932D having four toner-side terminals 932.

The four toner-side terminals 932 of the first group 932A are electrically connected to the first toner circuit board 24A in a state where the first toner cartridge 2A is attached to the frame 12 of the drum cartridge 1. The four toner-side terminals 932 of the second group 932B are electrically connected to the second toner circuit board 24B in a state where the second toner cartridge 2B is attached to the frame 12 of the drum cartridge 1. The four toner-side terminals 932 of the third group 932C are electrically connected to the third toner circuit board 24C in a state where the third toner cartridge 2C is attached to the frame 12 of the drum cartridge 1. The four toner-side terminals 932 of the fourth group 932D are electrically connected to the fourth toner circuit board 24D in a state where the fourth toner cartridge 2D is attached to the frame 12 of the drum cartridge 1.

The toner-side terminals 932 of each of the first group 932A through the fourth group 932D include one toner-side voltage terminal 932*a*, one toner-side ground terminal 932*b*, one toner-side clock terminal 932*c*, and one toner-side signal terminal 932*d*.

The toner-side voltage terminal 932*a* for each of the first group 932A through the fourth group 932D is electrically connected to the main body-side voltage terminal 931*a* through voltage relay lines 933*a* (described later), the CPU 937, and the power supply circuit 938. Further, in a state where the toner cartridges 2 are attached to the frame 12 of the drum cartridge 1, each of the toner-side voltage terminals 932*a* is electrically connected to the corresponding voltage terminal 242*a* of the toner circuit boards 24. With this configuration, power supply voltage is supplied from the controller 902 to each of the toner circuit board 24 through the drum circuit board 915.

The toner-side ground terminal 932*b* for each of the first group 932A through the fourth group 932D is electrically connected to the main body-side ground terminal 931*b* through a ground relay line 933*b* (described later). Further, in a state where the toner cartridges 2 are attached to the frame 12 of the drum cartridge 1, each of the toner-side ground terminals 932*b* is electrically connected to the corresponding ground terminal 242*b* of the toner circuit boards 24. As a result, ground voltage is supplied from the controller 902 to each of the toner circuit boards 24 through the drum circuit board 915.

The toner-side clock terminal 932*c* is electrically connected to the CPU 937 through a toner-side clock relay line 9332*c* of clock relay lines 933*c* (described later). Further, each of the toner-side clock terminal 932*c* is electrically connected to the corresponding one of the clock terminals 242*c* of the toner circuit boards 24 in a state where the toner cartridges 2 are attached to the frame 12 of the drum cartridge 1.

The toner-side signal terminal 932*d* for each of the first group 932A through the fourth group 932D is electrically connected to the multiplexer 934 through a corresponding toner-side signal relay line 9332*d* of signal relay lines 933*d* (described later). Further, in a state where the toner cartridges 2 are attached to the frame 12 of the drum cartridge 1, each of the toner-side signal terminals 932*d* is electrically connected to the corresponding signal terminal 242*d* of the toner circuit boards 24.

<9-3. Relay Lines>

As illustrated in FIG. 25, the relay lines 933 in the present embodiment include the voltage relay lines 933*a*, the ground relay line 933*b*, the clock relay lines 933*c*, and the signal relay lines 933*d*. More specifically, the number of the voltage relay lines 933*a* is plural, the number of the ground relay lines 933*b* is one, the number of the clock relay lines 933*c* is plural, and the number of the signal relay lines 933*d* is plural.

The voltage relay lines 933*a* include a main body-side voltage relay line 9331*a* and a toner-side voltage relay line 9332*a*. In the present embodiment, the number of the main body-side voltage relay lines 9331*a* is one, and the number of the toner-side voltage relay lines 9332*a* is one.

The main body-side voltage relay line 9331*a* has one end portion electrically connected to the main body-side voltage terminal 931*a*, and another end portion divided into two end portions. More specifically, the other end portion of the main body-side voltage relay line 9331*a* includes a first end portion and a second end portion. The first end portion of the main body-side voltage relay line 9331*a* is electrically connected to the CPU 937, while the second end portion of the main body-side voltage relay line 9331*a* is electrically connected to the power supply circuit 938. Accordingly, in the drum circuit board 915, power supply voltage inputted into the main body-side voltage terminal 931*a* is supplied to the CPU 937 and the power supply circuit 938.

The CPU 937 and the power supply circuit 938 are electrically connected to each other. The toner-side voltage relay line 9332*a* has one end portion electrically connected to the power supply circuit 938, and another end portion divided into five end portions. More specifically, the other end portion of the toner-side voltage relay line 9332*a* includes a first end portion, a second end portion, a third end portion, a fourth end portion, and a fifth end portion.

The first end portion of the toner-side voltage relay line 9332*a* is electrically connected to the toner-side voltage terminal 932*a* of the first group 932A. The second end portion of the toner-side voltage relay line 9332*a* is electrically connected to the toner-side voltage terminal 932*a* of the second group 932B. The third end portion of the toner-side voltage relay line 9332*a* is electrically connected to the toner-side voltage terminal 932*a* of the third group 932C. The fourth end portion of the toner-side voltage relay line 9332*a* is electrically connected to the toner-side voltage terminal 932*a* of the fourth group 932D. The fifth end portion of the toner-side voltage relay line 9332*a* is electrically connected to the multiplexer 934.

Therefore, in the drum circuit board 915, the power supply voltage outputted from the power supply circuit 938 is supplied to the four toner-side voltage terminals 932*a* and the multiplexer 934.

The ground relay line 933*b* has one end portion electrically connected to the main body-side ground terminal 931*b*, and another end portion divided into six end portions. Specifically, the other end portion of the ground relay line 933*b* includes a first end portion, a second end portion, a third end portion, a fourth end portion, a fifth end portion, and a sixth end portion.

The first end portion of the ground relay line 933*b* is electrically connected to the toner-side ground terminal 932*b* of the first group 932A. The second end portion of the ground relay line 933*b* is electrically connected to the toner-side ground terminal 932*b* of the second group 932B. The third end portion of the ground relay line 933*b* is electrically connected to the toner-side ground terminal 932*b* of the third group 932C. The fourth end portion of the ground relay line 933*b* is electrically connected to the toner-side ground terminal 932*b* of the fourth group 932D. The fifth end portion of the ground relay line 933*b* is electrically connected to the CPU 937. The sixth end portion of the ground relay line 933*b* is electrically connected to the multiplexer 934.

Accordingly, in the drum circuit board 915, ground voltage inputted into the main body-side ground terminal 931*b* is supplied to the four toner-side ground terminals 932*b*, the CPU 937, and the multiplexer 934. Thus, by sharing the main body-side ground terminal 931*b*, the number of the main body-side terminals 931 can be reduced.

The clock relay lines 933*c* include a main body-side clock relay line 9331*c* and a toner-side clock relay line 9332*c*. In the present embodiment, the number of the main body-side clock relay lines 9331*c* is one, and the number of the toner-side clock relay lines 9332*c* is one.

The main body-side clock relay line 9331*c* has one end portion electrically connected to the main body-side clock terminal 931*c*, and another end portion electrically connected to the CPU 937. The toner-side clock relay line 9332*c* has one end portion electrically connected to the CPU 937, and another end portion divided into four end portions. Specifically, the other end portion of the toner-side clock relay line 9332*c* includes a first end portion, a second end portion, a third end portion, and a fourth end portion.

The first end portion of the toner-side clock relay line 9332*c* is electrically connected to the toner-side clock terminal 932*c* of the first group 932A. The second end portion of the toner-side clock relay line 9332*c* is electrically connected to the toner-side clock terminal 932*c* of the second group 932B. The third end portion of the toner-side clock relay line 9332*c* is electrically connected to the toner-side clock terminal 932*c* of the third group 932C. The fourth end portion of the toner-side clock relay line 9332*c* is electrically connected to the toner-side clock terminal 932*c* of the fourth group 932D. Accordingly, in the drum circuit board 915, a clock signal outputted from the CPU 937 is supplied to the four toner-side clock terminals 932*c*.

The signal relay lines 933*d* include a main body-side signal relay line 9331*d* and toner-side signal relay lines 9332*d*. In the present embodiment, the number of the main body-side signal relay lines 9331*d* is one, and the number of the toner-side signal relay lines 9332*d* is plural, specifically, four.

The main body-side signal relay line 9331*d* has one end portion electrically connected to the main body-side signal terminal 931*d*, and another end portion electrically connected to the CPU 937. Each of the toner-side signal relay lines 9332*d* has one end portion electrically connected to the CPU 937, and another end portion electrically connected to the corresponding one of the toner-side signal terminals 932*d*.

The CPU 937 and the multiplexer 934 are electrically connected to each other.

<9-4. CPU and Multiplexer>

The CPU (Central Processing Unit) 937 is a processor configured to output an address signal in accordance with programs. In the present embodiment, the CPU 937 and the drum memory 951 are integrally formed as a single chip. However, the CPU 937 and the drum memory 951 may be independent from each other. The drum memory 951 stores therein programs that can be read by the CPU 937. The programs may previously be stored in the drum memory 951 before shipping the drum cartridge 1. Alternatively, the programs may be previously stored in the main body memory 106 of the image forming apparatus 100. In this case, when the image forming apparatus 100 is powered, the programs may be retrieved from the main body memory 106 and stored in the drum memory 951.

The CPU 937 receives a data signal from the controller 902 through the main body-side signal terminal 931*d*, and transmits the received data signal to the multiplexer 934. The data signal is a signal indicating various information to be transmitted to a communication destination. The CPU 937 generates an address signal in accordance with programs retrieved from the drum memory 951. Then, the CPU 937 transmits the generated address signal to the multiplexer 934. The address signal is a signal for selecting a communication destination.

The multiplexer 934 is a switch circuit for switching connection of signal lines. The multiplexer 934 receives the address signal from the CPU 937 and selects a communication destination from the four toner-side signal terminals 932*d* in accordance with the received address signal. That is, the multiplexer 934 is controlled by the CPU 937. Further, the multiplexer 934 receives the data signal from the CPU 937. The multiplexer 934 selectively outputs the received data signal to the toner-side signal terminal 932*d* selected as the communication destination.

By employing the CPU 937 and the multiplexer 934 as in the present embodiment, the communication destination of the data signal can be selected from the four toner memories 241, and the data signal can be transmitted to the selected communication destination. Accordingly, there is no need to provide the main body-side signal terminal 931*d* individually for all the four toner-side signal terminals 932*d*. Thus, the number of the main body-side signal terminals 931*d* can be reduced. Further, the number of the signal terminals 904*d* of the controller 902 can be also reduced.

Specifically, while five main body-side signal terminals 31*d* are required in the example of FIG. 6 of the first embodiment, only one main body-side signal terminal 931*d* is necessary in the example of FIG. 25 of the present embodiment. Further, while five signal terminals 104*d* of the controller 102 are required in the first embodiment, only one signal terminal 904*d* is necessary in the present embodiment.

<9-5. Relay of Information by Drum Circuit Board>

Also in the present embodiment, the controller 902 and each of the toner circuit boards 24 are connected to each other through the drum circuit board 915. Thus, the number of the terminals can be reduced in comparison with a case where each of the drum circuit board 915 and each of the toner circuit boards 24 are directly connected to the controller 902.

For example, as illustrated in FIG. 25, power supply voltage to be supplied to the drum memory 951 of the drum circuit board 915 and the toner memories 241 of the toner circuit boards 24 can be outputted through one main body-side voltage terminal 931*a*. Further, as illustrated in FIG. 25, ground voltage to be supplied to the drum memory 951 of the drum circuit board 915 and the toner memories 241 of the toner circuit boards 24 can be outputted through one main body-side ground terminal 931*b*. Further, as illustrated in FIG. 25, a clock signal to be supplied to the drum memory 951 of the drum circuit board 915 and the toner memories 241 of the toner circuit boards 24 can be outputted through one main body-side clock terminal 931*c*. This allows reduction in the number of the terminals 104 of the controller 902.

In particular, when the plurality of toner circuit boards 24 is provided as in the present embodiment, the number of the terminals can be further reduced by connecting the controller 902 and the plurality of the toner circuit boards 24 through the drum circuit board 915. For example, as illustrated in FIG. 25, power supply voltage to be supplied to the four toner circuit boards 24 can be outputted through one main body-side voltage terminal 931*a*. Further, as illustrated in FIG. 25, ground voltage to be supplied to the four toner circuit boards 24 can be outputted through one main body-side ground terminal 931*b*. Further, as illustrated in FIG. 25, a clock signal to be supplied to the four toner circuit boards 24 can be outputted through one main body-side clock terminal 931*c*. Accordingly, the number of the terminals 104 can be further reduced.

10. Modifications

While the description has been made with reference to the first embodiment through the ninth embodiment, it would be apparent to those skilled in the art that various modifications and variations may be made thereto.

Configurations of components, configurations of circuits, and the procedures in the embodiments are merely an example. Components used in the embodiments described above may be replaced with the other known components without departing from scope of the disclosure. Further, various features appearing in the embodiments described above may be suitably combined together avoiding conflicting combination.

In the embodiments described above, the drum circuit board is used to relay transmission of the information stored in the toner memory to the controller. However, the drum circuit board may not necessarily relay the information stored in the toner memory to the controller. For example, the controller of the image forming apparatus and the toner memory may be electrically connected to each other without interposing the drum memory therebetween.

What is claimed is:

1. An image forming apparatus comprising:

a toner cartridge configured to accommodate toner therein, the toner cartridge including a toner memory;

a drum cartridge to which the toner cartridge is attachable, the drum cartridge including:

a photosensitive drum; and a drum memory; and a controller configured to perform a process after attachment of the drum cartridge to the image forming apparatus, the process including:

a first determination process to determine whether communication with the drum memory is established; and after determining in the first determination process that the communication with the drum memory is established, a second determination process to determine whether communication with the toner memory is established, wherein the drum cartridge further includes a drum circuit board configured to relay transmission of information stored in the toner memory to the controller in a state where the toner cartridge is attached to the drum cartridge.

2. The image forming apparatus according to claim 1, wherein the first determination process includes determining whether the drum memory is authenticated, and wherein the second determination process includes determining whether the toner memory is authenticated.

3. The image forming apparatus according to claim 2, wherein the controller includes:

a main body memory storing a first drum authentication information and a first toner authentication information; and a processor, wherein the first determination process and the second determination process are performed by the processor, wherein the first determination process includes transmitting the first drum authentication information to the drum memory, and wherein the second determination process includes transmitting the first toner authentication information to the toner memory.

4. The image forming apparatus according to claim 3, wherein the main body memory further stores a first prescribed value and a second prescribed value, wherein the first determination process further includes:

in response to the transmitting the first drum authentication information to the drum memory, receiving a first response value from the drum memory; and comparing the first prescribed value with the first response value, and wherein the second determination process further includes:

in response to the transmitting the first toner authentication information to the toner memory, receiving a second response value from the toner memory; and comparing the second prescribed value with the second response value.

5. The image forming apparatus according to claim 4, wherein the processor is configured to further perform:

when the comparing the first prescribed value with the first response value shows that the first prescribed value is coincident with the first response value, determining that the drum memory is authenticated; and when the comparing the second prescribed value with the second response value shows that the second prescribed value is coincident with the second response value, determining that the toner memory is authenticated.

6. The image forming apparatus according to claim 5, wherein, in the comparing the first prescribed value with the first response value, the processor is configured to perform:

determining whether the first prescribed value is coincident with the first response value; and in response to the determining that the first prescribed value is coincident with the first response value, determining that the drum memory is authenticated, and wherein, in the comparing the second prescribed value with the second response value, the processor is configured to perform:

determining whether the second prescribed value is coincident with the second response value; and in response to the determining that the second prescribed value is coincident with the second response value, determining that the toner memory is authenticated.

7. The image forming apparatus according to claim 3, wherein the main body memory stores a second drum authentication information and a second toner authentication information, wherein the first determination process further includes:

in response to the transmitting the first drum authentication information to the drum memory, receiving a first response value from the drum memory;

transmitting the second drum authentication information to the main body memory;

in response to the transmitting the second drum authentication information to the main body memory, receiving a third response value from the main body memory; and comparing the first response value with the third response value, and wherein the second determination process further includes:

in response to the transmitting the first toner authentication information to the toner memory, receiving a second response value from the toner memory;

transmitting the second toner authentication information to the main body memory;

in response to the transmitting the second toner authentication information to the main body memory, receiving a fourth response value from the main body memory; and comparing the second response value with the fourth response value.

8. The image forming apparatus according to claim 7, wherein the main body memory includes a first area and a second area different from the first area, wherein the first area of the main body memory stores the second drum authentication information and the second toner authentication information, wherein the transmitting transmits the second drum authentication information to the second area of the main body memory, wherein the receiving receives the third response value from the second area of the main body memory, wherein the transmitting transmits the second toner authentication information to the second area of the main body memory, and wherein the receiving receives the fourth response value from the second area of the main body memory.

9. The image forming apparatus according to claim 7, wherein the processor is configured to further perform:

when the comparing the first response value with the third response value shows that the first response value is coincident with the third response value, determining that the drum memory is authenticated; and when the comparing the second response value with the fourth response value shows that the second response value is coincident with the fourth response value, determining that the toner memory is authenticated.

10. The image forming apparatus according to claim 9, wherein, in the comparing the first response value with the third response value, the processor is configured to perform:

determining whether the first response value is coincident with the third response value; and in response to the determining that the first response value is coincident with the third response value, determining that the drum memory is authenticated, and wherein, in the comparing the second response value with the fourth response value, the processor is configured to perform:

determining whether the second response value is coincident with the fourth response value; and in response to the determining that the second response value is coincident with the fourth response value, determining that the toner memory is authenticated.

11. The image forming apparatus according to claim 1, wherein the controller is configured to further perform an error outputting process, the error outputting process including:

in response to determining in the first determination process that the communication with the drum memory is not established, outputting a first error; and in response to determining in the second determination process that the communication with the toner memory is not established, outputting a second error.

12. The image forming apparatus according to claim 11, further comprising a display, wherein the outputting a first error includes displaying the first error on the display, wherein the outputting a second error includes displaying the second error on the display, and wherein the controller performs the displaying the first error on the display in preference to the displaying the second error on the display.

13. The image forming apparatus according to claim 12, wherein the controller performs the displaying the first error on the display prior to the displaying the second error on the display.

14. The image forming apparatus according to claim 1, further comprising another toner cartridge attachable to the drum cartridge, the another toner cartridge including another toner memory, wherein the drum circuit board is further configured to relay transmission of information stored in the another toner memory to the controller in a state where the another toner cartridge is attached to the drum cartridge.

15. The image forming apparatus according to claim 1, wherein the drum memory is positioned on the drum circuit board.

16. An image forming apparatus comprising:

a toner cartridge including a toner memory;

a drum cartridge to which the toner cartridge is attachable, the drum cartridge including:

a photosensitive drum; and a drum memory; and a controller configured to perform a process after attachment of the drum cartridge to the image forming apparatus, the process including:

a first determination process to determine whether communication with the drum memory is established;

after determining in the first determination process that the communication with the drum memory is established, a second determination process to determine whether communication with the toner memory is established; and an error outputting process including:

in response to determining in the first determination process that the communication with the drum memory is not established, outputting a first error; and in response to determining in the second determination process that the communication with the toner memory is not established, outputting a second error, the outputting a first error being performed in preference to the outputting a second error, wherein the drum cartridge further includes a drum circuit board configured to relay transmission of information stored in the toner memory to the controller in a state where the toner cartridge is attached to the drum cartridge.

17. The image forming apparatus according to claim 16, further comprising a display, wherein the outputting a first error includes displaying the first error on the display, and wherein the outputting a second error includes displaying the second error on the display.

18. The image forming apparatus according to claim 17, wherein the controller performs the displaying the first error on the display prior to the displaying the second error on the display.

19. The image forming apparatus according to claim 16, wherein the controller is configured to perform, in response to determining in the first determination process that the communication with the drum memory is established, the second determination process.

20. The image forming apparatus according to claim 16, wherein the first determination process includes determining whether the drum memory is authenticated, and wherein the second determination process includes determining whether the toner memory is authenticated.

21. An image forming apparatus comprising:

a toner cartridge including a toner memory;

a drum cartridge to which the toner cartridge is attachable, the drum cartridge including:

a photosensitive drum; and a drum memory; and a controller configured to perform a process after attachment of the drum cartridge to the image forming apparatus, the process including:

a first determination process to determine whether communication with the drum memory is established;

after determining in the first determination process that the communication with the drum memory is established, a second determination process to determine whether communication with the toner memory is established;

retrieving information stored in the toner memory from the toner memory; and writing the information retrieved from the toner memory in the retrieving into the drum memory, wherein the drum cartridge further includes a drum circuit board configured to relay transmission of information stored in the toner memory to the controller in a state where the toner cartridge is attached to the drum cartridge.

22. The image forming apparatus according to claim 21, wherein the information stored in the toner memory includes information for identifying individual of the toner cartridge attached to the drum cartridge.

23. The image forming apparatus according to claim 21, wherein the information stored in the toner memory includes information indicating a use history of the toner cartridge.

24. The image forming apparatus according to claim 21, further comprising another toner cartridge attachable to the drum cartridge, the another toner cartridge including another toner memory, wherein the retrieving includes retrieving information stored in the another toner memory from the another toner memory, and wherein the writing includes writing the information retrieved from the another toner memory in the retrieving to the drum memory.

25. The image forming apparatus according to claim 21, wherein the drum memory includes:

a first storage area, information stored in the first storage area being non-rewritable; and a second storage area, information stored in the second storage area being rewritable.

26. The image forming apparatus according to claim 25, wherein the drum memory is capable of storing information indicating usages of the drum cartridge in the second storage area, the information indicating usages of the drum cartridge stored in the second storage area being rewritable.

27. The image forming apparatus according to claim 26, wherein the usages of the drum cartridge includes a rotation amount of the photosensitive drum, the rotation amount of the photosensitive drum being an accumulated rotation amount indicating how many times the photosensitive drum has rotated.

28. The image forming apparatus according to claim 26, wherein the usages of the drum cartridge includes a charged time of the photosensitive drum, the charged time of the photosensitive drum being an accumulated period of time indicating how long the photosensitive drum has been charged in total.

* * * * *